US009551540B2

(12) United States Patent
Jindou et al.

(10) Patent No.: US 9,551,540 B2
(45) Date of Patent: Jan. 24, 2017

(54) HEAT EXCHANGER

(71) Applicant: DAIKIN INDUSTRIES, LTD., Osaka-shi, Osaka (JP)

(72) Inventors: Masanori Jindou, Sakai (JP); Yoshio Oritani, Sakai (JP); Takuya Kazusa, Sakai (JP); Yasutaka Ohtani, Sakai (JP); Junichi Hamadate, Sakai (JP); Yoshimasa Kikuchi, Sakai (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 14/359,268

(22) PCT Filed: Nov. 22, 2012

(86) PCT No.: PCT/JP2012/007533
§ 371 (c)(1),
(2) Date: May 19, 2014

(87) PCT Pub. No.: WO2013/076993
PCT Pub. Date: May 30, 2013

(65) Prior Publication Data

US 2014/0338874 A1 Nov. 20, 2014

(30) Foreign Application Priority Data

Nov. 22, 2011 (JP) ..... 2011-255345
Apr. 27, 2012 (JP) ..... 2012-103178

(51) Int. Cl.
*F28F 9/02* (2006.01)
*F25B 39/02* (2006.01)
(Continued)

(52) U.S. Cl.
CPC ..... *F28F 9/0204* (2013.01); *F25B 39/028* (2013.01); *F28D 1/05391* (2013.01);
(Continued)

(58) Field of Classification Search
CPC ..... F28F 9/0204; F28F 9/0207; F28F 9/027; F28F 9/0273; F28F 9/0275; F28F 9/0278; F28F 9/028; F28F 9/0282; F28F 9/026; F28F 9/0265; F28F 9/0268; F28D 1/05391; F25B 39/028
(Continued)

(56) References Cited

U.S. PATENT DOCUMENTS 3,196,943 A * 7/1965 Haerter ..... F28F 9/0265 165/174
5,203,407 A * 4/1993 Nagasaka ..... 165/174
(Continued)

FOREIGN PATENT DOCUMENTS

JP 6-74609 A 3/1994
JP 9-264693 A 10/1997
(Continued)

OTHER PUBLICATIONS

International Search Report issued in PCT/JP2012/007533, mailed on Feb. 5, 2013.

*Primary Examiner* — Len Tran
*Assistant Examiner* — Hans Weiland
(74) *Attorney, Agent, or Firm* — Birch, Stewart, Kolasch & Birch, LLP

(57) ABSTRACT

A lower space of a first header collecting pipe of a heat exchanger is, by partitions, divided into three communication chambers and a single mixing chamber. The mixing chamber communicates with the communication chamber through a through-hole of a lower horizontal partition, communicates with the communication chamber through a through-hole of a vertical partition, and communicates with the communication chamber through a through-hole of an upper horizontal partition. Gas-liquid refrigerant flows into the mixing chamber, and is mixed in the mixing chamber. Then, the refrigerant is distributed to the communication
(Continued)

chambers. Thus, the wetness of refrigerant flowing into a flat tube is uniformized among the flat tubes, and performance of the heat exchanger can be fully achieved.

10 Claims, 25 Drawing Sheets

(51) Int. Cl.
*F28D 1/053* (2006.01)
*F28F 1/02* (2006.01)

(52) U.S. Cl.
CPC ..... *F28F 9/0207* (2013.01); *F28F 9/027* (2013.01); *F28F 9/028* (2013.01); *F28F 9/0278* (2013.01); *F28F 1/022* (2013.01)

(58) Field of Classification Search
USPC ..... 165/143, 144, 150, 151, 153, 173, 174
See application file for complete search history.

(56) References Cited

U.S. PATENT DOCUMENTS

| | | | | |
|---|---|---|---|---|
| 5,901,785 | A | 5/1999 | Chiba et al. | |
| 5,979,547 | A * | 11/1999 | Shinmura et al. | 165/174 |
| 6,199,401 | B1 * | 3/2001 | Haussmann | 165/174 |
| 2009/0120627 | A1 | 5/2009 | Beamer et al. | |
| 2010/0206535 | A1 * | 8/2010 | Munoz | F25B 39/028 165/173 |

FOREIGN PATENT DOCUMENTS

| | | | |
|---|---|---|---|
| JP | 2002-139292 | A | 5/2002 |
| JP | 2004-226030 | A | 8/2004 |
| JP | 2009-270781 | A | 11/2009 |
| WO | WO 2009/048451 | A1 | 4/2009 |

* cited by examiner (A) CROSS SECTION ALONG K-K LINE (B) CROSS SECTION ALONG L-L LINE (A)

(B)

HEAT EXCHANGER

TECHNICAL FIELD

The present disclosure relates to a heat exchanger including a pair of header collecting pipes and a plurality of flat tubes connected to each header collecting pipe, and configured to exchange heat between air and fluid flowing through each flat tube.

BACKGROUND ART

Conventionally, a heat exchanger has been known, which includes many flat tubes and header collecting pipes connected to the flat tubes and which is configured to exchange heat between refrigerant flowing through each flat tube and air flowing outside the each flat tube. In a heat exchanger disclosed in Patent Document 1, many vertically-extending flat tubes are arranged in the horizontal direction, and a header collecting pipe is connected to a lower end of each flat tube. Moreover, in a heat exchanger disclosed in Patent Document 2, many horizontally-extending flat tubes are arranged in the vertical direction, and a header collecting pipe is connected to an end part of each flat tube.

Refrigerant supplied to the heat exchanger of this type first flows into the header collecting pipe, and then flows so as to branch into the flat tubes. If the heat exchanger of this type functions as an evaporator of a refrigerating apparatus, refrigerant in the two phases of gas and liquid is supplied to the heat exchanger. That is, in this case, the refrigerant in the two phases of gas and liquid is distributed to the flat tubes through the header collecting pipe.

The heat exchanger functioning as the evaporator as in Patent Document 1 is designed such that the mass flow rate of refrigerant flowing into the flat tube is uniformized among the flat tubes. The structure of the heat exchanger disclosed in Patent Document 1 will be described in detail below.

In the heat exchanger of Patent Document 1, a distribution space is formed lateral to an end part of the header collecting pipe, and refrigerant in the two phases of gas and liquid is introduced into the distribution space. In the heat exchanger, an internal space of the header collecting pipe is divided into three chambers arranged in the horizontal direction. Moreover, in the heat exchanger, three distribution paths vertically arranged in line are formed in a partition separating the distribution space and the internal space of the header collecting pipe from each other. Each distribution path is formed for a corresponding one of the chambers of the header collecting pipe. Each distribution path causes a corresponding one of the chambers of the header collecting pipe to communicate with the distribution space. Refrigerant flowing into the distribution space is distributed to each chamber of the header collecting pipe through a corresponding one of the distribution paths, and then flows so as to branch into the flat tubes communicating with the each chamber of the header collecting pipe.

Gravity acts on refrigerant in the two phases of gas and liquid in the distribution space. Thus, as will be seen from paragraph 0018 and FIG. 1 of Patent Document 1, the void fraction for refrigerant increases toward the upper side in the distribution space. That is, in the distribution space, the percentage of low-density gas refrigerant increases toward the upper side, whereas the percentage of high-density liquid refrigerant increases toward the lower side.

In the heat exchanger illustrated in FIG. 1 of Patent Document 1, the number of flat tubes communicating with each chamber of the header collecting pipe is changed in order to equalize the mass flow rate of refrigerant flowing into each flat tube. That is, the number of flat tubes communicating with the chamber corresponding to the uppermost distribution path is the smallest because refrigerant containing much gas refrigerant flows into the uppermost distribution path and the mass flow rate of refrigerant flowing into the chamber corresponding to the uppermost distribution path is relatively low. On the other hand, the number of flat tubes communicating with the chamber corresponding to the lowermost distribution path is the largest because refrigerant containing much liquid refrigerant flows into the lowermost distribution path and the mass flow rate of refrigerant flowing into the chamber corresponding to the lowermost distribution path is relatively high.

In the heat exchanger illustrated in FIG. 5 of Patent Document 1, the diameter of each distribution path is changed in order to equalize the mass flow rate of refrigerant flowing into each flat tube. That is, since refrigerant containing much gas refrigerant flows into the uppermost distribution path, the diameter of the uppermost distribution path is set to the maximum diameter to increase the volumetric flow rate of refrigerant passing through the uppermost distribution path, thereby ensuring the mass flow rate of refrigerant flowing into the chamber corresponding to the uppermost distribution path. On the other hand, since refrigerant containing much liquid refrigerant flows into the lowermost distribution path, the diameter of the lowermost distribution path is set to the minimum diameter to decrease the volumetric flow rate of refrigerant passing through the lowermost distribution path, thereby ensuring the mass flow rate of refrigerant flowing into the chamber corresponding to the lowermost distribution path.

CITATION LIST

Patent Document

PATENT DOCUMENT 1: Japanese Unexamined Patent Publication No. H09-264693

PATENT DOCUMENT 2: Japanese Unexamined Patent Publication No. H06-074609

SUMMARY OF THE INVENTION

Technical Problem

In order to make full use of performance of a heat exchanger including many flat tubes, the ratio (i.e., the wetness of refrigerant) between gas refrigerant and liquid refrigerant contained in refrigerant flowing into the flat tube is preferably uniformized among the flat tubes. That is, the case where the wetness of refrigerant flowing into the flat tube is non-uniform among the flat tubes results in the following state: in the flat tube into which low-wetness refrigerant flows, the low-wetness refrigerant turns into the single phase of gas right after flowing into the flat tube; and in the flat tube into which high-wetness refrigerant flows, liquid refrigerant still remains in the high-wetness refrigerant at an outlet of the flat tube. Accordingly, the amount of heat absorbed by refrigerant flowing through the flat tube is non-uniform among the flat tubes, and therefore performance of the heat exchanger is not fully achieved.

In the heat exchanger of Patent Document 1, the mass flow rate of refrigerant flowing into the flat tubes is uniformized among the flat tubes, but the wetness of refrigerant flowing into the flat tube is non-uniform among the flat tubes. For such reasons, performance of the heat exchanger of Patent Document 1 is susceptible to improvement on the foregoing points.

The present disclosure has been made in view of the foregoing, and aims to uniformize, in a heat exchanger including a plurality of flat tubes, the wetness of refrigerant flowing into the flat tube among the flat tubes to fully achieve performance of the heat exchanger.

Solution to the Problem

A first aspect of the invention is intended for a heat exchanger including a plurality of flat tubes (32); a first header collecting pipe (60) connected to one ends of the flat tubes (32); a second header collecting pipe (70) connected to the other ends of the flat tubes (32); and a plurality of fins (36) joined to the flat tubes (32). The heat exchanger is configured to exchange heat between fluid flowing through each flat tube (32) and air flowing outside the each flat tube (32), and is capable of functioning as an evaporator. The first header collecting pipe (60) and the second header collecting pipe (70) are in a standing attitude. The first header collecting pipe (60) is formed with a connection port (66) connected to a pipe through which refrigerant flows, a mixing chamber (63) communicating with the connection port (66) and configured to mix liquid refrigerant and gas refrigerant of gas-liquid refrigerant flowing into the mixing chamber (63) through the connection port (66) to homogenize the gas-liquid refrigerant, a plurality of communication chambers (62*a*-62*c*) arranged in a vertical direction and each communicating with one or more of the flat tubes (32), and a plurality of distribution paths (65) configured to distribute the homogenized refrigerant of the mixing chamber (63) to the communication chambers (62*a*-62*c*).

In the first aspect of the invention, each flat tube (32) is, at one end thereof, connected to the standing first header collecting pipe (60), and is, at the other end thereof, connected to the standing second header collecting pipe (70). In the heat exchanger (23) of the first aspect of the invention, the flat tubes (32) are arranged in the vertical direction. In the standing first header collecting pipe (60), the communication chambers (62*a*-62*c*) are formed so as to be arranged in the vertical direction. One or more flat tubes (32) are connected to each communication chamber (62*a*-62*c*).

In the first aspect of the invention, the pipe forming a refrigerant circuit of a refrigerating apparatus is connected to the connection port (66) of the first header collecting pipe (60). In the state in which the heat exchanger (23) of the first aspect of the invention functions as the evaporator, refrigerant in the two phases of gas and liquid flows into the mixing chamber (63) through the pipe. In the mixing chamber (63), the gas-liquid refrigerant is homogenized. That is, in the mixing chamber (63), gas refrigerant and liquid refrigerant are mixed together so as to be dispersed as uniform as possible in the mixing chamber (63). The refrigerant in the mixing chamber (63) flows so as to branch into the distribution paths (65), and then flows into the communication chambers (62*a*-62*c*) corresponding respectively to the distribution paths (65). Then, the refrigerant flows so as to branch into the flat tubes (32) communicating with each communication chamber (62*a*-62*c*).

A second aspect of the invention is intended for the heat exchanger of the first aspect of the invention, in which the first header collecting pipe (60) includes a vertical partition (90) provided along an axial direction of the first header collecting pipe (60) and configured to separate at least one of the communication chambers (62*a*-62*c*) from the mixing chamber (63), and a horizontal partition (80, 85) provided so as to intersect the axial direction of the first header collecting pipe (60) and configured to separate the communication chambers (62*a*-62*c*) adjacent to each other in the vertical direction from each other.

In the second aspect of the invention, the horizontal partitions (80, 85) separate the communication chambers (62*a*-62*c*) adjacent to each other in the vertical direction, and the vertical partition (90) separates at least one of the communication chambers (62*a*-62*c*) from the mixing chamber (63). The vertical partition (90) is provided along the axial direction of the first header collecting pipe (60), and vertically divides an internal space of the first header collecting pipe (60). Thus, in the first header collecting pipe (60), one of the spaces adjacent to each other with the vertical partition (90) being interposed therebetween serves as the at least one of the communication chambers (62*a*-62*c*) communicating with the flat tubes (32), and the other space serves as the mixing chamber (63).

A third aspect of the invention is intended for the heat exchanger of the second aspect of the invention, in which the communication chambers (62*a*-62*c*) of the first header collecting pipe (60) include three or more communication chambers, the horizontal partition (80, 85) include an upper horizontal partition (80) configured to separate an uppermost one (62*c*) of the communication chambers (62*a*-62*c*) from an adjacent one (62*b*) of the communication chambers (62*a*-62*c*), and a lower horizontal partition (85) configured to separate a lowermost one (62*a*) of the communication chambers (62*a*-62*c*) from an adjacent one (62*b*) of the communication chambers (62*a*-62*c*), the vertical partition (90) is configured to separate the mixing chamber (63) from one or more (62*b*) of the communication chambers (62*a*-62*c*) positioned between the upper horizontal partition (80) and the lower horizontal partition (85), and the mixing chamber (63) is surrounded by the vertical partition (90), the upper horizontal partition (80), the lower horizontal partition (85), and a side wall of the first header collecting pipe (60).

In the third aspect of the invention, three or more communication chambers (62*a*-62*c*) are formed in the first header collecting pipe (60). The vertical partition (90) separates the mixing chamber (63) from the communication chamber(s) (62*b*) other than the uppermost communication chamber (62*c*) and the lowermost communication chamber (62*a*). That is, the mixing chamber (63) and each communication chamber (62*b*) positioned between the upper horizontal partition (80) and the lower horizontal partition (85) are adjacent to each other with the vertical partition (90) being interposed therebetween. Moreover, the mixing chamber (63) is separated from the uppermost communication chamber (62*c*) by the upper horizontal partition (80), and is separated from the lowermost communication chamber (62*a*) by the lower horizontal partition (85).

A fourth aspect of the invention is intended for the heat exchanger of the third aspect of the invention, in which a through-hole (95) for communication is formed in the vertical partition (90) such that the at least one communication chamber (62*b*) positioned between the upper horizontal partition (80) and the lower horizontal partition (85) communicates with the mixing chamber (63), a through-hole (81) for communication is formed in the upper horizontal partition (80) such that the uppermost one (62*c*) of the communication chambers (62*a*-62*c*) communicates with the mixing chamber (63), a through-hole (86) for communication is formed in the lower horizontal partition (85) such that the lowermost one (62*a*) of the communication chambers (62*a*-62*c*) communicates with the mixing chamber (63), and the through-hole (95) of the vertical partition (90), the through-hole (81) of the upper horizontal partition (80), and the through-hole (86) of the lower horizontal partition (85) form the distribution paths (65).

In the fourth aspect of the invention, refrigerant in the mixing chamber (63) flows into the communication chamber(s) (62*b*) positioned between the upper horizontal partition (80) and the lower horizontal partition (85) through the through-hole (95) formed in the vertical partition (90). Moreover, the refrigerant in the mixing chamber (63) flows into the uppermost communication chamber (62*c*) through the through-hole (81) of the upper horizontal partition (80). In addition, the refrigerant in the mixing chamber (63) flows into the lowermost communication chamber (62*a*) through the through-hole (86) of the lower horizontal partition (85).

A fifth aspect of the invention is intended for the heat exchanger of the second aspect of the invention, in which the vertical partition (90) is configured to separate the mixing chamber (63) from all of the communication chambers (62*a*-62*c*) formed in the first header collecting pipe (60).

In the fifth aspect of the invention, the mixing chamber (63) and each communication chamber (62*a*-62*c*) are adjacent to each other with the vertical partition (90) being interposed therebetween.

A sixth aspect of the invention is intended for the heat exchanger of the fifth aspect of the invention, in which, in the vertical partition (90), at least one through-hole (95*a*-95*c*) for communication is formed for each communication chamber (62*a*-62*c*) such that the each communication chamber (62*a*-62*c*) communicates with the mixing chamber (63), and the at least one through-hole (95*a*-95*c*) of the vertical partition (90) forms the distribution paths (65).

In the vertical partition (90) of the sixth aspect of the invention, at least one through-hole (95*a*-95*c*) is formed for each communication chamber (62*a*-62*c*). Refrigerant flows into each communication chamber (62*a*-62*c*) from the mixing chamber (63) through a corresponding one of the through-holes (95*a*-95*c*).

A seventh aspect of the invention is intended for the heat exchanger of any one of the second to sixth aspects of the invention, in which the connection port (66) is formed in the side wall of the first header collecting pipe (60) so as to face the vertical partition (90).

An eighth aspect of the invention is intended for the heat exchanger of the fourth or sixth aspect of the invention, in which the connection port (66) is formed in the side wall of the first header collecting pipe (60) so as to face the vertical partition (90), and the through-hole (95) of the vertical partition (90) is formed so as not to face the connection port (66).

In the first header collecting pipe (60) of each of the seventh and eighth aspects of the invention, the connection port (66) faces the vertical partition (90). Thus, gas-liquid refrigerant flowing into the mixing chamber (63) through the connection port (66) comes into contact with the vertical partition (90) facing the connection port (66).

In the vertical partition (90) of the eighth aspect of the invention, the through-hole (95) is formed so as not to face the connection port (66). Thus, refrigerant flowing into the mixing chamber (63) through the connection port (66) is prevented from intensively flowing into the through-hole (95) of the vertical partition (90).

A ninth aspect of the invention is intended for the heat exchanger of the seventh or eighth aspect of the invention, in which the vertical partition (90) is disposed close to the connection port (66) relative to a center axis (64) of the first header collecting pipe (60).

In the ninth aspect of the invention, the vertical partition (90) is positioned closer to the connection port (66) than the center axis (64) of the first header collecting pipe (60) is to. Thus, refrigerant flowing into the mixing chamber (63) through the connection port (66) comes into contact with the vertical partition (90) at higher flow velocity, and therefore refrigerant is stirred vigorously in the mixing chamber (63).

A tenth aspect of the invention is intended for the heat exchanger of the third aspect of the invention, in which the first header collecting pipe (60) further includes a cylindrical body member (160) to which the upper horizontal partition (80) and the lower horizontal partition (85) are attached and in which the communication chambers (62*a*-62*c*) and the mixing chamber (63) are formed, the body member (160) is formed with an upper insertion hole (162) into which the upper horizontal partition (80) is inserted from outside of the body member (160), and a lower insertion hole (163) into which the lower horizontal partition (85) is inserted from the outside of the body member (160), the upper insertion hole (162) and the lower insertion hole (163) are different from each other in shapes, in the upper horizontal partition (80), a sealing part (182) formed in a shape corresponding to the upper insertion hole (162) and closing the upper insertion hole (162) is formed, and in the lower horizontal partition (85), a sealing part (187) formed in a shape corresponding to the lower insertion hole (163) and closing the lower insertion hole (163) is formed.

In the tenth aspect of the invention, the upper insertion hole (162) and the lower insertion hole (163) are formed in the body member (160) forming the first header collecting pipe (60). In the process of manufacturing of the heat exchanger (23), the upper horizontal partition (80) is inserted into the upper insertion hole (162) of the body member (160) from the outside of the body member (160), and the lower horizontal partition (85) is inserted into the lower insertion hole (163) of the body member (160) from the outside of the body member (160). The upper horizontal partition (80) inserted into the upper insertion hole (162) closes the upper insertion hole (162) at the sealing part (182). The lower horizontal partition (85) inserted into the lower insertion hole (163) closes the lower insertion hole (163) at the sealing part (187).

In the tenth aspect of the invention, the upper insertion hole (162) and the lower insertion hole (163) of the body member (160) are different from each other in shapes. The sealing part (182) of the upper horizontal partition (80) is formed in the shape corresponding to the upper insertion hole (162), and the sealing part (187) of the lower horizontal partition (85) is formed in the shape corresponding to the lower insertion hole (163). That is, the sealing part (182) of the upper horizontal partition (80) and the sealing part (187) of the lower horizontal partition (85) are different from each other in shapes. Thus, when an attempt is, in the process of manufacturing of the heat exchanger (23), made by a process operator to mistakenly insert the upper horizontal partition (80) into the lower insertion hole (163), the upper horizontal partition (80) cannot be fitted into the lower insertion hole (163), or the lower insertion hole (163) cannot be closed by the sealing part (182) even if the upper horizontal partition (80) can be fitted into the lower insertion hole (163). When an attempt is, in the process of manufacturing of the heat exchanger (23), made by a process operator to mistakenly insert the lower horizontal partition (85) into the upper insertion hole (162), the lower horizontal partition (85) cannot be fitted into the upper insertion hole (162), or the upper insertion hole (162) cannot be closed by the sealing part (187) even if the lower horizontal partition (85) can be fitted into the upper insertion hole (162).

An eleventh aspect of the invention is intended for the heat exchanger of any one of the second to tenth aspects of the invention, in which the vertical partition (90) faces end surfaces of the flat tubes (32) connected to the first header collecting pipe (60).

In the first header collecting pipe (60) of the eleventh aspect of the invention, the vertical partition (90) faces the end surfaces of the flat tubes (32).

A twelfth aspect of the invention is intended for the heat exchanger of the first aspect of the invention, in which the mixing chamber (63) is positioned below all of the communication chambers (62*a*-62*c*), and connection paths (102, 103, 104) each provided for a corresponding one of the communication chambers (62*a*-62*c*) and each configured to cause the corresponding one of the communication chambers (62*a*-62*c*) to communicate only with the mixing chamber (63) form the distribution paths (65).

In the first header collecting pipe (60) of the twelfth aspect of the invention, the mixing chamber (63) is positioned below all of the communication chambers (62*a*-62*c*). gas-liquid refrigerant flowing into the mixing chamber (63) through the connection port (66) is distributed to the communication chambers (62*a*-62*c*) positioned above the mixing chamber (63) through the connection paths (102, 103, 104) forming the distribution paths (65).

A thirteenth aspect of the invention is intended for the heat exchanger of the twelfth aspect of the invention, in which a partition (110) configured to horizontally divide the mixing chamber (63) is provided in the first header collecting pipe (60), a lower mixing chamber (63*b*) which is part of the mixing chamber (63) below the mixing partition (110) communicates with the connection port (66), and an upper mixing chamber (63*a*) which is part of the mixing chamber (63) above the mixing partition (110) communicates with the distribution paths (65), and a through-hole (111) through which the lower mixing chamber (63*b*) and the upper mixing chamber (63*a*) communicate with each other is formed in the mixing partition (110).

In the thirteenth aspect of the invention, the mixing chamber (63) is divided into the upper mixing chamber (63*a*) and the lower mixing chamber (63*b*) by the partition (110). Gas-liquid refrigerant flowing into the lower mixing chamber (63*b*) through the connection port (66) flows into the upper mixing chamber (63*a*) through the through-hole (111) of the partition (110). When the refrigerant passes through the through-hole (111), mixing of gas refrigerant and liquid refrigerant contained in the refrigerant is accelerated. Then, the refrigerant flowing into the upper mixing chamber (63*a*) is distributed to the communication chambers (62*a*-62*c*) through the connection paths (102, 103, 104).

A fourteenth aspect of the invention is intended for the heat exchanger of any one of the first to thirteenth aspects of the invention, which further includes a tubular member (55) attached to the first header collecting pipe (60) and connected to the connection port (66). A pipe through which refrigerant flows is connected to the connection port (66) through the tubular member (55), and the tubular member (55) is in such a shape that an end part (56) of the tubular member (55) connected to the connection port (66) is narrowed.

In the fourteenth aspect of the invention, the tubular member (55) is attached to the first header collecting pipe (60). The tubular member (55) is in such a shape that the end part (56) connected to the connection port (66) is narrowed. That is, the end part (56) of the tubular member (55) connected to the connection port (66) is thinner than the other part of the tubular member (55). Gas-liquid refrigerant supplied to the heat exchanger (23) functioning as the evaporator flows into the mixing chamber (63) of the first header collecting pipe (60) through the tubular member (55). Gas refrigerant and liquid refrigerant contained in the refrigerant flowing through the tubular member (55) are mixed together when passing through the end part (56) of the tubular member (55) formed in the narrowed shape.

A fifteenth aspect of the invention is intended for the heat exchanger of any one of the first to fourteenth aspects of the invention, in which the heat exchanger is divided into a main heat exchange region (51) including some (31) of the flat tubes (31, 32) and an auxiliary heat exchange region (52) including the remaining flat tubes (32), the auxiliary heat exchange region (52) is positioned below the main heat exchange region (51), the auxiliary heat exchange region (52) is divided into a plurality of auxiliary heat exchange parts (52*a*-52*c*) each including multiple ones of the remaining flat tubes (32) and each formed for a corresponding one of the communication chambers (62*a*-62*c*), the multiple ones of the remaining flat tubes (32) of each auxiliary heat exchange part (52*a*-52*c*) communicate with a corresponding one of the communication chambers (62*a*-62*c*), the main heat exchange region (51) is divided into a plurality of main heat exchange parts (51*a*-51*c*) each including multiple ones of the some (31) of the flat tubes (31, 32) and each formed for a corresponding one of the auxiliary heat exchange parts (52*a*-52*c*), and the multiple ones of the some (31) of the flat tubes (31, 32) of each main heat exchange part (51*a*-51*c*) communicate, through the second header collecting pipe (70), with the multiple ones of the remaining flat tubes (32) of a corresponding one of the auxiliary heat exchange parts (52*a*-52*c*).

In the fifteenth aspect of the invention, the heat exchanger (23) is divided into the main heat exchange region (51) and the auxiliary heat exchange region (52). The main heat exchange region (51) is further divided into the main heat exchange parts (51*a*-51*c*), and the auxiliary heat exchange region (52) is further divided into the auxiliary heat exchange parts (52*a*-52*c*). The main heat exchange parts (51*a*-51*c*) and the auxiliary heat exchange parts (52*a*-52*c*) is in one-to-one correspondence. In the state in which the heat exchanger (23) functions as the evaporator, gas-liquid refrigerant flows into the mixing chamber (63) of the first header collecting pipe (60). The refrigerant in the mixing chamber (63) is distributed to the communication chambers (62*a*-62*c*), and then flows into the flat tubes (32) of the auxiliary heat exchange parts (52*a*-52*c*) corresponding respectively to the communication chambers (62*a*-62*c*). The refrigerant having passed through the flat tubes (32) of the auxiliary heat exchange parts (52*a*-52*c*) passes through the second header collecting pipe (70), and then flows into the flat tubes (31) of the main heat exchange parts (51*a*-51*c*).

Advantages of the Invention

In the present disclosure, gas-liquid refrigerant supplied to the heat exchanger (23) functioning as the evaporator is mixed in the mixing chamber (63) of the first header collecting pipe (60), and then is supplied to each communication chamber (62*a*-62*c*). A difference in ratio (i.e., the wetness of refrigerant) between gas refrigerant and liquid refrigerant contained in refrigerant sent from the mixing chamber (63) to the communication chamber (62*a*-62*c*) among the communication chambers (62*a*-62*c*) can be reduced. As a result, a difference in wetness of refrigerant flowing from the communication chamber (62*a*-62*c*) to the flat tube (32) among the flat tubes (32) can be reduced. Thus, according to the present disclosure, the wetness of refrigerant flowing into the flat tube (32) can be uniformized among the flat tubes (32), and therefore performance of the heat exchanger (23) can be fully achieved.

In the third aspect of the invention, the mixing chamber (63) and each communication chamber (62*a*-62*c*) are adjacent to each other in the state in which a corresponding one of the vertical partition (90), the upper horizontal partition (80), and the lower horizontal partition (85) is interposed therebetween. In the fifth aspect of the invention, the mixing chamber (63) and each communication chamber (62*a*-62*c*) are adjacent to each other with the vertical partition (90) being interposed therebetween. That is, in each of the third and fifth aspects of the invention, the mixing chamber (63) is adjacent to one of the communication chambers (62*a*-62*c*) with the single partition (80, 85, 90) being interposed therebetween. Thus, according to each of the third and fifth aspects of the invention, the length of the distribution path (65) connecting between the mixing chamber (63) and each communication chamber (62*a*-62*c*) can be shortened as much as possible, and complication of the structure of the heat exchanger (23) can be reduced.

In each of the seventh and eighth aspects of the invention, gas-liquid refrigerant flowing into the mixing chamber (63) through the connection port (66) comes into contact with the vertical partition (90). Thus, refrigerant in the mixing chamber (63) is vigorously stirred by the refrigerant flowing out from the connection port (66) and contacting the vertical partition (90). Thus, according to these aspects of the invention, mixing of gas refrigerant and liquid refrigerant contained in the refrigerant in the mixing chamber (63) is accelerated, and therefore homogenization of the gas-liquid refrigerant in the mixing chamber (63) can be enhanced.

Particularly in the vertical partition (90) of the eighth aspect of the invention, the through-hole (95) is formed so as not to face the connection port (66). Thus, refrigerant flowing into the mixing chamber (63) through the connection port (66) can be prevented from intensively flowing into the through-hole (95) of the vertical partition (90). Thus, according to the present disclosure, the mass flow rate of refrigerant flowing from the mixing chamber (63) into the communication chamber (62*a*-62*c*) can be uniformized among the communication chambers (62*a*-62*c*).

In the ninth aspect of the invention, the vertical partition (90) is provided closer to the connection port (66) than the center axis (64) of the first header collecting pipe (60) is to. Thus, right after flowing into the mixing chamber (63) through the connection port (66), refrigerant can come into contact with the vertical partition (90) at high velocity. Thus, refrigerant in the mixing chamber (63) can be vigorously stirred, and therefore mixing of gas refrigerant and liquid refrigerant can be further accelerated.

In the tenth aspect of the invention, the upper insertion hole (162) and the lower insertion hole (163) formed in the body member (160) are different from each other in shapes. Moreover, the sealing part (182) of the upper horizontal partition (80) in the shape corresponding to the upper insertion hole (162) and the sealing part (187) of the lower horizontal partition (85) in the shape corresponding to the lower insertion hole (163) are different from each other in shapes. Thus, in the process of manufacturing of the heat exchanger (23), the possibility of attaching, by a process operator, the upper horizontal partition (80) or the lower horizontal partition (85) to an improper position can be eliminated. Consequently, the rate of occurrence of defective products which do not normally function can be reduced.

In each of the twelfth and thirteenth aspects of the invention, gas-liquid refrigerant flowing into the mixing chamber (63) through the connection port (66) is distributed to the communication chambers (62*a*-62*c*) positioned above the mixing chamber (63). Particularly in the thirteenth aspect of the invention, the mixing chamber (63) is horizontally divided by the partition (110), and homogenization of gas-liquid refrigerant is enhanced when the gas-liquid refrigerant passes through the through-hole (111) of the partition (110). Thus, according to the thirteenth aspect of the invention, the difference in wetness of refrigerant distributed from the mixing chamber (63) to the communication chambers (62*a*-62*c*) among the communication chambers (62*a*-62*c*) can be further reduced, and the wetness of refrigerant flowing into the flat tube (32) can be further uniformized among the flat tubes (32).

In the fourteenth aspect of the invention, gas-liquid refrigerant supplied to the heat exchanger (23) functioning as the evaporator flows into the mixing chamber (63) of the first header collecting pipe (60) through the tubular member (55). Gas refrigerant and liquid refrigerant contained in the refrigerant flowing through the tubular member (55) are mixed together when passing through the end part (56) of the tubular member (55) formed in the narrowed shape. Thus, according to this aspect of the invention, homogenization of gas-liquid refrigerant in the mixing chamber (63) can be further enhanced.

BRIEF DESCRIPTION OF THE DRAWINGS

FIG. 6(A) is a partial cross-sectional view along a B-B line of FIG. 5. FIG. 6(B) is a cross-sectional view along a C-C line of FIG. 6(A). FIG. 6(C) is a cross-sectional view along a D-D line of FIG. 6(A).

FIG. 11(A) is a partial cross-sectional view along an E-E line of FIG. 10. FIG. 11(B) is a cross-sectional view along an F-F line of FIG. 11(A). FIG. 11(C) is a cross-sectional view along a G-G line of FIG. 11(A).

FIG. 13(A) is a partial cross-sectional view along an H-H line of FIG. 12. FIG. 13(B) is a cross-sectional view along an I-I line of FIG. 13(A). FIG. 13(C) is a cross-sectional view along a J-J line of FIG. 13(A).

FIG. 16(A) is a cross-sectional view along a K-K line of FIG. 15. FIG. 16(B) is a cross-sectional view along an L-L line of FIG. 15.

FIG. 19(A) is a partial cross-sectional view along an M-M line of FIG. 18. FIG. 19(B) is a cross-sectional view along an N-N line of FIG. 19(A). FIG. 19(C) is a cross-sectional view along an O-O line of FIG. 19(A).

FIG. 23(A) illustrates a partition of a first header collecting pipe. FIG. 23(B) illustrates an upper horizontal partition. FIG. 23(C) illustrates a lower horizontal partition.

FIG. 24(A) is a partial cross-sectional view along a P-P line of FIG. 22. FIG. 24(B) is a cross-sectional view along a Q-Q line of FIG. 24(A). FIG. 24(C) is a cross-sectional view along an R-R line of FIG. 24(A). FIG. 24(D) is a cross-sectional view along an S-S line of FIG. 24(A).

FIG. 25(A) illustrates the state in which the lower horizontal partition is mistakenly inserted into an upper insertion hole. FIG. 25(B) illustrates the state in which the upper horizontal partition is mistakenly inserted into a lower insertion hole.

DESCRIPTION OF EMBODIMENTS

Embodiments of the present disclosure will be described in detail below with reference to drawings. Note that the embodiments and variations described below will be set forth merely for the purpose of preferred examples in nature, and are not intended to limit the scope, applications, and use of the invention.

First Embodiment of the Invention

A first embodiment of the present disclosure will be described. A heat exchanger of the present embodiment is an outdoor heat exchanger (23) provided in an air conditioner (10). The air conditioner (10) will be first described below, and then the outdoor heat exchanger (23) will be described in detail.

Air Conditioner

Figure 1:
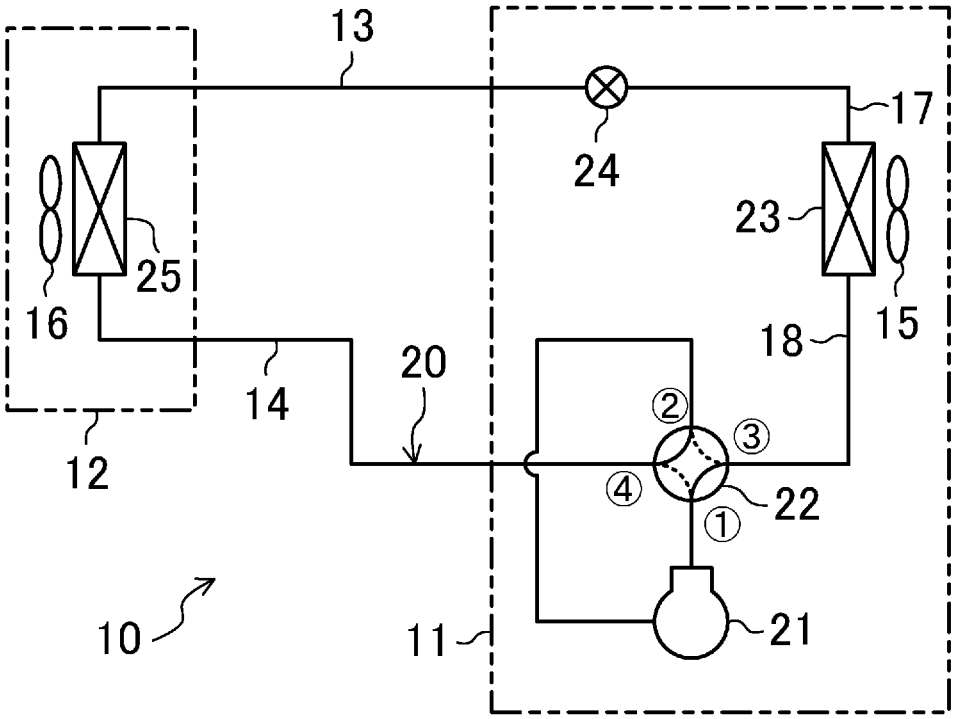
FIG. 1 is a refrigerant circuit diagram illustrating the outline configuration of an air conditioner including an outdoor heat exchanger of a first embodiment.

The air conditioner (10) will be described with reference to FIG. 1.

<Configuration of Air Conditioner>

The air conditioner (10) includes an outdoor unit (11) and an indoor unit (12). The outdoor unit (11) and the indoor unit (12) are connected together through a liquid-side communication pipe (13) and a gas-side communication pipe (14). The outdoor unit (11), the indoor unit (12), the liquid-side communication pipe (13), and the gas-side communication pipe (14) form a refrigerant circuit (20) in the air conditioner (10).

A compressor (21), a four-way valve (22), the outdoor heat exchanger (23), an expansion valve (24), and an indoor heat exchanger (25) are provided in the refrigerant circuit (20). The compressor (21), the four-way valve (22), the outdoor heat exchanger (23), and the expansion valve (24) are housed in the outdoor unit (11). In the outdoor unit (11), an outdoor fan (15) configured to supply outdoor air to the outdoor heat exchanger (23) is provided. On the other hand, the indoor heat exchanger (25) is housed in the indoor unit (12). In the indoor unit (12), an indoor fan (16) configured to supply room air to the indoor heat exchanger (25) is provided.

The refrigerant circuit (20) is a closed circuit filled with refrigerant. In the refrigerant circuit (20), a discharge pipe of the compressor (21) is connected to a first port of the four-way valve (22), and a suction pipe of the compressor (21) is connected to a second port of the four-way valve (22). Moreover, the outdoor heat exchanger (23), the expansion valve (24), and the indoor heat exchanger (25) are arranged in this order from a third port to a fourth port of the four-way valve (22) in the refrigerant circuit (20).

The compressor (21) is a hermetic scroll compressor or a hermetic rotary compressor. The four-way valve (22) switches between a first state (indicated by a solid line in FIG. 1) in which the first and third ports communicate with each other and the second and fourth ports communicate with each other, and a second state (indicated by a dashed line in FIG. 1) in which the first and fourth ports communicate with each other and the second and third ports communicate with each other. The expansion valve (24) is a so-called electronic expansion valve.

The outdoor heat exchanger (23) is configured to exchange heat between outdoor air and refrigerant. The outdoor heat exchanger (23) will be described later. On the other hand, the indoor heat exchanger (25) is configured to exchange heat between room air and refrigerant. The indoor heat exchanger (25) is a so-called cross-fin type fin-and-tube heat exchanger including a circular heat transfer pipe.

<Operation of Air Conditioner>

The air conditioner (10) selectively performs an air-cooling operation and an air-heating operation.

During the air-cooling operation, in the refrigerant circuit (20), a refrigeration cycle is performed with the four-way valve (22) being set to the first state. In this state, refrigerant flows through the outdoor heat exchanger (23), the expansion valve (24), and the indoor heat exchanger (25) in this order. The outdoor heat exchanger (23) functions as a condenser, and the indoor heat exchanger (25) functions as an evaporator. In the outdoor heat exchanger (23), gas refrigerant flowing from the compressor (21) is condensed by dissipating heat to outdoor air, and the condensed refrigerant flows out from the outdoor heat exchanger (23) toward the expansion valve (24).

During the air-heating operation, in the refrigerant circuit (20), the refrigeration cycle is performed with the four-way valve (22) being set to the second state. In this state, refrigerant flows through the indoor heat exchanger (25), the expansion valve (24), and the outdoor heat exchanger (23) in this order. The indoor heat exchanger (25) functions as a condenser, and the outdoor heat exchanger (23) functions as an evaporator. Refrigerant expanded into the two phases of gas and liquid when passing through the expansion valve (24) flows into the outdoor heat exchanger (23). The refrigerant flowing into the outdoor heat exchanger (23) is evaporated by absorbing heat from outdoor air, and then flows out from the outdoor heat exchanger (23) toward the compressor (21).

Outdoor Heat Exchanger

The outdoor heat exchanger (23) will be described with reference to FIGS. 2-7. The number of flat tubes (31, 32) described below, the number of main heat exchange parts (51*a*-51*c*) described below, and the number of auxiliary heat exchange parts (52*a*-52*c*) described below are merely examples.

<Configuration of Outdoor Heat Exchanger>

Figure 2:
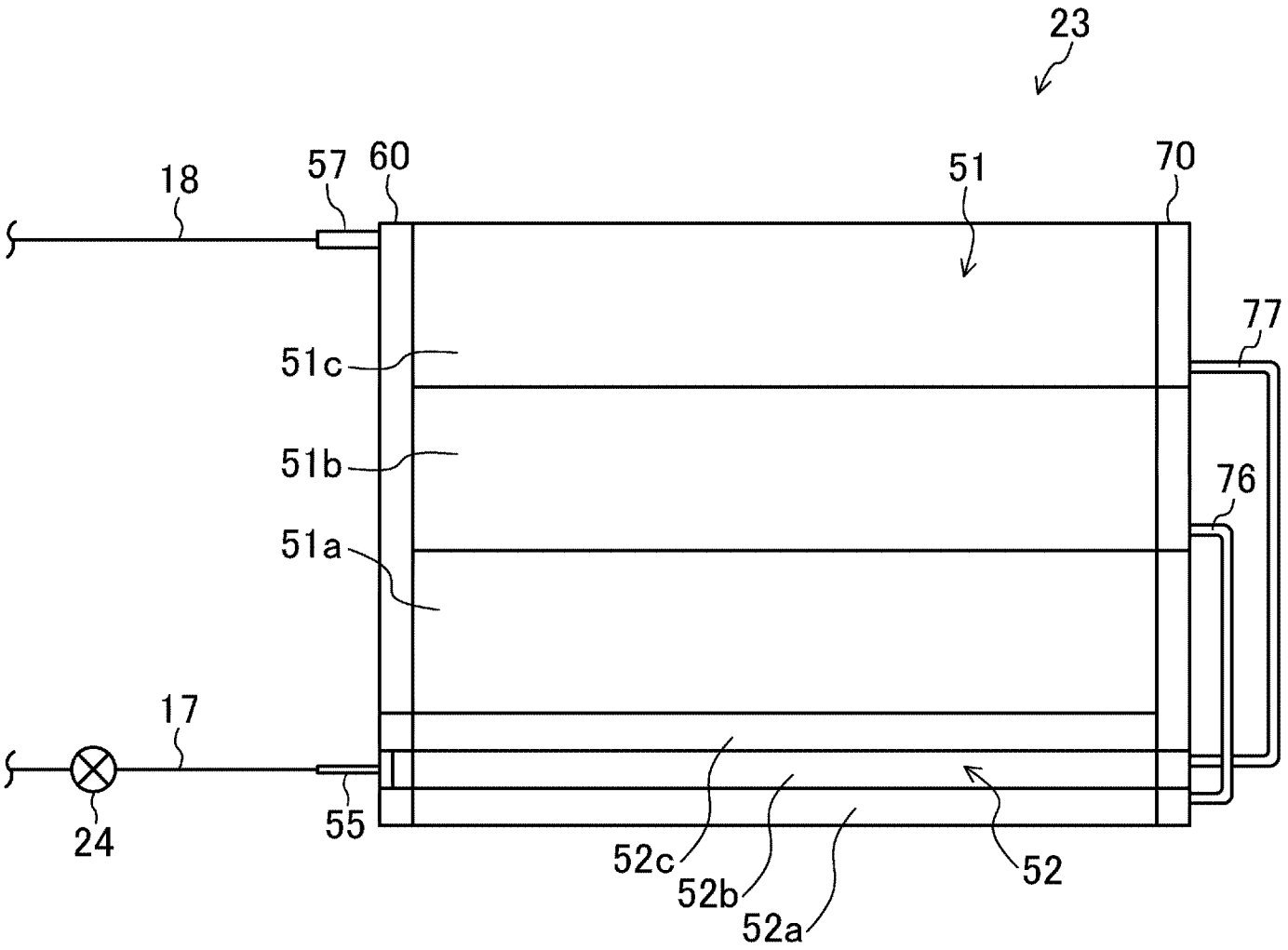
FIG. 2 is a front view illustrating the outline configuration of the outdoor heat exchanger of the first embodiment.
Figure 3:
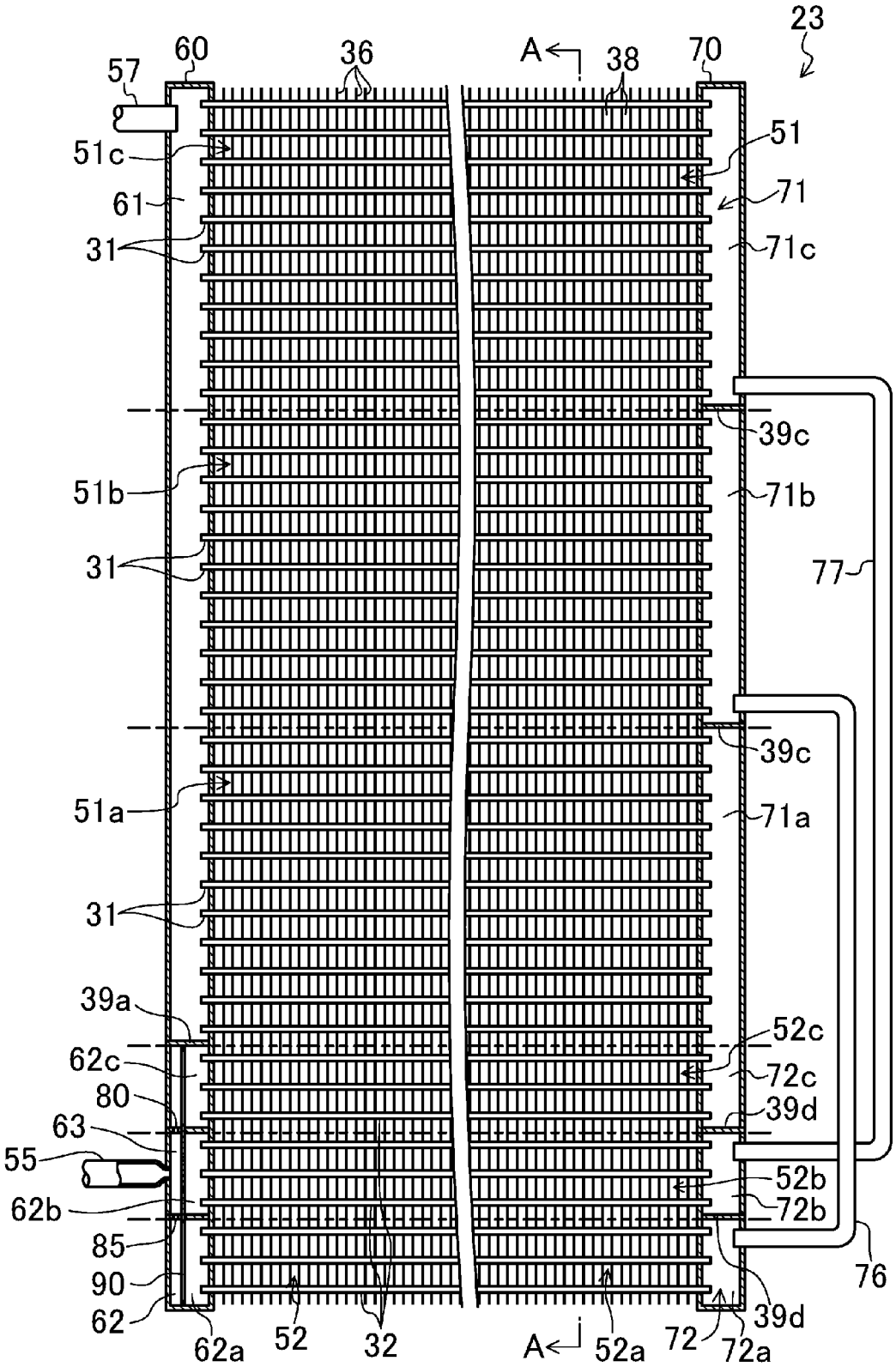
FIG. 3 is a partial cross-sectional view illustrating a front side of the outdoor heat exchanger of the first embodiment.

Referring to FIGS. 2 and 3, the outdoor heat exchanger (23) includes a first header collecting pipe (60), a second header collecting pipe (70), the plurality of flat tubes (31, 32), and a plurality of fins (36). The first header collecting pipe (60), the second header collecting pipe (70), the flat tubes (31, 32), and the fins (36) are made of an aluminum alloy, and are joined together by brazing.

Although it will be described in detail later, the outdoor heat exchanger (23) is divided into a main heat exchange region (51) and an auxiliary heat exchange region (52). In the outdoor heat exchanger (23), some (32) of the flat tubes (31, 32) form the auxiliary heat exchange region (52), and the remaining pipes (31) form the main heat exchange region (51).

The first header collecting pipe (60) and the second header collecting pipe (70) are each formed in an elongated cylindrical shape closed at both ends. Referring to FIGS. 2 and 3, the first header collecting pipe (60) stands at a left end of the outdoor heat exchanger (23), and the second header collecting pipe (70) stands at a right end of the outdoor heat exchanger (23). That is, the first header collecting pipe (60) and the second header collecting pipe (70) are each disposed such that an axial direction thereof is along the vertical direction.

Figure 4:
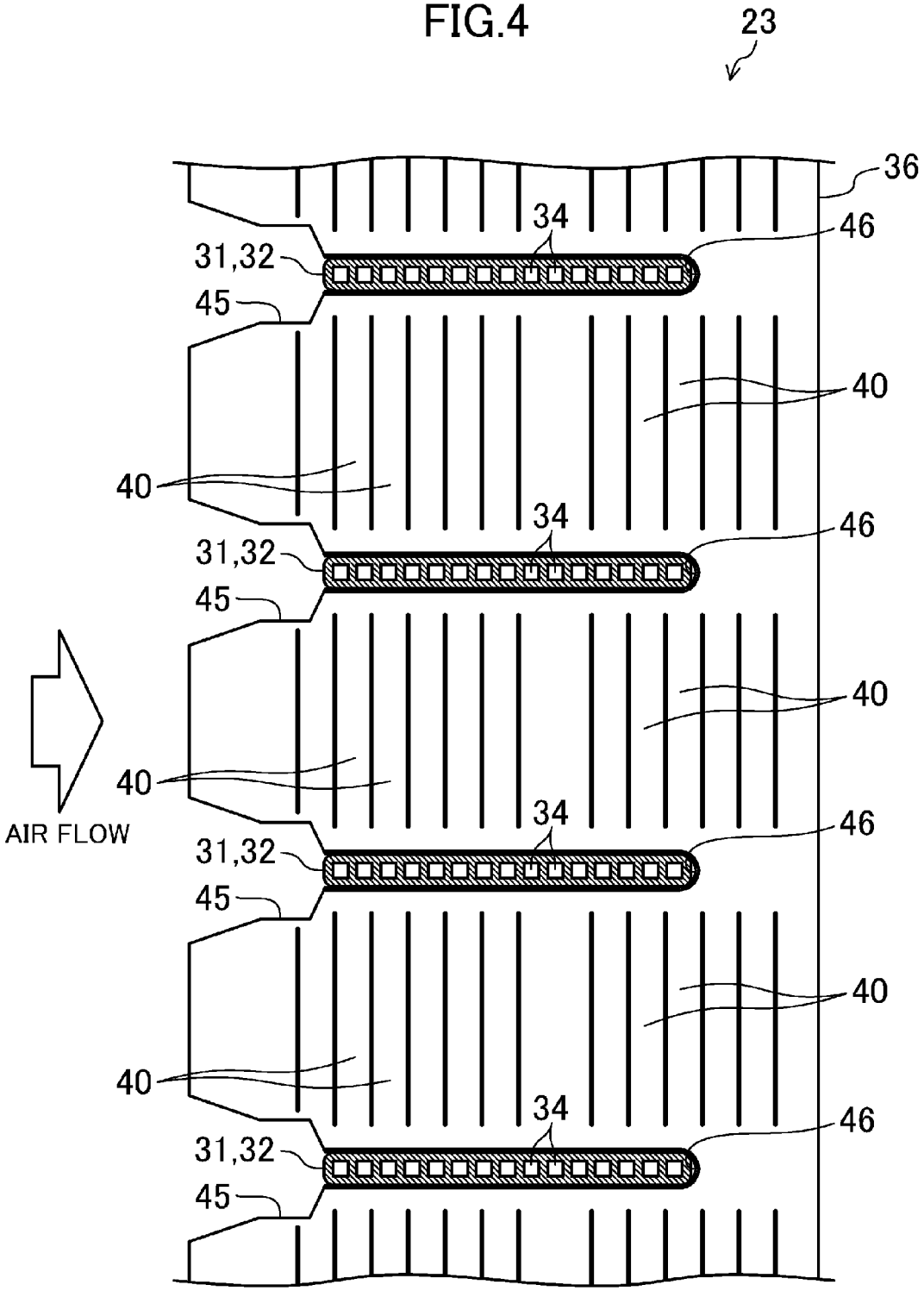
FIG. 4 is an enlarged partial cross-sectional view of the outdoor heat exchanger along an A-A line of FIG. 3.

Referring to FIG. 4, each flat tube (31, 32) is a heat transfer pipe having a flat oval cross section. Referring to FIG. 3, in the outdoor heat exchanger (23), the flat tubes (31, 32) are arranged such that an extension direction thereof is along the horizontal direction and that flat side surfaces of adjacent ones of the flat tubes (31, 32) face each other. Moreover, the flat tubes (31, 32) are arranged in the vertical direction at predetermined intervals, and are substantially parallel to each other. Each flat tube (31, 32) is, at one end thereof, inserted into the first header collecting pipe (60), and is, at the other end thereof, inserted into the second header collecting pipe (70).

Referring to FIG. 4, a plurality of fluid paths (34) are formed in each flat tube (31, 32). Each fluid path (34) is a path extending in the extension direction of the flat tube (31, 32). In each flat tube (31, 32), the fluid paths (34) are arranged in line in a width direction (i.e., the direction perpendicular to a longitudinal direction of the flat tube (31, 32)) of the flat tube (31, 32). The fluid paths (34) formed in each flat tube (31, 32) communicate, at one ends thereof, with an internal space of the first header collecting pipe (60), and communicates, at the other ends thereof, with an internal space of the second header collecting pipe (70). Refrigerant supplied to the outdoor heat exchanger (23) exchanges heat with air while flowing through the fluid paths (34) of the flat tubes (31, 32).

Referring to FIG. 4, each fin (36) is an elongated plate-shaped fin formed in such a manner that a metal plate is pressed. In the fin (36), a plurality of elongated cutouts (45) extending from a front edge (i.e., a windward edge) of the fin (36) in a width direction of the fin (36) are formed. In the fin (36), the cutouts (45) are formed at predetermined intervals in a longitudinal direction (i.e., the vertical direction) of the fin (36). A leeward part of each cutout (45) forms a pipe insertion part (46). The width of the pipe insertion part (46) in the vertical direction is substantially equal to the thickness of the flat tube (31, 32), and the length of the pipe insertion part (46) is substantially equal to the width of the flat tube (31, 32). Each flat tube (31, 32) is inserted into a corresponding one of the pipe insertion parts (46) of the fins (36), and is, by brazing, joined to the circumferential edge of the pipe insertion part (46). Moreover, in the fin (36), louvers (40) configured to promote heat transfer are formed. The fins (36) are arranged in the extension direction of the flat tubes (31, 32) such that a plurality of air paths (38) through which air flows is each formed between adjacent ones of the flat tubes (31, 32).

Referring to FIGS. 2 and 3, the outdoor heat exchanger (23) is horizontally divided into two regions, i.e., the heat exchange regions (51, 52). In the outdoor heat exchanger (23), the upper heat exchange region serves as the main heat exchange region (51), and the lower heat exchange region serves as the auxiliary heat exchange region (52).

Each heat exchange region (51, 52) is horizontally divided into three heat exchange parts (51*a*-51*c*, 52*a*-52*c*). That is, in the outdoor heat exchanger (23), each of the main heat exchange region (51) and the auxiliary heat exchange region (52) is divided into a plurality of heat exchange parts (51*a*-51*c*, 52*a*-52*c*), and the number of heat exchange parts (51*a*-51*c*, 52*a*-52*c*) is the same between the main heat exchange region (51) and the auxiliary heat exchange region (52). Note that the number of heat exchange parts (51*a*-51*c*, 52*a*-52*c*) formed in each heat exchange region (51, 52) may be two, or may be four or more.

Specifically, the first main heat exchange part (51*a*), the second main heat exchange part (51*b*), and the third main heat exchange part (51*c*) are formed in this order from the bottom to the top in the main heat exchange region (51). The first auxiliary heat exchange part (52*a*), the second auxiliary heat exchange part (52*b*), and the third auxiliary heat exchange part (52*c*) are formed in this order from the bottom to the top in the auxiliary heat exchange region (52). Each of the main heat exchange parts (51*a*-51*c*) and the auxiliary heat exchange parts (52*a*-52*c*) includes a plurality of flat tubes (31, 32). Moreover, referring to FIG. 3, the number of flat tubes (31) forming each main heat exchange part (51*a*-

51*c*) is higher than the number of flat tubes (32) forming each auxiliary heat exchange part (52*a*-52*c*). Thus, the number of flat tubes (31) forming the main heat exchange region (51) is higher than the number of flat tubes (32) forming the auxiliary heat exchange region (52). In the outdoor heat exchanger (23) of the present embodiment, three flat tubes (32) form each auxiliary heat exchange part (52*a*-52*c*).

Referring to FIG. 3, the internal space of the first header collecting pipe (60) is horizontally divided by a partition (39*a*). In the first header collecting pipe (60), the upper space relative to the partition (39*a*) forms an upper space (61), and the lower space relative to the partition (39*a*) forms a lower space (62).

The upper space (61) forms a main communication space corresponding to the main heat exchange region (51). The upper space (61) is a single space communicating with all of the flat tubes (31) forming the main heat exchange region (51). That is, the upper space (61) communicates with each flat tubes (31) of the main heat exchange parts (51*a*-51*c*).

The lower space (62) forms an auxiliary communication space corresponding to the auxiliary heat exchange region (52). Although described in detail later, the lower space (62) is divided into the same number of communication chambers (62*a*-62*c*) (three communication chambers in the present embodiment) as that of the auxiliary heat exchange parts (52*a*-52*c*). The lowermost first communication chamber (62*a*) communicates with all of the flat tubes (32) forming the first auxiliary heat exchange part (52*a*). The second communication chamber (62*b*) positioned above the first communication chamber (62*a*) communicates with all of the flat tubes (32) forming the second auxiliary heat exchange part (52*b*). The uppermost third communication chamber (62*c*) communicates with all of the flat tubes (32) forming the third auxiliary heat exchange part (52*c*).

The internal space of the second header collecting pipe (70) is divided into a main communication space (71) corresponding to the main heat exchange region (51), and an auxiliary communication space (72) corresponding to the auxiliary heat exchange region (52).

The main communication space (71) is horizontally divided by two partitions (39*c*). The partitions (39*c*) divide the main communication space (71) into the same number of sub-spaces (71*a*-71*c*) (three sub-spaces in the present embodiment) as that of the main heat exchange parts (51*a*-51*c*). The lowermost first sub-space (71*a*) communicates with all of the flat tubes (31) forming the first main heat exchange part (51*a*). The second sub-space (71*b*) positioned above the first sub-space (71*a*) communicates with all of the flat tubes (31) forming the second main heat exchange part (51*b*). The uppermost third sub-space (71*c*) communicates with all of the flat tubes (31) forming the third main heat exchange part (51*c*).

The auxiliary communication space (72) is horizontally divided by two partitions (39*d*). The partitions (39*d*) divide the auxiliary communication space (72) into the same number of sub-spaces (72*a*-72*c*) (three sub-spaces in the present embodiment) as that of the auxiliary heat exchange parts (52*a*-52*c*). The lowermost fourth sub-space (72*a*) communicates with all of the flat tubes (32) forming the first auxiliary heat exchange part (52*a*). The fifth sub-space (72*b*) positioned above the fourth sub-space (72*a*) communicates with all of the flat tubes (32) forming the second auxiliary heat exchange part (52*b*). The uppermost sixth sub-space (72*c*) communicates with all of the flat tubes (32) forming the third auxiliary heat exchange part (52*c*).

Two connection pipes (76, 77) are attached to the second header collecting pipe (70). The connection pipes (76, 77) are circular pipes.

The first connection pipe (76) is, at one end thereof, connected to the second sub-space (71*b*) corresponding to the second main heat exchange part (51*b*), and is, at the other end thereof, connected to the fourth sub-space (72*a*) corresponding to the first auxiliary heat exchange part (52*a*). The second connection pipe (77) is, at one end thereof, connected to the third sub-space (71*c*) corresponding to the third main heat exchange part (51*c*), and is, at the other end thereof, connected to the fifth sub-space (72*b*) corresponding to the second auxiliary heat exchange part (52*b*). In the second header collecting pipe (70), the sixth sub-space (72*c*) corresponding to the third auxiliary heat exchange part (52*c*) and the first sub-space (71*a*) corresponding to the first main heat exchange part (51*a*) form a connected series of spaces.

As just described, in the outdoor heat exchanger (23) of the present embodiment, the first main heat exchange part (51*a*) and the third auxiliary heat exchange part (52*c*) are connected together in series, the second main heat exchange part (51*b*) and the first auxiliary heat exchange part (52*a*) are connected together in series, and the third main heat exchange part (51*c*) and the second auxiliary heat exchange part (52*b*) are connected together in series.

Referring to FIGS. 2 and 3, a liquid-side connection pipe (55) and a gas-side connection pipe (57) are provided in the outdoor heat exchanger (23). The liquid-side connection pipe (55) and the gas-side connection pipe (57) are circular pipe-shaped member made of an aluminum alloy. The liquid-side connection pipe (55) and the gas-side connection pipe (57) are joined to the first header collecting pipe (60) by brazing.

Although will be described in detail later, the liquid-side connection pipe (55) serving as a tubular member is, at one end thereof, connected to a lower part of the first header collecting pipe (60), and communicates with the lower space (62). The liquid-side connection pipe (55) is, at the other end thereof, connected to a copper pipe (17) connecting between the outdoor heat exchanger (23) and the expansion valve (24) through a joint (not shown in the figure).

The gas-side connection pipe (57) is, at one end thereof, connected to an upper part of the first header collecting pipe (60), and communicates with the upper space (61). The gas-side connection pipe (57) is, at the other end thereof, connected to a copper pipe (18) connecting between the outdoor heat exchanger (23) and the third port of the four-way valve (22) through a joint (not shown in the figure).

<Configuration of Lower Part of First Header Collecting Pipe>

The structure of the lower part of the first header collecting pipe (60) will be described in detail with reference to FIGS. 5-7. In the description below, one of side surfaces of the first header collecting pipe (6Q) close to the flat tubes (32) is referred to as a "front surface," and the other side surface of the first header collecting pipe (60) opposite to the flat tubes (32) is referred to as a "rear surface."

Figure 5:
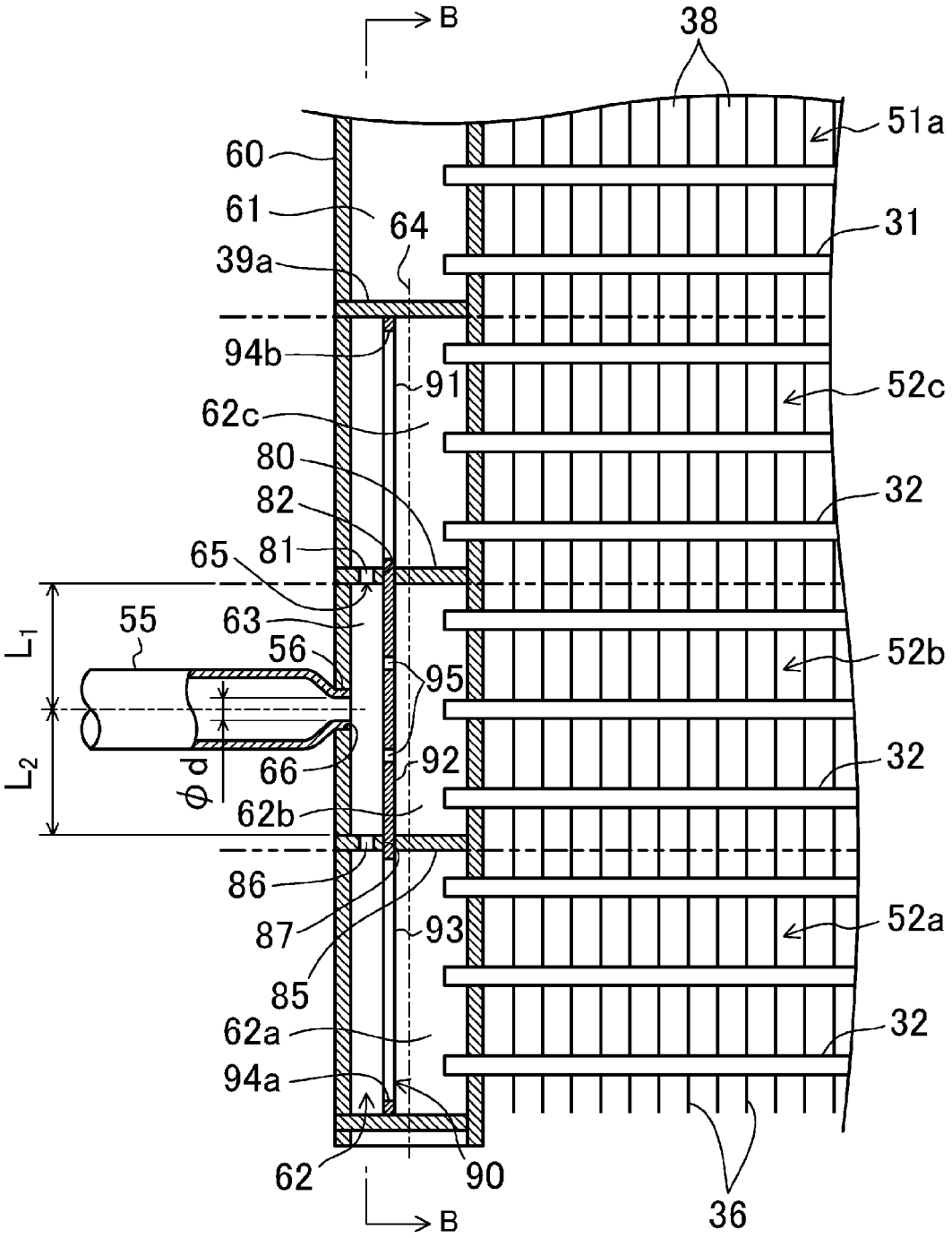
FIG. 5 is an enlarged cross-sectional view illustrating a main part of the front side of the outdoor heat exchanger of the first embodiment.

In the lower space (62) of the first header collecting pipe (60), an upper horizontal partition (80), a lower horizontal partition (85), and a vertical partition (90) are arranged (see FIG. 5). The lower space (62) is divided into the communication chambers (62*a*-62*c*) and a mixing chamber (63) by the horizontal partitions (80, 85) and the vertical partition (90). The upper horizontal partition (80), the lower horizontal partition (85), and the vertical partition (90) are made of an aluminum alloy.

The upper horizontal partition (80) and the lower horizontal partition (85) are formed in a discoid shape, and horizontally divide the lower space (62). The upper horizontal partition (80) and the lower horizontal partition (85) are joined to the first header collecting pipe (60) by brazing. The upper horizontal partition (80) is disposed at a boundary between the second auxiliary heat exchange part (52*b*) and the third auxiliary heat exchange part (52*c*) to separate the second communication chamber (62*b*) and the third communication chamber (62*c*) from each other. The lower horizontal partition (85) is disposed at a boundary between the first auxiliary heat exchange part (52*a*) and the second auxiliary heat exchange part (52*b*) to separate the first communication chamber (62*a*) and the second communication chamber (62*b*) from each other.

Figure 6:
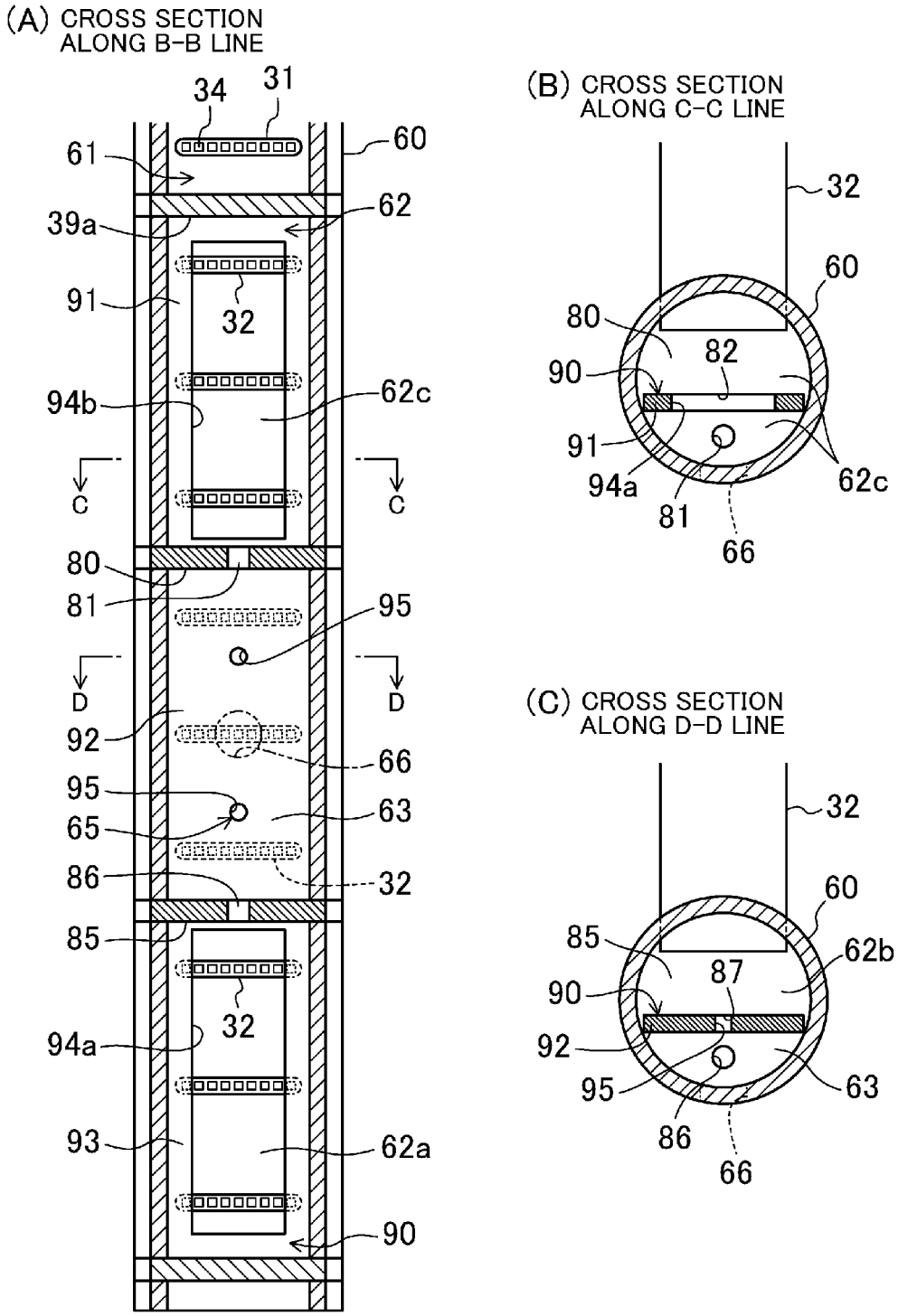
FIGS. 6(A)-6(C) are enlarged cross-sectional views illustrating a main part of the outdoor heat exchanger of the first embodiment.

A slit hole (82, 87) and a through-hole (81, 86) for communication are formed in each of the upper horizontal partition (80) and the lower horizontal partition (85) (see FIGS. 5 and 6).

Each slit hole (82, 87) is an elongated rectangular shape, and penetrates a corresponding one of the horizontal partitions (80, 85) in a thickness direction thereof. A long side of the slit hole (82, 87) is substantially parallel to an end surface of the flat tube (32). In each horizontal partition (80, 85), a corresponding one of the slit holes (82, 87) is positioned close to the rear surface of the first header collecting pipe (60). The width of the slit hole (82, 87) is substantially the same as the thickness of the vertical partition (90), and the length of the slit hole (82, 87) is substantially the same as the width of the vertical partition (90).

Each through-hole (81, 86) is a circular hole, and penetrates a corresponding one of the horizontal partitions (80, 85) in the thickness direction thereof. In the horizontal partition (80, 85), the through-hole (81, 86) is positioned closer to the rear surface of the first header collecting pipe (60) than the slit hole (82, 87) is to. The through-holes (81, 86) of the upper horizontal partition (80) and the lower horizontal partition (85) have the same diameter.

Figure 7:
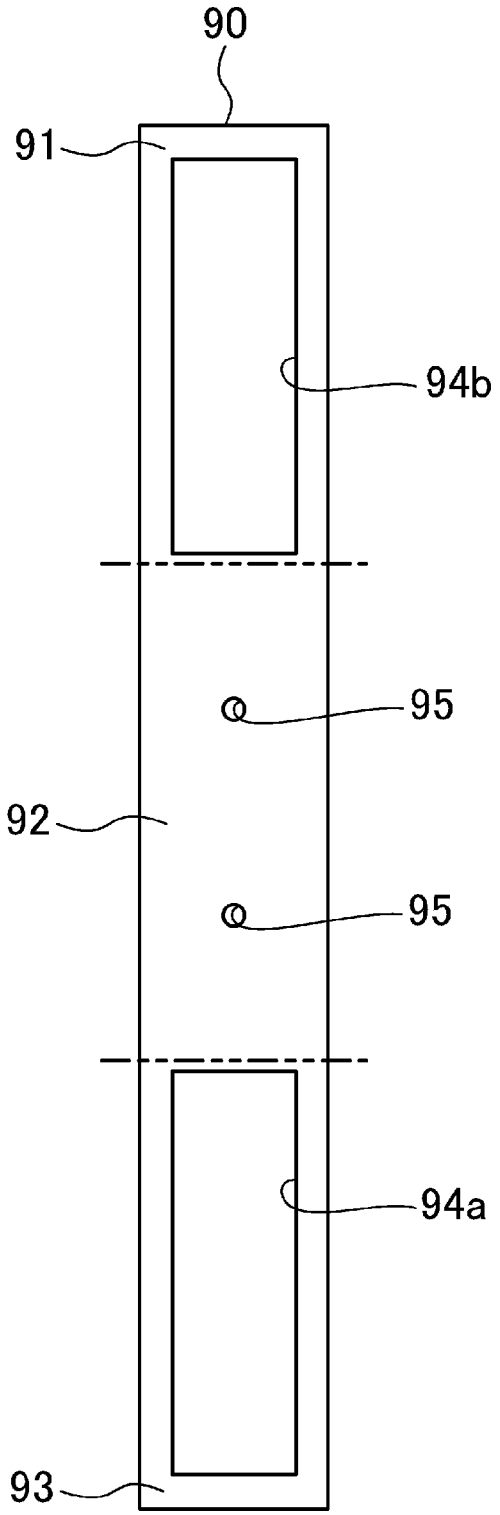
FIG. 7 is a plan view of a vertical partition provided in the outdoor heat exchanger of the first embodiment.

The vertical partition (90) is formed in an elongated rectangular plate shape (see FIG. 7).

The vertical partition (90) is inserted into the slit hole (82) of the upper horizontal partition (80) and the slit hole (87) of the lower horizontal partition (85) (see FIGS. 5 and 6). The vertical partition (90) faces the end surfaces of the flat tubes (32) inserted into the first header collecting pipe (60).

The vertical partition (90) contacts a bottom part of the first header collecting pipe (60) at a lower end thereof, and contacts the partition (39*a*) at an upper end thereof. Moreover, side parts of the vertical partition (90) in a width direction thereof (i.e., in the horizontal direction as viewed in FIGS. 6(A)-6(C)) contact an inner circumferential surface of the first header collecting pipe (60). The vertical partition (90) is not joined to other members. The attitude of the vertical partition (90) is maintained in the state in which the vertical partition (90) is inserted into the slit holes (82, 87) of the horizontal partitions (80, 85) and contacts the partition (39*a*) and the bottom part of the first header collecting pipe (60).

Part of the vertical partition (90) above the upper horizontal partition (80) is an upper part (91), part of the vertical partition (90) between the upper horizontal partition (80) and the lower horizontal partition (85) is a middle part (92), and part of the vertical partition (90) below the lower horizontal partition (85) is a lower part (93) (see FIGS. 5 and 6).

The middle part (92) of the vertical partition (90) divides a space between the upper horizontal partition (80) and the lower horizontal partition (85) into the second communication chamber (62*b*) positioned on a front surface side of the first header collecting pipe (60) and the mixing chamber (63) positioned on a rear surface side of the first header collecting pipe (60). That is, in the first header collecting pipe (60), the mixing chamber (63) is formed on the rear surface side of the second communication chamber (62*b*). The mixing chamber (63) is surrounded by the middle part (92) of the vertical partition (90), the upper horizontal partition (80), the lower horizontal partition (85), and a side wall of the first header collecting pipe (60).

In the vertical partition (90), two rectangular openings (94*a*, 94*b*) and two circular through-holes (95) for communication are formed. The openings (94*a*, 94*b*) and the through-holes (95) each penetrate the vertical partition (90) in a thickness direction thereof.

The openings (94*a*, 94*b*) are formed respectively in the upper part (91) and the lower part (93) of the vertical partition (90). The upper opening (94*b*) forms the mostly of the upper part (91) of the vertical partition (90). Thus, the third communication chamber (62*c*) positioned above the upper horizontal partition (80) is substantially a connected series of spaces formed on both sides of the vertical partition (90). The lower opening (94*a*) forms the mostly of the lower part (93) of the vertical partition (90). Thus, the first communication chamber (62*a*) positioned below the lower horizontal partition (85) is substantially a connected series of spaces formed on both sides of the vertical partition (90).

The through-holes (95) are formed in the middle part (92) of the vertical partition (90). The through-holes (95) are circular holes having a diameter of about 2 mm, and are positioned respectively on upper and lower sides of the middle part (92) relative to the middle of the middle part (92) in the vertical direction.

As just described, the openings (94*a*, 94*b*) are formed respectively in the end parts of the vertical partition (90) in a longitudinal direction thereof, and the through-holes (95) are formed between the openings (94*a*, 94*b*). The openings (94*a*, 94*b*) and the through-holes (95) are arranged in line in the longitudinal direction of the vertical partition (90). The vertical partition (90) is in a bilateral and diphycercal symmetrical shape.

As described above, the through-holes (95) are formed in the vertical partition (90), the through-hole (81) is formed in the upper horizontal partition (80), and the through-hole (86) is formed in the lower horizontal partition (85). The through-holes (95) of the vertical partition (90) allow the mixing chamber (63) to communicate with the second communication chamber (62*b*). The through-hole (81) of the upper horizontal partition (80) allows the mixing chamber (63) to communicate with the third communication chamber (62*c*). The through-hole (86) of the lower horizontal partition (85) allows the mixing chamber (63) to communicate with the first communication chamber (62*a*). The through-holes (81, 86, 95) form distribution paths (65) through which refrigerant of the mixing chamber (63) is distributed to the communication chambers (62*a*-62*c*).

A connection port (66) into which the liquid-side connection pipe (55) is inserted is formed in the side wall of the first header collecting pipe (60). The connection port (66) is a circular through-hole. The connection port (66) is formed in part of the first header collecting pipe (60) between the upper horizontal partition (80) and the lower horizontal partition (85), and communicates with the mixing chamber (63). The center of the connection port (66) is positioned at the middle of the mixing chamber (63) in a height direction thereof. Thus, referring to FIG. 5, a distance $L_1$ between the center of the connection port (66) and a lower surface of the upper horizontal partition (80) and a distance $L_2$ between the center of the connection port (66) and an upper surface of the lower horizontal partition (85) are equal to each other ($L_1=L_2$). Moreover, the connection port (66) faces part of the vertical partition (90) between the through-holes (95).

The liquid-side connection pipe (55) is in such a shape that a connection end part (56) inserted into the connection port (66) of the first header collecting pipe (60) is narrowed. That is, the inner diameter d of the connection end part (56) of the liquid-side connection pipe (55) is smaller than that of other part of the liquid-side connection pipe (55). Moreover, the outer diameter of the connection end part (56) is substantially equal to that of the connection port (66). In the present embodiment, the diameter of each through-hole (81, 86) of the upper horizontal partition (80) and the lower horizontal partition (85) is smaller than the inner diameter of the connection end part (56) of the liquid-side connection pipe (55), and the diameter of the through-hole (95) of the vertical partition (90) is smaller than that of each through-hole (81, 86) of the upper horizontal partition (80) and the lower horizontal partition (85). Moreover, the area of the through-hole (81) of the upper horizontal partition (80) and the area of the through-hole (86) of the lower horizontal partition (85) are each equal to the total area of the through-holes (95) of the vertical partition (90).

<Refrigerant Flow in Outdoor Heat Exchanger Serving as Condenser>

In the air-cooling operation of the air conditioner (10), the outdoor heat exchanger (23) functions as the condenser. The flow of refrigerant in the outdoor heat exchanger (23) during the air-cooling operation will be described.

Gas refrigerant discharged from the compressor (21) is supplied to the outdoor heat exchanger (23). The gas refrigerant sent from the compressor (21) flows into the upper space (61) of the first header collecting pipe (60) through the gas-side connection pipe (57), and then is distributed to the flat tubes (31) of the main heat exchange region (51). While flowing through the fluid paths (34) of the flat tubes (31) of the main heat exchange parts (51*a*-51*c*) of the main heat exchange region (51), the refrigerant of each fluid path (34) is condensed by dissipating heat to outdoor air. Then, the refrigerant flows into the sub-spaces (71*a*-71*c*) of the second header collecting pipe (70).

The refrigerant flowing into each sub-space (71*a*-71*c*) of the main communication space (71) is sent to a corresponding one of the sub-spaces (72*a*-72*c*) of the auxiliary communication space (72). Specifically, the refrigerant flowing into the first sub-space (71*a*) of the main communication space (71) flows downward into the sixth sub-space (72*c*) of the auxiliary communication space (72). The refrigerant flowing into the second sub-space (71*b*) of the main communication space (71) flows into the fourth sub-space (72*a*) of the auxiliary communication space (72) through the first connection pipe (76). The refrigerant flowing into the third sub-space (71*c*) of the main communication space (71) flows into the fifth sub-space (72*b*) of the auxiliary communication space (72) through the second connection pipe (77).

The refrigerant flowing into each sub-space (72*a*-72*c*) of the auxiliary communication space (72) is distributed to the flat tubes (32) of a corresponding one of the auxiliary heat exchange parts (52*a*-52*c*). The refrigerant flowing through each fluid path (34) of the flat tubes (32) turns into sub-cooled liquid by dissipating heat to outdoor air, and then flows into a corresponding one of the communication chambers (62*a*-62*c*) of the lower space (62) of the first header collecting pipe (60). Subsequently, the refrigerant flows into the liquid-side connection pipe (55) through the mixing chamber (63), and then flows out from the outdoor heat exchanger (23).

<Refrigerant Flow in Outdoor Heat Exchanger Serving as Evaporator>

In the air-heating operation of the air conditioner (10), the outdoor heat exchanger (23) functions as the evaporator. The flow of refrigerant in the outdoor heat exchanger (23) during the air-heating operation will be described.

Refrigerant expanded into the two phases of gas and liquid while passing through the expansion valve (24) is supplied to the outdoor heat exchanger (23). The gas-liquid refrigerant flowing out from the expansion valve (24) flows into the mixing chamber (63) of the first header collecting pipe (60) through the liquid-side connection pipe (55) inserted into the connection port (66). At this point, the flow velocity of refrigerant increases when the refrigerant passes through the connection end part (56) of the liquid-side connection pipe (55), and the refrigerant discharged from the liquid-side connection pipe (55) at high flow velocity comes into contact with the vertical partition (90). Thus, in the mixing chamber (63), refrigerant is vigorously stirred, and therefore gas refrigerant and liquid refrigerant contained in the refrigerant are mixed together. That is, the refrigerant in the mixing chamber (63) is homogenized, and therefore the wetness of the refrigerant in the mixing chamber (63) becomes substantially uniform.

The refrigerant in the mixing chamber (63) is distributed to the communication chambers (62*a*-62*c*). That is, the refrigerant in the mixing chamber (63) flows into the first communication chamber (62*a*) through the through-hole (86) of the lower horizontal partition (85), flows into the second communication chamber (62*b*) through the through-holes (95) of the vertical partition (90), and flows into the third communication chamber (62*c*) through the through-hole (81) of the upper horizontal partition (80).

As described above, the gas-liquid refrigerant in the mixing chamber (63) is homogenized. Thus, the wetness of refrigerant flowing into the communication chamber (62*a*-62*c*) from the mixing chamber (63) is uniform among the communication chambers (62*a*-62*c*). Moreover, the area of the through-hole (81) of the upper horizontal partition (80) and the area of the through-hole (86) of the lower horizontal partition (85) are, as described above, each equal to the total area of the through-holes (95) of the vertical partition (90). Thus, the mass flow rate of refrigerant flowing into the communication chamber (62*a*-62*c*) from the mixing chamber (63) is substantially equal among the communication chambers (62*a*-62*c*).

The refrigerant flowing into each communication chamber (62*a*-62*c*) of the first header collecting pipe (60) is distributed to the flat tubes (32) of a corresponding one of the auxiliary heat exchange parts (52*a*-52*c*). The refrigerant flowing into each fluid path (34) of the flat tubes (32) absorbs heat from outdoor air while flowing through the each fluid path (34), and part of the liquid refrigerant is evaporated. The refrigerant having passed through the fluid paths (34) of the flat tubes (32) flows into the sub-spaces (72*a*-72*c*) of the auxiliary communication space (72) of the second header collecting pipe (70). The refrigerant flowing into each sub-space (72*a*-72*c*) is still in the two phases of gas and liquid.

The refrigerant flowing into each sub-space (72*a*-72*c*) of the auxiliary communication space (72) is sent to a corresponding one of the sub-spaces (71*a*-71*c*) of the main communication space (71). Specifically, the refrigerant flowing into the fourth sub-space (72*a*) of the auxiliary communication space (72) flows into the second sub-space (71*b*) of the main communication space (71) through the first connection pipe (76). The refrigerant flowing into the fifth sub-space (72*b*) of the auxiliary communication space (72) flows into the third sub-space (71*c*) of the main communication space (71) through the second connection pipe (77). The refrigerant flowing into the sixth sub-space (72*c*) of the auxiliary communication space (72) upwardly flows into the first sub-space (71*a*) of the main communication space (71).

The refrigerant flowing into each sub-space (71*a*-71*c*) of the main communication space (71) is distributed to the flat tubes (31) of a corresponding one of the main heat exchange parts (51*a*-51*c*). The refrigerant flowing through each fluid path (34) of the flat tubes (31) is substantially evaporated into the single phase of gas by absorbing heat from outdoor air, and then flows into the upper space (61) of the first header collecting pipe (60). Then, the refrigerant flows out from the outdoor heat exchanger (23) through the gas-side connection pipe (57).

Advantages of First Embodiment

In the outdoor heat exchanger (23) of the present embodiment functioning as the evaporator, refrigerant in the two phases of gas and liquid flows into the mixing chamber (63) of the first header collecting pipe (60) through the liquid-side connection pipe (55). At this point, the refrigerant discharged from the liquid-side connection pipe (55) at high flow velocity comes into contact with the vertical partition (90), and therefore refrigerant in the mixing chamber (63) is vigorously stirred.

In the outdoor heat exchanger (23) of the present embodiment, homogenized gas-liquid refrigerant in the mixing chamber (63) is distributed to the three communication chambers (62*a*-62*c*), and then flows so as to branch into the three flat tubes (32) communicating with a corresponding one of the communication chambers (62*a*-62*c*). Thus, the wetness of gas-liquid refrigerant flowing into the communication chamber (62*a*-62*c*) is uniformized among the communication chambers (62*a*-62*c*). As a result, the wetness of refrigerant flowing into the flat tube (32) from the communication chamber (62*a*-62*c*) is uniformized among the flat tubes (32).

In the outdoor heat exchanger (23) of the present embodiment, the area of the through-hole (81) of the upper horizontal partition (80) and the area of the through-hole (86) of the lower horizontal partition (85) are each equal to the total area of the through-holes (95) of the vertical partition (90). Thus, the mass flow rate of refrigerant flowing into the communication chamber (62*a*-62*c*) from the mixing chamber (63) is uniformized among the communication chambers (62*a*-62*c*). As a result, the mass flow rate of refrigerant flowing into the flat tube (32) from the communication chamber (62*a*-62*c*) is uniformized among the flat tubes (32).

According to the present embodiment, the wetness and mass flow rate of refrigerant flowing into the communication chamber (62*a*-62*c*) when the outdoor heat exchanger (23) functions as the evaporator can be uniformized among the communication chambers (62*a*-62*c*). As a result, the wetness and mass flow rate of refrigerant flowing into the flat tube (32) communicating with the communication chamber (62*a*-62*c*) can be uniformized among the flat tubes (32). Thus, performance of the outdoor heat exchanger (23) can be fully achieved.

In the present embodiment, gas-liquid refrigerant supplied to the outdoor heat exchanger (23) functioning as the evaporator is homogenized in the mixing chamber (63), and then is distributed to the communication chambers (62*a*-62*c*) arranged in the vertical direction. Thus, according to the present embodiment, the refrigerant whose wetness is substantially uniform among the communication chambers (62*a*-62*c*) can be supplied from the mixing chamber (63) to the vertically-arranged communication chambers (62*a*-62*c*) with reduced influence of gravity acting on the refrigerant.

In the outdoor heat exchanger (23) of the present embodiment, the connection port (66) of the first header collecting pipe (60) faces the vertical partition (90), and the vertical partition (90) is disposed close to the connection port (66) relative to a center axis (64) of the first header collecting pipe (60). Thus, according to the present embodiment, the flow velocity of refrigerant discharged from the liquid-side connection pipe (55) to contact with the vertical partition (90) can be increased, and therefore refrigerant in the mixing chamber (63) can be more vigorously stirred to enhance homogenization of the refrigerant.

In the outdoor heat exchanger (23) of the present embodiment, the mixing chamber (63) of the first header collecting pipe (60) is adjacent to the first communication chamber (62*a*) with the lower horizontal partition (85) being interposed between the mixing chamber (63) and the first communication chamber (62*a*), is adjacent to the second communication chamber (62*b*) with the vertical partition (90) being interposed between the mixing chamber (63) and the second communication chamber (62*b*), and is adjacent to the third communication chamber (62*c*) with the upper horizontal partition (80) being interposed between the mixing chamber (63) and the third communication chamber (62*c*). Thus, the through-holes (81, 86) formed in the horizontal partitions (80, 85) and the through-holes (95) formed in the vertical partition (90) allow the mixing chamber (63) to communicate with the communication chambers (62*a*-62*c*). Thus, according to the present embodiment, the through-holes (81, 86, 95) having a simple structure can form the distribution paths (65), and therefore complication of the structure of the outdoor heat exchanger (23) can be reduced.

Variation of First Embodiment

As described above, the number of communication chambers formed in the first header collecting pipe (60) of the outdoor heat exchanger (23) is not limited to three. The structure of the lower part of the first header collecting pipe (60) in both of the case where four communication chambers are formed and the case where five communication chambers are formed will be described. Moreover, differences from the structure of the first header collecting pipe (60) in the case where the three communication chambers (62*a*-62*c*) are formed as illustrated in FIG. 5 will be described.

First, the structure of the lower part of the first header collecting pipe (60) in the case where four communication chambers (62*a*-62*d*) are formed will be described with reference to FIG. 8. In this case, the auxiliary heat exchange region (52) of the outdoor heat exchanger (23) is divided into the same number of auxiliary heat exchange parts (52*a*-52*d*) (i.e., four auxiliary heat exchange parts) as that of the communication chambers (62*a*-62*d*). The first auxiliary heat exchange part (52*a*), the second auxiliary heat exchange part (52*b*), the third auxiliary heat exchange part (52*c*), and the fourth auxiliary heat exchange part (52*d*) are arranged in this order from the bottom to the top in the auxiliary heat exchange region (52). Although not shown in FIG. 8, the main heat exchange region (51) of the outdoor heat exchanger (23) is divided into the same number of main heat exchange parts (i.e., four main heat exchange parts) as that of the auxiliary heat exchange parts (52*a*-52*d*).

Figure 8:
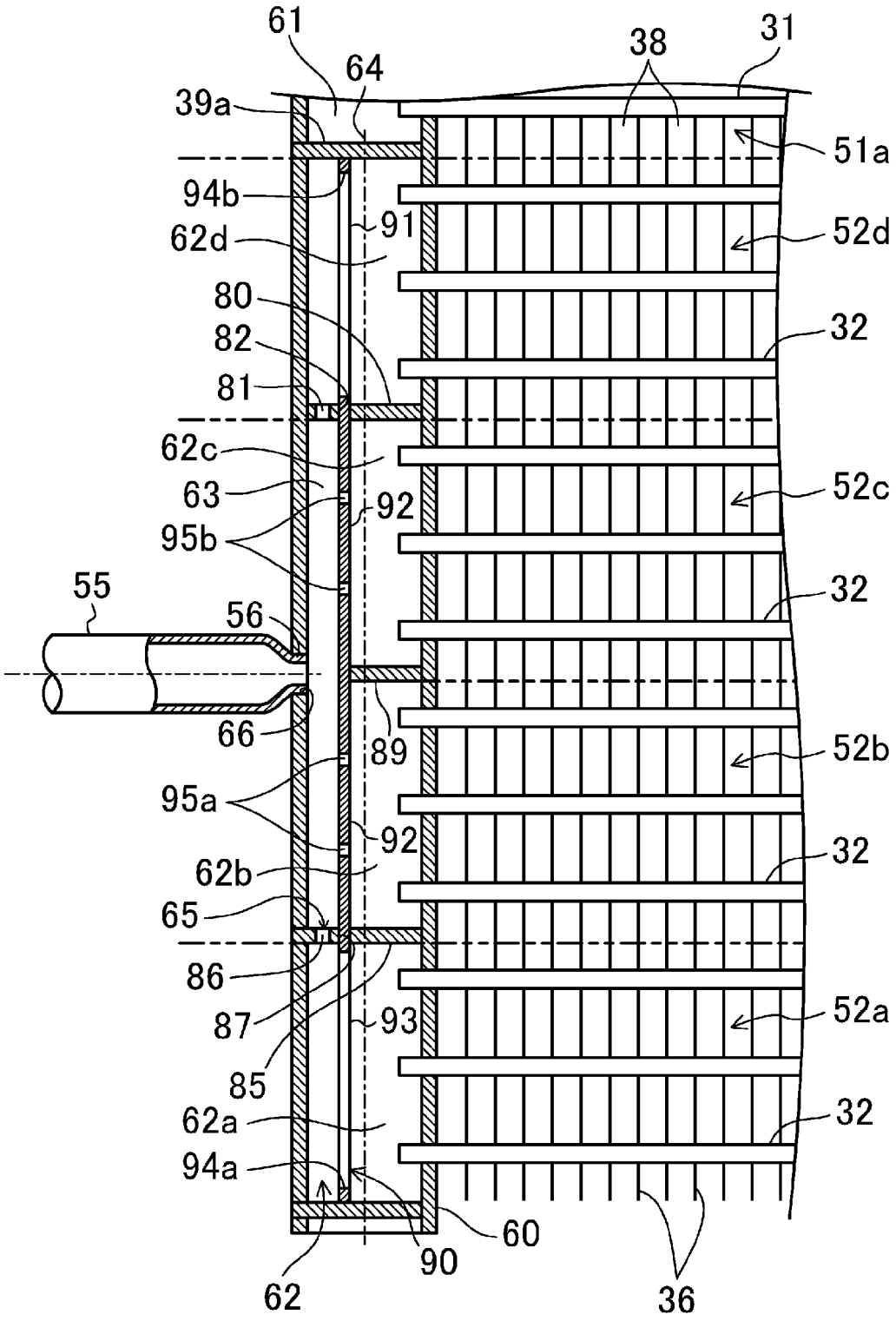
FIG. 8 is an enlarged cross-sectional view illustrating a main part of a front side of an outdoor heat exchanger of a variation (i.e., the case where four communication chambers are formed) of the first embodiment.

Referring to FIG. 8, the upper horizontal partition (80), the lower horizontal partition (85), a middle horizontal partition (89), and the vertical partition (90) are arranged in the lower space (62) of the first header collecting pipe (60). The lower space (62) is divided into the communication chambers (62*a*-62*d*) and the mixing chamber (63) by the horizontal partitions (80, 85, 89) and the vertical partition (90). In the lower space (62), the first communication chamber (62*a*), the second communication chamber (62*b*), the third communication chamber (62*c*), and the fourth communication chamber (62*d*) are arranged in this order from the bottom to the top. The middle horizontal partition (89) is made of an aluminum alloy.

The upper horizontal partition (80) is disposed at a boundary between the third auxiliary heat exchange part (52*c*) and the fourth auxiliary heat exchange part (52*d*) to separate the third communication chamber (62*c*) and the fourth communication chamber (62*d*) from each other. The middle horizontal partition (89) is disposed at a boundary between the second auxiliary heat exchange part (52*b*) and the third auxiliary heat exchange part (52*c*) to separate the second communication chamber (62*b*) and the third communication chamber (62*c*) from each other. The middle horizontal partition (89) horizontally divides a space close to the flat tubes (32) relative to the vertical partition (90). The lower horizontal partition (85) is disposed at the boundary between the first auxiliary heat exchange part (52*a*) and the second auxiliary heat exchange part (52*b*) to separate the first communication chamber (62*a*) and the second communication chamber (62*b*) from each other.

The length of the middle part (92) of the vertical partition (90) illustrated in FIG. 8 is longer than that illustrated in FIG. 5. The middle part (92) of the vertical partition (90) is positioned on the rear surface side of the second communication chamber (62*b*) and the third communication chamber (62*c*) (i.e., on the side opposite to the flat tubes (32)), and separates the second communication chamber (62*b*) and the third communication chamber (62*c*) from the mixing chamber (63). As in the mixing chamber (63) illustrated in FIG. 5, the mixing chamber (63) illustrated in FIG. 8 is surrounded by the middle part (92) of the vertical partition (90), the upper horizontal partition (80), the lower horizontal partition (85), and the side wall of the first header collecting pipe (60).

Four through-holes (95*a*, 95*b*) for communication are formed in the middle part (92) of the vertical partition (90). Lower two (95*a*) of the through-holes (95*a*, 95*b*) are formed in part of the vertical partition (90) adjacent to the second communication chamber (62*b*), and cause the second communication chamber (62*b*) to communicate with the mixing chamber (63). Upper two (95*b*) of the through-holes (95*a*, 95*b*) are formed in part of the vertical partition (90) adjacent to the third communication chamber (62*c*), and cause the third communication chamber (62*c*) to communicate with the mixing chamber (63). The through-holes (95*a*, 95*b*) and the through-holes (81, 86) of the upper horizontal partition (80) and the lower horizontal partition (85) together form the distribution paths (65).

The diameter of the through-hole (95*a*, 95*b*) formed in the vertical partition (90) is equal among the through-holes (95*a*, 95*b*). Moreover, the diameter of the through-hole (95*a*, 95*b*) is smaller than the diameter of each through-hole (81, 86) formed in the upper horizontal partition (80) and the lower horizontal partition (85).

The upper part (91) of the vertical partition (90) illustrated in FIG. 8 is positioned in the fourth communication chamber (62*d*) formed above the upper horizontal partition (80). As in the vertical partition (90) illustrated in FIG. 5, the opening (94*b*) formed close to an upper end of the vertical partition (90) forms the mostly of the upper part (91) of the vertical partition (90). Thus, the fourth communication chamber (62*d*) is a connected series of spaces formed on both sides of the vertical partition (90).

The connection port (66) illustrated in FIG. 8 is formed such that the center thereof is positioned at the middle of the mixing chamber (63) in the height direction thereof. The connection end part (56) of the liquid-side connection pipe (55) is inserted into the connection port (66). The connection end part (56) is in a narrowed shape. The structure illustrated in FIG. 8 is the same as that illustrated in FIG. 5 on this point.

In the state in which the outdoor heat exchanger (23) illustrated in FIG. 8 functions as the evaporator, gas-liquid refrigerant flows into the mixing chamber (63) through the liquid-side connection pipe (55), and the refrigerant discharged from the liquid-side connection pipe (55) comes into contact with the vertical partition (90). Then, the refrigerant in the mixing chamber (63) is distributed to the communication chambers (62*a*-62*d*). That is, the refrigerant in the mixing chamber (63) flows into the first communication chamber (62*a*) through the through-hole (86) of the lower horizontal partition (85), flows into the second communication chamber (62*b*) through the lower through-holes (95*a*) of the vertical partition (90), flows into the third communication chamber (62*c*) through the upper through-holes (95*b*) of the vertical partition (90), and flows into the fourth communication chamber (62*d*) through the through-hole (81) of the upper horizontal partition (80).

Next, the structure of the lower part of the first header collecting pipe (60) in the case where five communication chambers (62*a*-62*e*) are formed will be described with reference to FIG. 9. In this case, the auxiliary heat exchange region (52) of the outdoor heat exchanger (23) is divided into the same number of auxiliary heat exchange parts (52*a*-52*e*) (i.e., five auxiliary heat exchange parts) as that of the communication chambers (62*a*-62*e*). In the auxiliary heat exchange region (52), the first auxiliary heat exchange part (52*a*), the second auxiliary heat exchange part (52*b*), the third auxiliary heat exchange part (52*c*), the fourth auxiliary heat exchange part (52*d*), and the fifth auxiliary heat exchange part (52*e*) are arranged in this order from the bottom to the top. Although not shown in FIG. 9, the main heat exchange region (51) of the outdoor heat exchanger (23) is divided into the same number of main heat exchange parts (i.e., five main heat exchange parts) as that of the auxiliary heat exchange parts (52*a*-52*e*).

Figure 9:
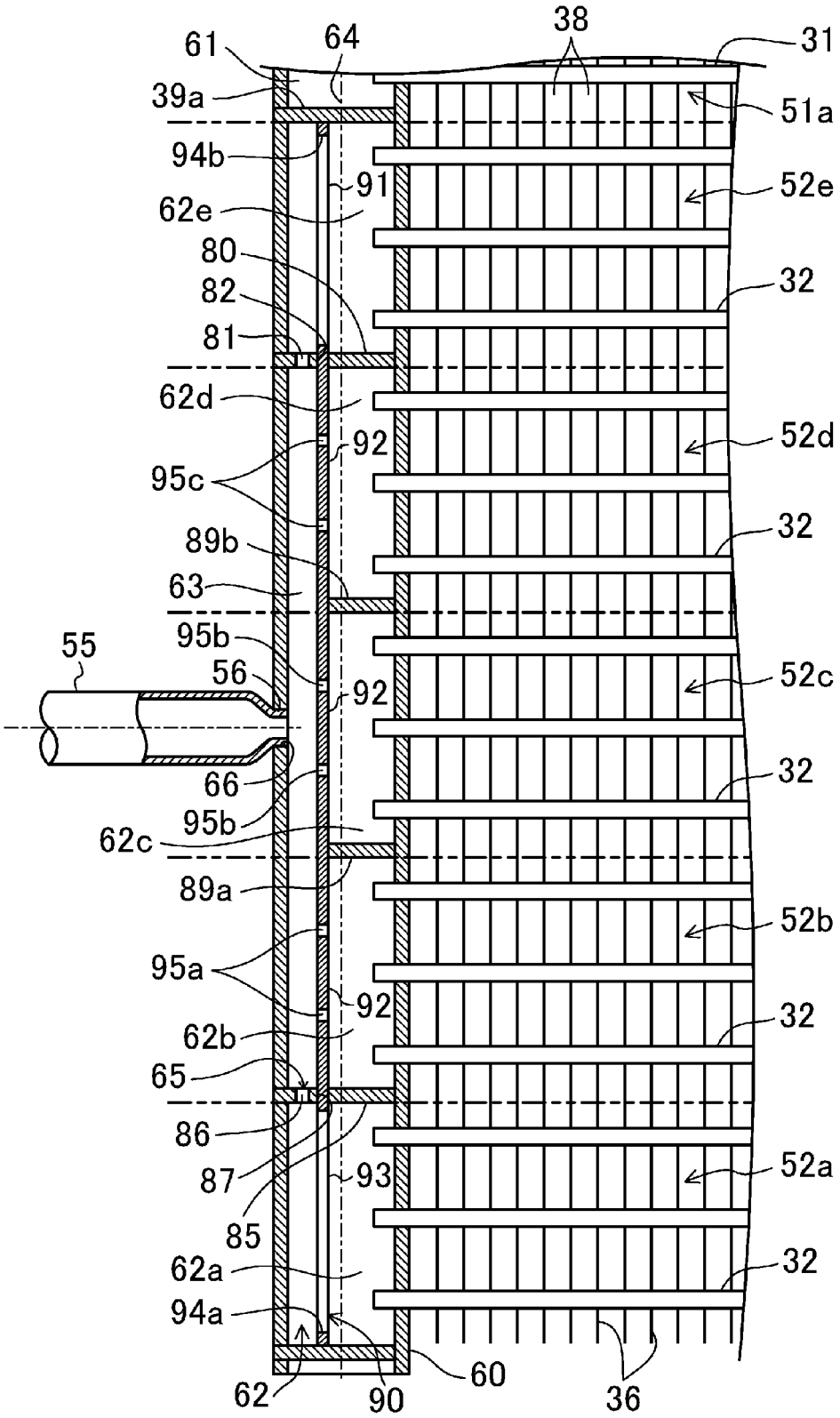
FIG. 9 is an enlarged cross-sectional view illustrating a main part of a front side of an outdoor heat exchanger of another variation (i.e., the case where five communication chambers are formed) of the first embodiment.

Referring to FIG. 9, the upper horizontal partition (80), the lower horizontal partition (85), and the vertical partition (90) are arranged in the lower space (62) of the first header collecting pipe (60). Moreover, two middle horizontal partitions (89*a*, 89*b*) are further arranged in the lower space (62) of the first header collecting pipe (60). The lower space (62) is divided into the communication chambers (62*a*-62*e*) and the mixing chamber (63) by the horizontal partitions (80, 85, 89*a*, 89*b*) and the vertical partition (90). In the lower space (62), the first communication chamber (62*a*), the second communication chamber (62*b*), the third communication chamber (62*c*), the fourth communication chamber (62*d*), and the fifth communication chamber (62*e*) are arranged in this order from the bottom to the top. The middle horizontal partitions (89*a*, 89*b*) are made of an aluminum alloy.

The upper horizontal partition (80) is disposed at a boundary between the fourth auxiliary heat exchange part (52*d*) and the fifth auxiliary heat exchange part (52*e*) to separate the fourth communication chamber (62*d*) and the fifth communication chamber (62*e*) from each other. The upper middle horizontal partition (89*b*) is disposed at the boundary between the third auxiliary heat exchange part (52*c*) and the fourth auxiliary heat exchange part (52*d*) to separate the third communication chamber (62*c*) and the fourth communication chamber (62*d*) from each other. The lower middle horizontal partition (89*a*) is disposed at the boundary between the second auxiliary heat exchange part (52*b*) and the third auxiliary heat exchange part (52*c*) to separate the second communication chamber (62*b*) and the third communication chamber (62*c*) from each other. Each middle horizontal partition (89*a*, 89*b*) horizontally divides the space close to the flat tubes (32) relative to the vertical partition (90). The lower horizontal partition (85) is disposed at the boundary between the first auxiliary heat exchange part (52*a*) and the second auxiliary heat exchange part (52*b*) to separate the first communication chamber (62*a*) and the second communication chamber (62*b*) from each other.

The length of the middle part (92) of the vertical partition (90) illustrated in FIG. 9 is longer than that illustrated in FIG. 5. The middle part (92) of the vertical partition (90) is positioned on the rear surface side of the second communication chamber (62*b*), the third communication chamber (62*c*), and the fourth communication chamber (62*d*) (i.e., on the side opposite to the flat tubes (32)), and separates the second communication chamber (62*b*), the third communication chamber (62*c*), and the fourth communication chamber (62*d*) from the mixing chamber (63). As in the mixing chamber (63) illustrated in FIG. 5, the mixing chamber (63) illustrated in FIG. 9 is surrounded by the middle part (92) of the vertical partition (90), the upper horizontal partition (80), the lower horizontal partition (85), and the side wall of the first header collecting pipe (60).

Six through-holes (95*a*-95*c*) for communication are formed in the middle part (92) of the vertical partition (90). Lower two (95*a*) of the through-holes (95*a*-95*c*) are formed in part of the middle part (92) adjacent to the second communication chamber (62*b*), and cause the second communication chamber (62*b*) to communicate with the mixing chamber (63). Middle two (95*b*) of the through-holes (95*a*-95*c*) are formed in part of the middle part (92) adjacent to the third communication chamber (62*c*), and cause the third communication chamber (62*c*) to communicate with the mixing chamber (63). Upper two (95*c*) of the through-holes (95*a*-95*c*) are formed in part of the middle part (92) adjacent to the fourth communication chamber (62*d*), and cause the fourth communication chamber (62*d*) to communicate with the mixing chamber (63). The through-holes (95*a*-95*c*) and the through-holes (81, 86) of the upper horizontal partition (80) and the lower horizontal partition (85) together form the distribution paths (65).

The diameter of the through-hole (95*a*-95*c*) formed in the vertical partition (90) is equal among the through-holes (95*a*-95*c*). Moreover, the diameter of the through-hole (95*a*-95*c*) is smaller than the diameter of each through-hole (81, 86) formed in the upper horizontal partition (80) and the lower horizontal partition (85).

The upper part (91) of the vertical partition (90) illustrated in FIG. 9 is positioned in the fifth communication chamber (62*e*) formed above the upper horizontal partition (80). As in the vertical partition (90) illustrated in FIG. 5, the opening (94*b*) formed close to the upper end of the vertical partition (90) forms the mostly of the upper part (91) of the vertical partition (90). Thus, the fifth communication chamber (62*e*) is a connected series of spaces formed on both sides of the vertical partition (90).

The connection port (66) illustrated in FIG. 9 is formed such that the center thereof is positioned at the middle of the mixing chamber (63) in the height direction thereof. The connection end part (56) of the liquid-side connection pipe (55) is inserted into the connection port (66). The connection end part (56) is in a narrowed shape. The structure illustrated in FIG. 9 is the same as that illustrated in FIG. 5 on this point.

In the state in which the outdoor heat exchanger (23) illustrated in FIG. 9 functions as the evaporator, gas-liquid refrigerant flows into the mixing chamber (63) through the liquid-side connection pipe (55), and the refrigerant discharged from the liquid-side connection pipe (55) comes into contact with the vertical partition (90). Then, the refrigerant in the mixing chamber (63) is distributed to the communication chambers (62*a*-62*e*). That is, the refrigerant in the mixing chamber (63) flows into the first communication chamber (62*a*) through the through-hole (86) of the lower horizontal partition (85), flows into the second communication chamber (62*b*) through the lower through-holes (95*a*) of the vertical partition (90), flows into the third communication chamber (62*c*) through the middle through-holes (95*b*) of the vertical partition (90), flows into the fourth communication chamber (62*d*) through the upper through-holes (95*c*) of the vertical partition (90), and flows into the fifth communication chamber (62*e*) through the through-hole (81) of the upper horizontal partition (80).

Second Embodiment of the Invention

A second embodiment of the present disclosure will be described. An outdoor heat exchanger (23) of the present embodiment is different from the outdoor heat exchanger (23) of the first embodiment in the configuration of an upper horizontal partition (80), a lower horizontal partition (85), and a vertical partition (90). Differences between the outdoor heat exchanger (23) of the present embodiment and the outdoor heat exchanger (23) of the first embodiment will be described.

Figure 10:
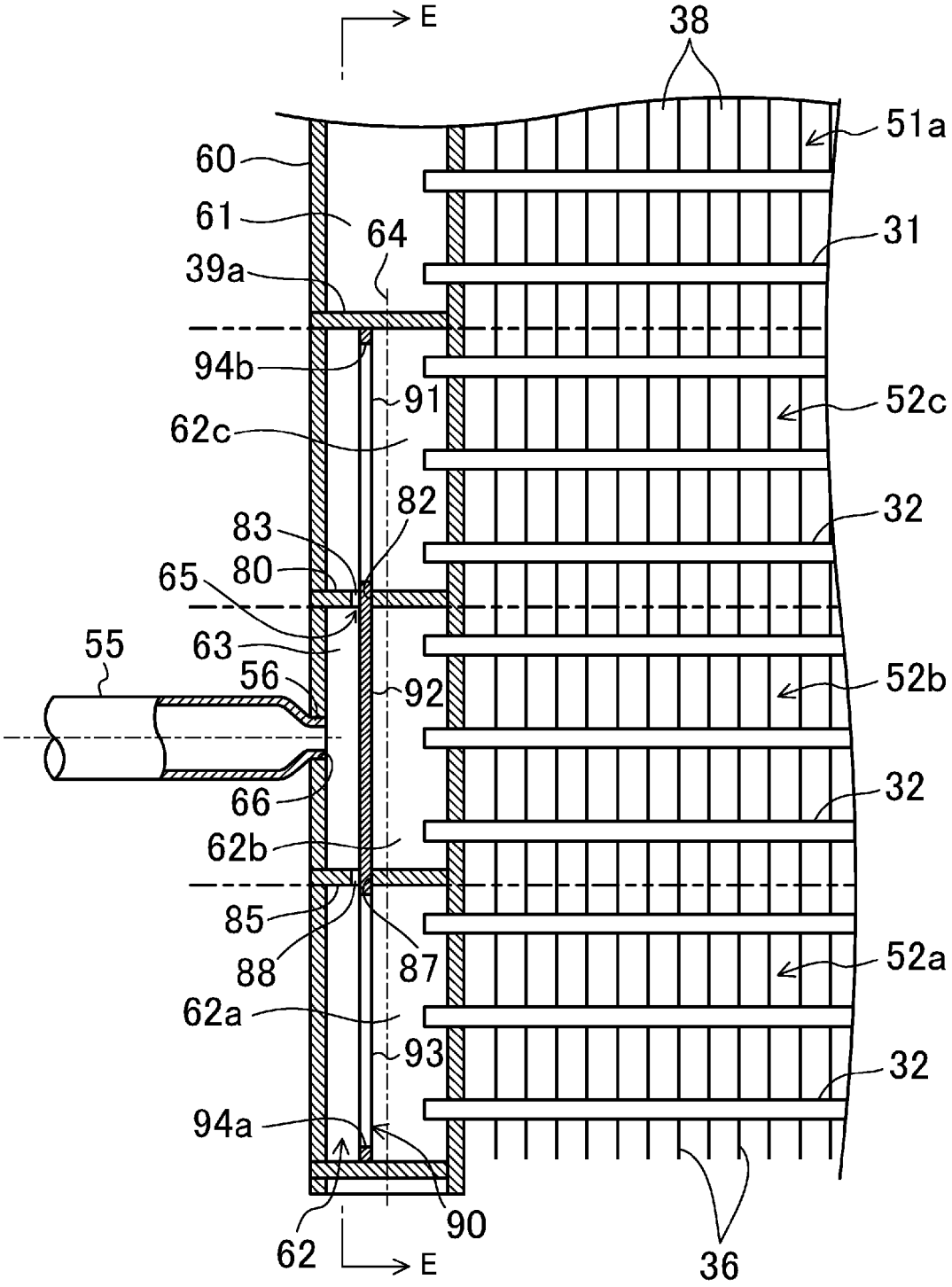
FIG. 10 is an enlarged cross-sectional view illustrating a main part of a front side of an outdoor heat exchanger of a second embodiment.
Figure 11:
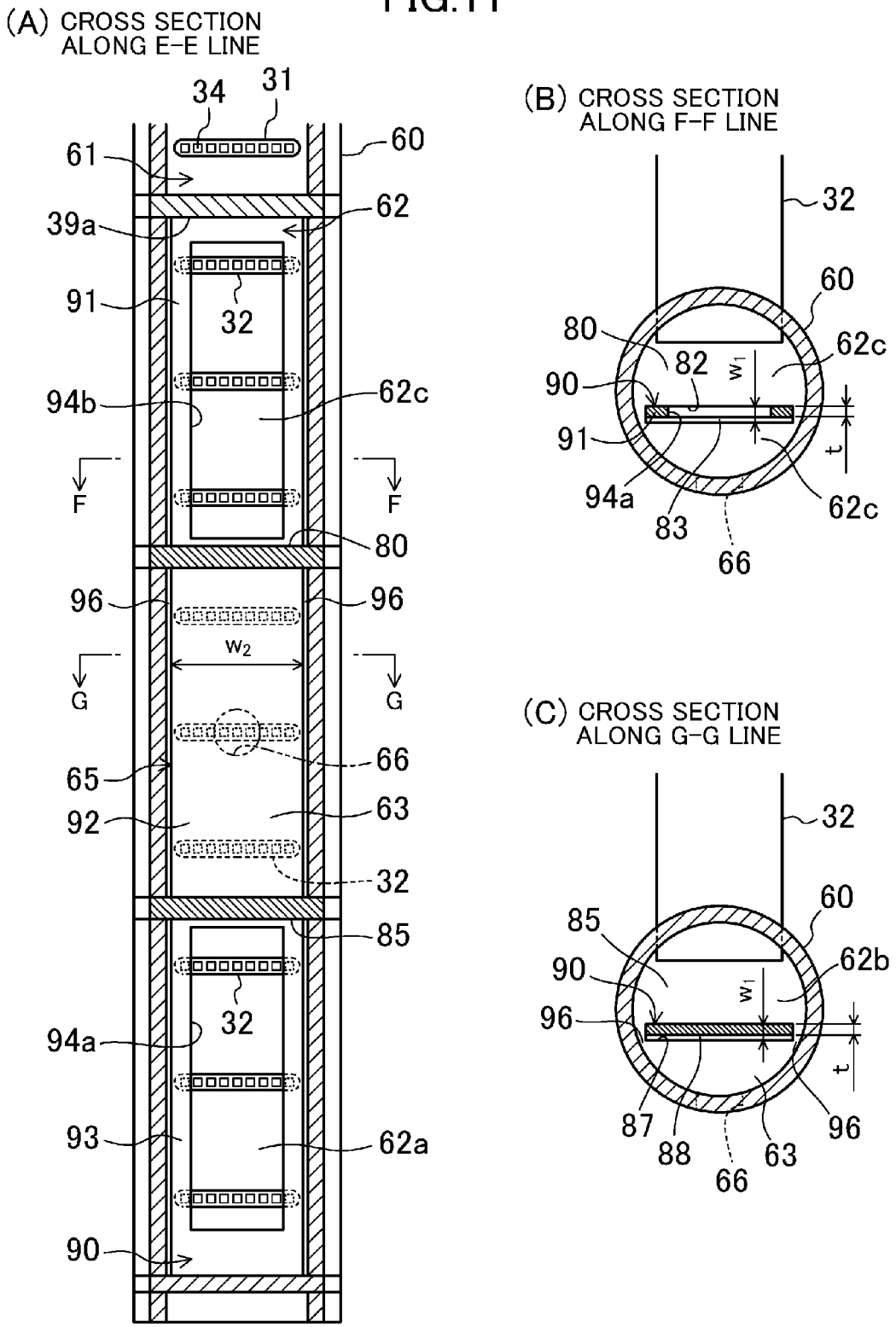
FIGS. 11(A)-11(C) are enlarged cross-sectional views illustrating a main part of the outdoor heat exchanger of the second embodiment.
Figure 12:
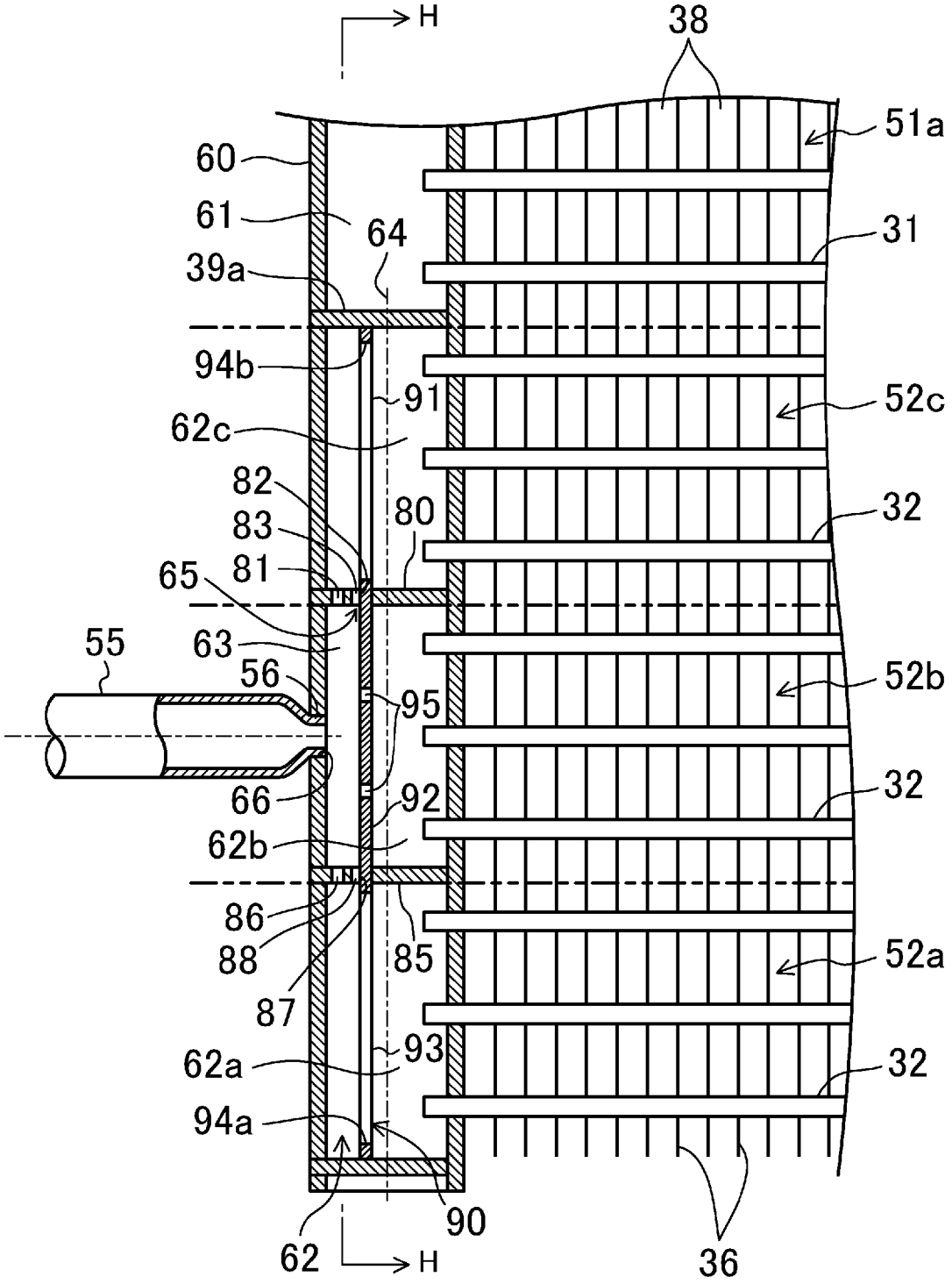
FIG. 12 is an enlarged cross-sectional view illustrating a main part of a front part of an outdoor heat exchanger of a third embodiment.
Figure 13:
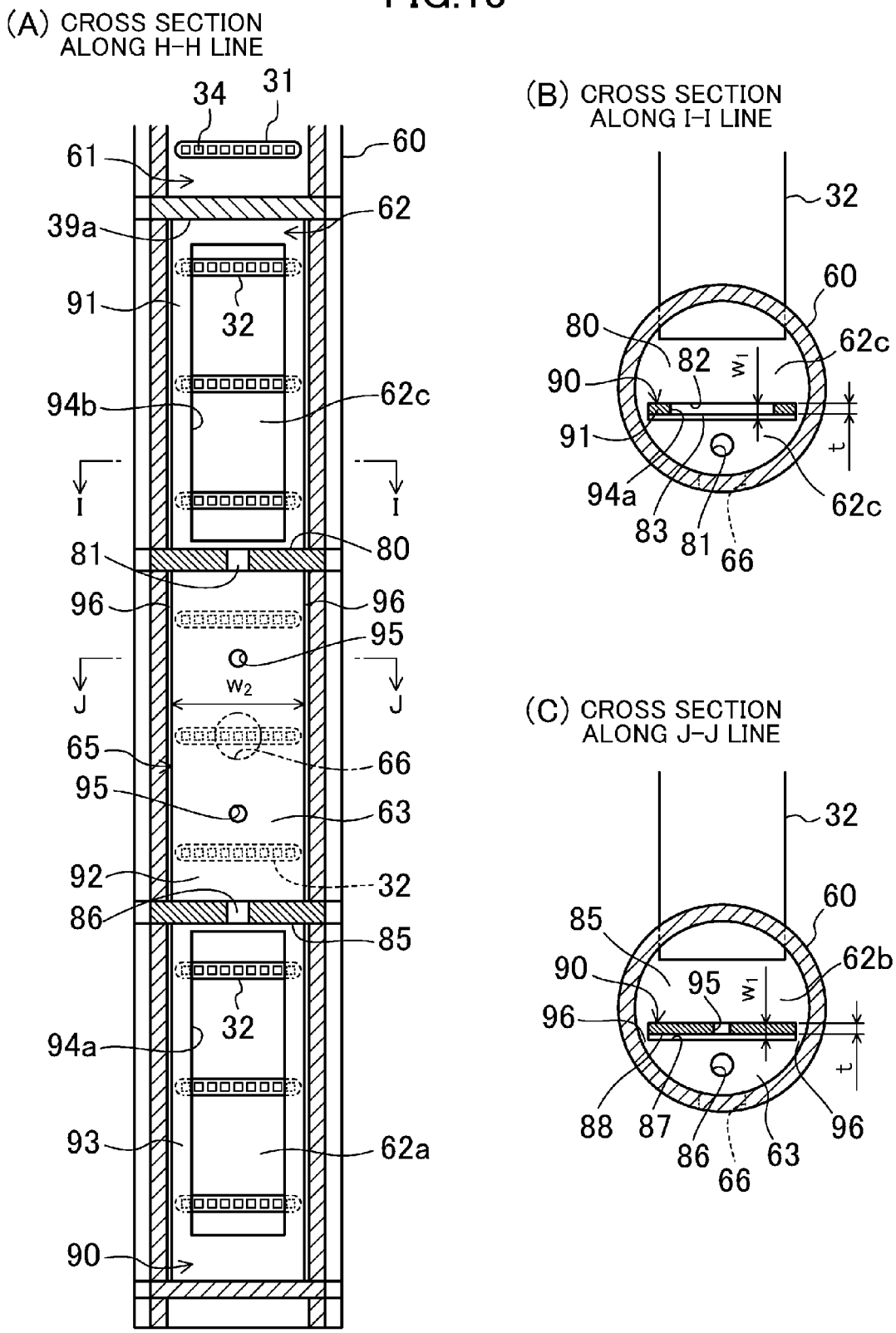
FIGS. 13(A)-13(C) are enlarged cross-sectional views illustrating a main part of the outdoor heat exchanger of the third embodiment.

Referring to FIG. 10, through-holes (81, 86) for communication are not formed in the upper horizontal partition (80) and the lower horizontal partition (85) in the present embodiment. On the other hand, referring to FIGS. 11(A)-11(C), a slit hole width $w_1$ is larger than the thickness t of the vertical partition (90) in each of the upper horizontal partition (80) and the lower horizontal partition (85). Thus, a clearance (83) is formed between the upper horizontal partition (80) and the vertical partition (90) inserted into a slit hole (82), and a third communication chamber (62*c*) and a mixing chamber (63) communicate with each other through the clearance (83). Moreover, a clearance (88) is formed between the lower horizontal partition (85) and the vertical partition (90) inserted into a slit hole (87), and a first communication chamber (62*a*) and the mixing chamber (63) communicate with each other through the clearance (88).

Referring to FIG. 10, a through-hole (95) for communication is not formed in the vertical partition (90) of the present embodiment. On the other hand, referring to FIGS. 11(A)-11(C), the width $w_2$ of the vertical partition (90) is smaller than that of the first embodiment illustrated in FIGS. 6(A)-6(C). Thus, a clearance (96) is formed between each side part of the vertical partition (90) in a width direction thereof (i.e., in the horizontal direction as viewed in FIGS. 11(A)-11(C)) and an inner circumferential surface of a first header collecting pipe (60), and a second communication chamber (62*b*) and the mixing chamber (63) communicate with each other through the clearance (96).

As just described, in the first header collecting pipe (60) of the present embodiment, the mixing chamber (63) communicates with each communication chamber (62*a*-62*c*) through a corresponding one of the clearances (83, 88, 96). That is, in the present embodiment, the clearances (83, 88, 96) form distribution paths (65).

In the state in which the outdoor heat exchanger (23) functions as an evaporator, gas-liquid refrigerant flowing into the mixing chamber (63) through a liquid-side connection pipe (55) flows into the first communication chamber (62*a*) through the clearance (88) formed between the lower horizontal partition (85) and the vertical partition (90), flows into the second communication chamber (62*b*) through the clearances (96) formed between a side wall of the first header collecting pipe (60) and the vertical partition (90), and flows into the third communication chamber (62*c*) through the clearance (83) formed between the upper horizontal partition (80) and the vertical partition (90).

Third Embodiment of the Invention

A third embodiment of the present disclosure will be described. An outdoor heat exchanger (23) of the present embodiment is different from the outdoor heat exchanger (23) of the second embodiment in the configuration of an upper horizontal partition (80), a lower horizontal partition (85), and a vertical partition (90). Differences between the outdoor heat exchanger (23) of the present embodiment and the outdoor heat exchanger (23) of the second embodiment will be described.

Referring to FIGS. 12 and 13(A)-13(C), as in the outdoor heat exchanger (23) of the first embodiment, a through-hole (81) for communication is formed in the upper horizontal partition (80) of the outdoor heat exchanger (23) of the present embodiment, a through-hole (86) for communication is formed in the lower horizontal partition (85) of the outdoor heat exchanger (23) of the present embodiment, and two through-holes (95) for communication are formed in the vertical partition (90) of the outdoor heat exchanger (23) of the present embodiment.

The through-hole (81) which is a circular through-hole is formed in part of the upper horizontal partition (80) close to a rear surface of a first header collecting pipe (60) relative to a slit hole (82). As in the second embodiment, a clearance (83) is formed between the upper horizontal partition (80) and the vertical partition (90) inserted into the slit hole (82). In the first header collecting pipe (60) of the present embodiment, a third communication chamber (62*c*) communicates with a mixing chamber (63) through the clearance (83) and the through-hole (81).

The through-hole (86) which is a circular through-hole is formed in part of the lower horizontal partition (85) close to the rear surface of the first header collecting pipe (60) relative to a slit hole (87). As in the second embodiment, a clearance (88) is formed between the lower horizontal partition (85) and the vertical partition (90) inserted into the slit hole (87). In the first header collecting pipe (60) of the present embodiment, a first communication chamber (62*a*) communicates with the mixing chamber (63) through the clearance (88) and the through-hole (86).

The through-holes (95) which are circular through-holes are formed at intervals in a middle part (92) of the vertical partition (90). As in the second embodiment, a clearance (96) is formed between each side part of the vertical partition (90) in a width direction thereof (i.e., in the horizontal direction as viewed in FIGS. 13(A)-13(C)) and an inner circumferential surface of the first header collecting pipe (60). In the first header collecting pipe (60) of the present embodiment, a second communication chamber (62*b*) communicates with the mixing chamber (63) through the clearances (96) and the through-holes (95).

As just described, in the first header collecting pipe (60) of the present embodiment, the mixing chamber (63) communicates with each communication chamber (62*a*-62*c*) through corresponding ones of the clearances (83, 88, 96) and the through-holes (81, 86, 95). That is, in the present embodiment, the clearances (83, 88, 96) and the through-holes (81, 86, 95) form a through-hole (95).

In the state in which the outdoor heat exchanger (23) functions as an evaporator, gas-liquid refrigerant flowing into the mixing chamber (63) through a liquid-side connection pipe (55) flows into the first communication chamber (62*a*) through any of the clearance (88) formed between the lower horizontal partition (85) and the vertical partition (90) and the through-hole (86) of the lower horizontal partition (85), flows into the second communication chamber (62*b*) through any of the clearances (96) formed between a side wall of the first header collecting pipe (60) and the vertical partition (90) and the through-holes (95) of the vertical partition (90), and flows into the third communication chamber (62*c*) through any of the clearance (83) formed between the upper horizontal partition (80) and the vertical partition (90) and the through-hole (81) of the upper horizontal partition (80).

Fourth Embodiment of the Invention

A fourth embodiment of the present disclosure will be described. An outdoor heat exchanger (23) of the present embodiment is different from the outdoor heat exchanger (23) of the first embodiment in the configuration of an upper horizontal partition (80), a lower horizontal partition (85), and a vertical partition (90). Differences between the outdoor heat exchanger (23) of the present embodiment and the outdoor heat exchanger (23) of the first embodiment will be described.

Figure 14:
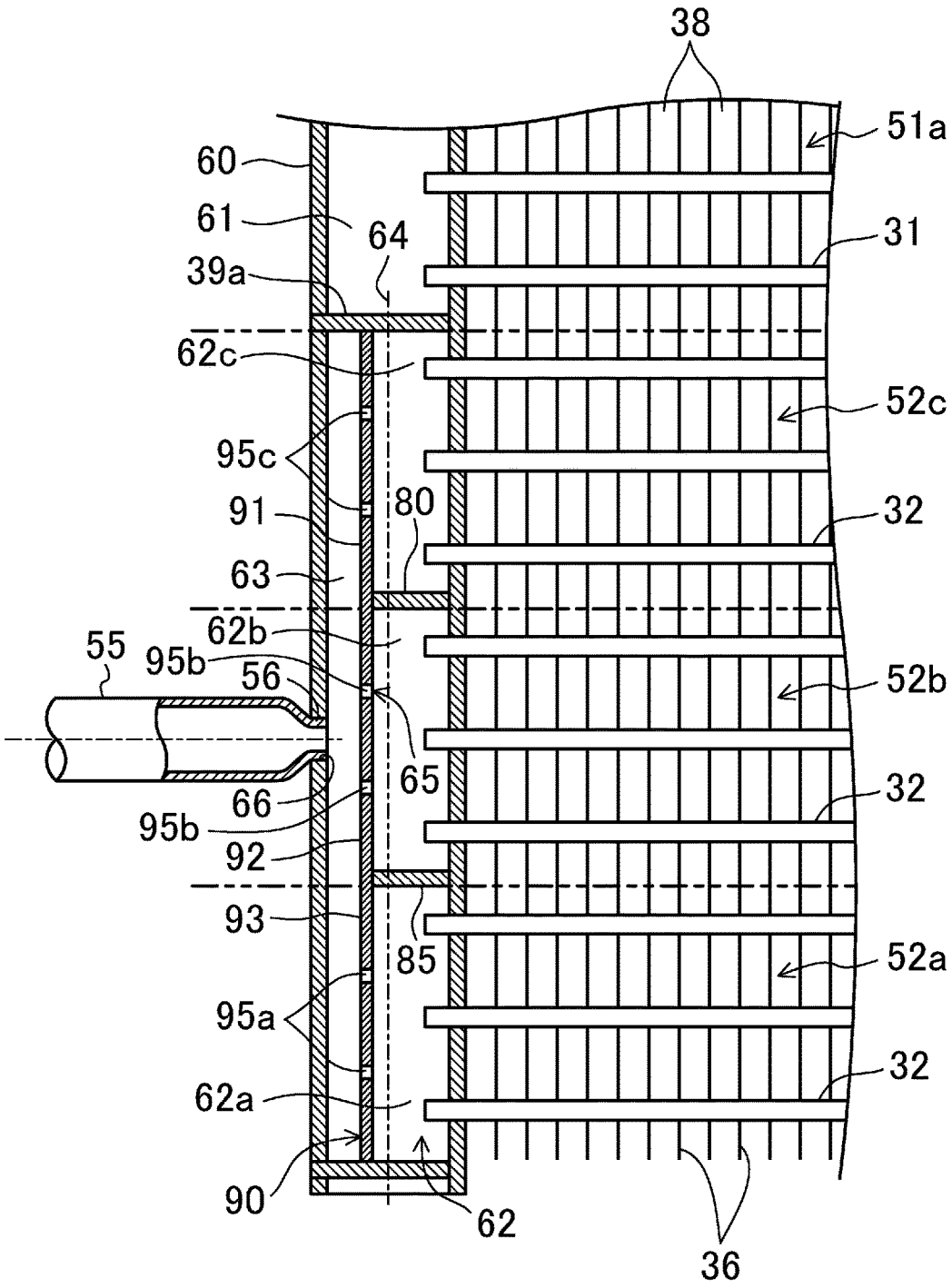
FIG. 14 is an enlarged cross-sectional view illustrating a main part of a front side of an outdoor heat exchanger of a fourth embodiment.

Referring to FIG. 14, the upper horizontal partition (80) and the lower horizontal partition (85) of the present embodiment each horizontally divide only part of a lower space (62) close to flat tubes (32) relative to the vertical partition (90). A mixing chamber (63) of the present embodiment is adjacent to all of communication chambers (62*a*-62*c*) with the vertical partition (90) being interposed between the mixing chamber (63) and each communication chamber (62*a*-62*c*).

Openings (94*a*, 94*b*) are not formed in the vertical partition (90) of the present embodiment. Two through-holes (95*a*-95*c*) for communication are formed in each of an upper part (91), a middle part (92), and a lower part (93) of the vertical partition (90). The diameter of the through-hole (95*a*-95*c*) is equal among the through-holes (95*a*-95*c*). The through-holes (95*a*) formed in the lower part (93) cause the first communication chamber (62*a*) to communicate with the mixing chamber (63). The through-holes (95*b*) formed in the middle part (92) cause the second communication chamber (62*b*) to communicate with the mixing chamber (63). The through-holes (95*c*) formed in the upper part (91) cause the third communication chamber (62*c*) to communicate with the mixing chamber (63).

In the present embodiment, the through-holes (95*a*-95*c*) formed in the vertical partition (90) form distribution paths (65). In the state in which the outdoor heat exchanger (23) functions as an evaporator, gas-liquid refrigerant flowing into the mixing chamber (63) through a liquid-side connection pipe (55) flows into the first communication chamber (62*a*) through the through-holes (95*a*) of the lower part (93), flows into the second communication chamber (62*b*) through the through-holes (95*b*) of the middle part (92), and flows into the third communication chamber (62*c*) through the through-holes (95*c*) of the upper part (91).

Fifth Embodiment of the Invention

A fifth embodiment of the present disclosure will be described. An outdoor heat exchanger (23) of the present embodiment is different from the outdoor heat exchanger (23) of the first embodiment in the configuration of a lower part of a first header collecting pipe (60). Differences between the outdoor heat exchanger (23) of the present embodiment and the outdoor heat exchanger (23) of the first embodiment will be described.

Figure 15:
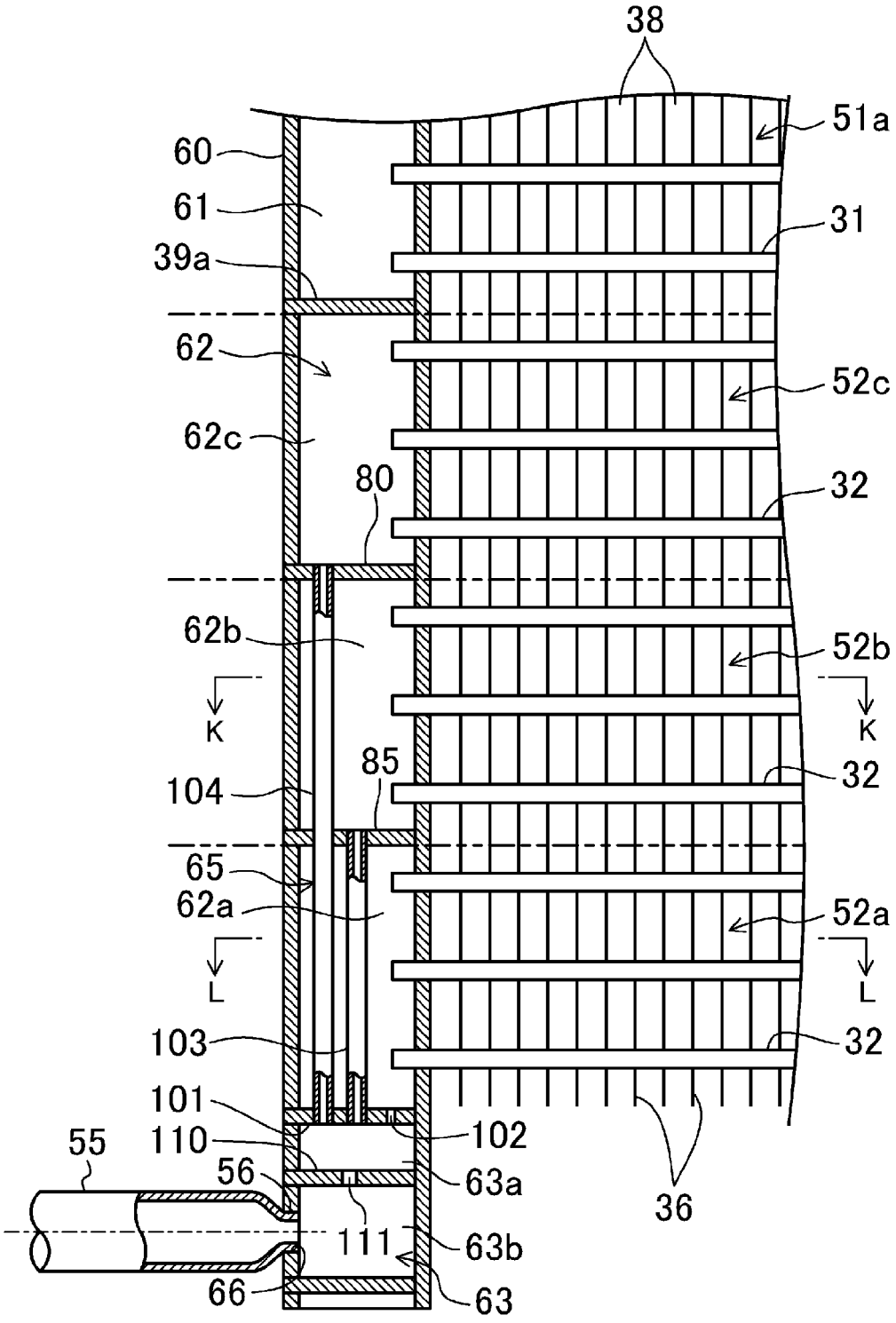
FIG. 15 is an enlarged cross-sectional view illustrating a main part of a front side of an outdoor heat exchanger of a fifth embodiment.

Referring to FIG. 15, the first header collecting pipe (60) of the present embodiment extends downward as compared to the first header collecting pipe (60) of the first embodiment illustrated in FIG. 5. A bottom partition (101) is additionally provided in the first header collecting pipe (60). A lower space (62) of the first header collecting pipe (60) is horizontally divided by an upper horizontal partition (80), a lower horizontal partition (85), and the bottom partition (101). That is, the lower space (62) is divided into a mixing chamber (63), a first communication chamber (62*a*), a second communication chamber (62*b*), and a third communication chamber (62*c*) in this order from the bottom to the top.

A through-hole (102) for communication serving as a connection path is formed in the bottom partition (101). The through-hole (102) is a circular hole penetrating the bottom partition (101) in a thickness direction thereof. Moreover, a first communication pipe (103) and a second communication pipe (104) each serving as a connection path are connected to the bottom partition (101). Each communication pipe (103, 104) is a thin circular pipe. The first communication pipe (103) is joined to the bottom partition (101) at one end thereof, and is joined to the lower horizontal partition (85) at the other end thereof. The second communication pipe (104) is joined to the bottom partition (101) at one end thereof, and is joined to the upper horizontal partition (80) at the other end thereof.

Figure 16:
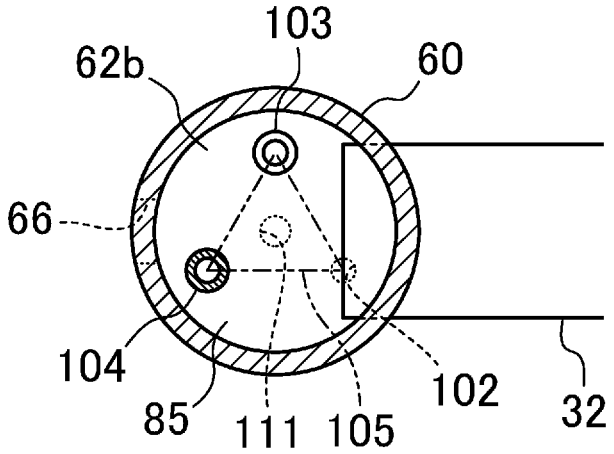
FIGS. 16(A) and 16(B) are enlarged cross-sectional views illustrating a main part of the outdoor heat exchanger of the fifth embodiment.
Figure 16:
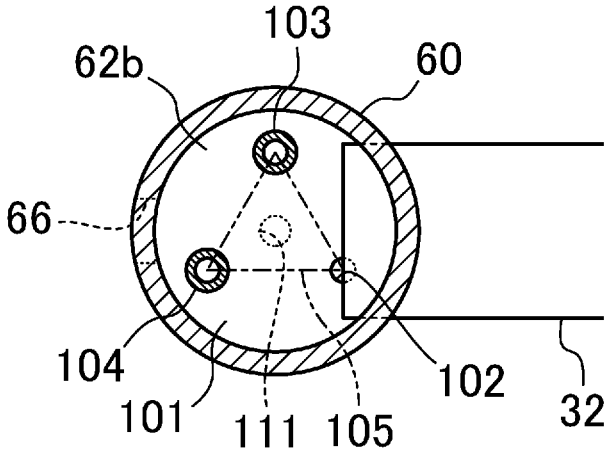

In the present embodiment, the through-hole (102) of the bottom partition (101), the first communication pipe (103), and the second communication pipe (104) form distribution paths (65). That is, the mixing chamber (63) communicates with a first communication chamber (62*a*) through the through-hole (102) of the bottom partition (101), communicates with a second communication chamber (62*b*) through the first communication pipe (103), and communicates with a third communication chamber (62*c*) through the second communication pipe (104). In the bottom partition (101), the through-hole (102), the first communication pipe (103), and the second communication pipe (104) are, referring to FIGS. 16(A) and 16(B), are positioned respectively at vertexes of a regular triangle (105) having the center of gravity on a center axis (64) of the first header collecting pipe (60).

Referring to FIG. 15, a mixing partition (110) is provided in the first header collecting pipe (60) of the present embodiment. The mixing partition (110) horizontally divides the mixing chamber (63). Part of the mixing chamber (63) of the present embodiment above the mixing partition (110) serves as an upper mixing chamber (63*a*), and part of the mixing chamber (63) of the present embodiment below the mixing partition (110) serves as a lower mixing chamber (63*b*). A through-hole (111) for mixing is formed at the center of the mixing partition (110). The through-hole (111) is a circular hole penetrating the mixing partition (110) in a thickness direction thereof. The diameter of the through-hole (111) is about 3 mm, and is larger than each of the followings: the diameter of the through-hole (102) of the bottom partition (101); the inner diameter of the first communication pipe (103); and the inner diameter of the second communication pipe (104). Moreover, the diameter of the through-hole (111) is smaller than each of the followings: the inner diameter of a connection end part (56) of a liquid-side connection pipe (55); and the diameter of a connection port (66).

The connection port (66) of the present embodiment is formed in part of a side wall of the first header collecting pipe (60) below the mixing partition (110). As in the first embodiment, the connection end part (56) of the liquid-side connection pipe (55) is inserted into the connection port (66). The liquid-side connection pipe (55) communicates with the lower mixing chamber (63*b*).

In the state in which the outdoor heat exchanger (23) functions as an evaporator, gas-liquid refrigerant flowing into the lower mixing chamber (63*b*) through the liquid-side connection pipe (55) flows into the upper mixing chamber (63*a*) through the through-hole (111) of the mixing partition (110). When the gas-liquid refrigerant passes through the through-hole (111), gas refrigerant and liquid refrigerant contained in the refrigerant are mixed together. Thus, the homogenized gas-liquid refrigerant flows into the upper mixing chamber (63*a*). That is, the wetness of refrigerant in the upper mixing chamber (63*a*) is substantially uniform. The homogenized gas-liquid refrigerant in the upper mixing chamber (63*a*) is distributed to the communication chambers (62*a*-62*c*). Specifically, the refrigerant in the upper mixing chamber (63*a*) flows into the first communication chamber (62*a*) through the through-hole (102) of the bottom partition (101), flows into the second communication chamber (62*b*) through the first communication pipe (103), and flows into the third communication chamber (62*c*) through the second communication pipe (104).

Sixth Embodiment of the Invention

A sixth embodiment of the present disclosure will be described. The present embodiment is different from the first embodiment in the configuration of an outdoor heat exchanger (23). Differences between the outdoor heat exchanger (23) of the present embodiment and the outdoor heat exchanger (23) of the first embodiment will be described.

Figure 17:
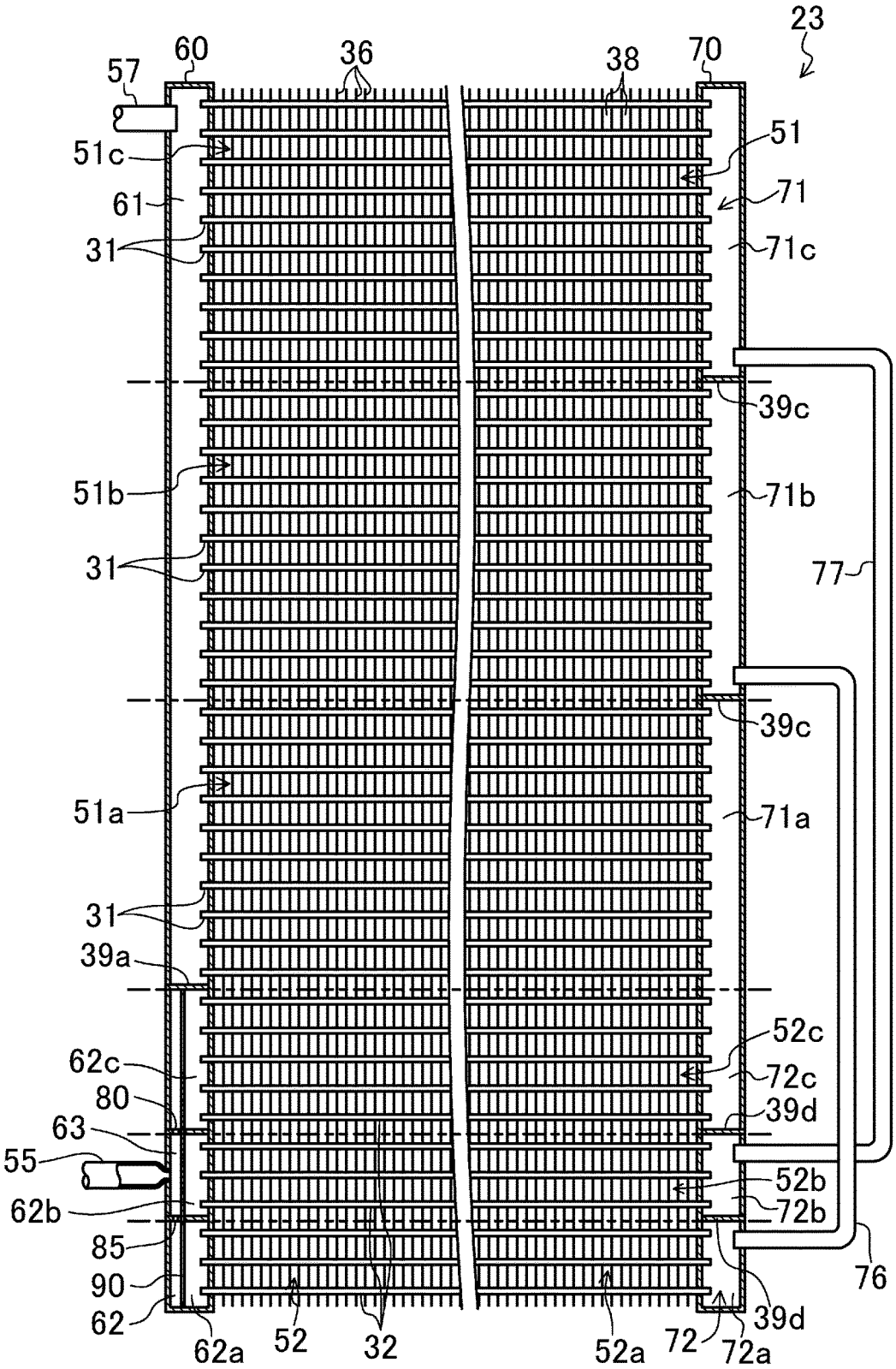
FIG. 17 is a partial cross-sectional view illustrating a front side of an outdoor heat exchanger of a sixth embodiment.

Referring to FIG. 17, the outdoor heat exchanger (23) of the present embodiment includes five flat tubes (32) forming a third auxiliary heat exchange part (52*c*). The outdoor heat exchanger (23) of the present embodiment is the same as that of the first embodiment in that the number of flat tubes (32) forming each of a first auxiliary heat exchange part (52*a*) and a second auxiliary heat exchange part (52*b*) is three.

Referring to FIGS. 18 and 19(A)-19(C), in the outdoor heat exchanger (23) of the present embodiment, the five flat tubes (32) communicate with a third communication chamber (62*c*) of a first header collecting pipe (60). Moreover, in the outdoor heat exchanger (23) of the present embodiment, the five flat tubes (32) communicate with a sixth sub-space (72*c*) of an auxiliary communication space (72) of a second header collecting pipe (70) (see FIG. 17).

Figure 19:
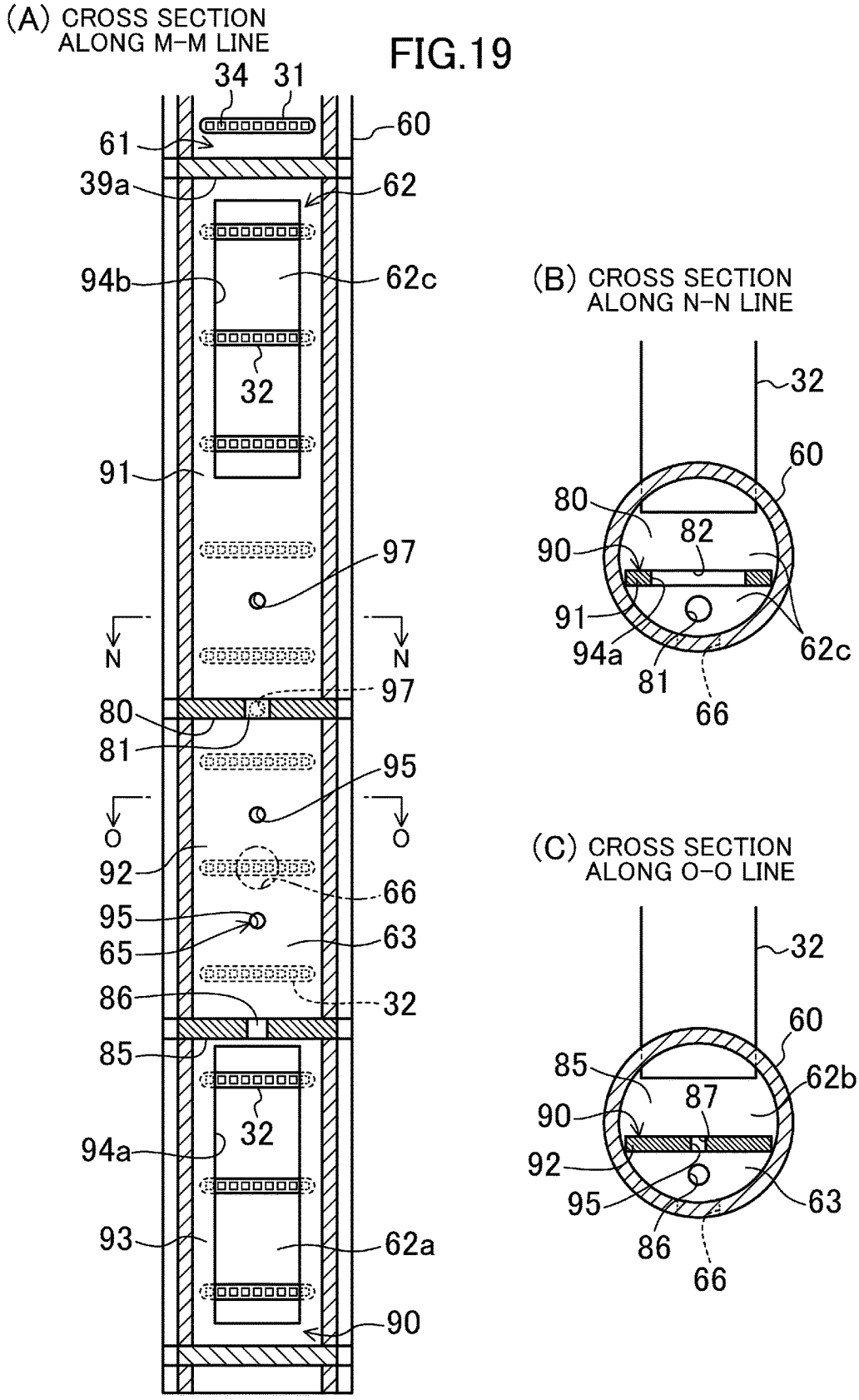
FIGS. 19(A)-19(C) are enlarged cross-sectional views illustrating a main part of the outdoor heat exchanger of the sixth embodiment.

Referring to FIGS. 19(A)-19(C), in the outdoor heat exchanger (23) of the present embodiment, the diameter of a through-hole (81) of an upper horizontal partition (80) is larger than that of a through-hole (86) of a lower horizontal partition (85).

Figure 20:
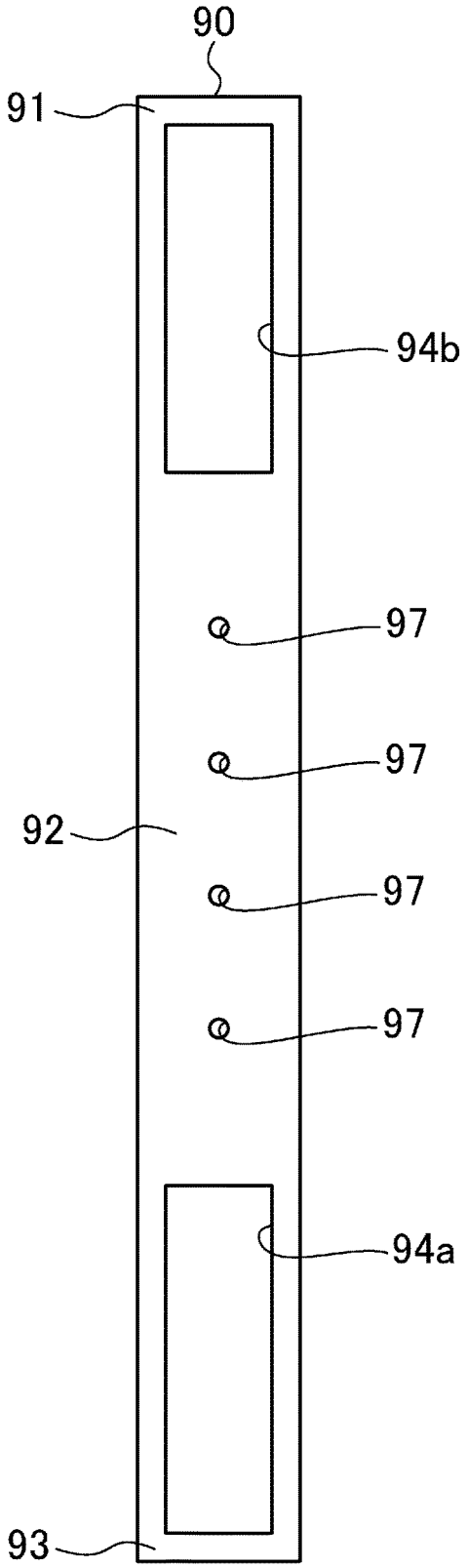
FIG. 20 is a plan view of a vertical partition provided in the outdoor heat exchanger of the sixth embodiment.

Referring to FIG. 20, a vertical partition (90) of the present embodiment is formed in such a rectangular plate shape that a long side thereof is longer than that of the vertical partition (90) of the first embodiment.

As in the first embodiment, two rectangular openings (94*a*, 94*b*) are formed in the vertical partition (90) of the present embodiment. One (94*a*) of the openings (94*a*, 94*b*) is positioned close to a lower end of the vertical partition (90), and the other opening (94*b*) is positioned close to an upper end of the vertical partition (90). As in the first embodiment, each opening (94*a*, 94*b*) penetrates the vertical partition (90) in a thickness direction thereof. The size of each opening (94*a*, 94*b*) is the same as that of the first embodiment.

Four circular through-holes (97) are formed in the vertical partition (90) of the present embodiment. The through-holes (97) are formed at certain intervals in part of the vertical partition (90) between the openings (94*a*, 94*b*). Each through-hole (97) penetrates the vertical partition (90) in the thickness direction thereof.

As just described, in the vertical partition (90), each opening (94*a*, 94*b*) is formed in a corresponding one of end parts of the vertical partition (90) in a longitudinal direction thereof, and the through-holes (97) are formed between the openings (94*a*, 94*b*). The openings (94*a*, 94*b*) and the through-holes (97) are arranged in line in the longitudinal direction of the vertical partition (90). The vertical partition (90) is in a bilateral and diphycercal symmetrical shape.

As in the first embodiment, the vertical partition (90) of the present embodiment is inserted into slit holes (82, 87) of the upper horizontal partition (80) and the lower horizontal partition (85), and contacts a partition (39*a*) and a bottom part of the first header collecting pipe (60) (see FIGS. 18 and 19(A)-19(C)). In this state, the lower opening (94*a*) of the vertical partition (90) is positioned below the lower horizontal partition (85), lower two of the through-holes (97) of the vertical partition (90) are positioned between the upper horizontal partition (80) and the lower horizontal partition (85), and the upper opening (94*b*) and the uppermost through-hole (97) of the vertical partition (90) are positioned above the upper horizontal partition (80). The second top through-hole (97) is positioned at the slit hole (82) of the upper horizontal partition (80).

As described above, lower two of the through-holes (97) of the vertical partition (90) attached to the first header collecting pipe (60) are positioned between the upper horizontal partition (80) and the lower horizontal partition (85). The through-holes (97) positioned between the upper horizontal partition (80) and the lower horizontal partition (85) each serve as a through-hole (95) for communication configured to cause a mixing chamber (63) to communicate with a second communication chamber (62*b*). That is, in the vertical partition (90) of the present embodiment, only two of the through-holes (97) positioned between the upper horizontal partition (80) and the lower horizontal partition (85) serve as the through-holes (95).

Advantages of Sixth Embodiment

In the case where the vertical partition (90) is in a bilateral and diphycercal asymmetrical shape, the outdoor heat exchanger (23) does not normally function as long as the vertical partition (90) is not placed in a particular attitude in the first header collecting pipe (60).

On the other hand, in the outdoor heat exchanger (23) of the present embodiment, the number of flat tubes (32) forming the third auxiliary heat exchange part (52*c*) is higher than the number of flat tubes (32) forming the first auxiliary heat exchange part (52*a*) or the second auxiliary heat exchange part (52*b*), but the vertical partition (90) is in the bilateral and diphycercal symmetrical shape. This eliminates the possibility of attaching the vertical partition (90) in an incorrect attitude to the first header collecting pipe (60) in the process of manufacturing of the outdoor heat exchanger (23). Thus, according to the present embodiment, the steps of manufacturing the outdoor heat exchanger (23) in which the number of flat tubes (32) varies according to the auxiliary heat exchange parts (52*a*-52*c*) can be simplified, and the rate of occurrence of defective products in the manufacturing process can be reduced.

Variation of Sixth Embodiment

In the outdoor heat exchanger (23) of the present embodiment, the position at which a gas-side connection pipe (57) is connected to the first header collecting pipe (60) and the position at which each connection pipe (76, 77) is connected to a second header collecting pipe (70) may be changed.

Figure 21:
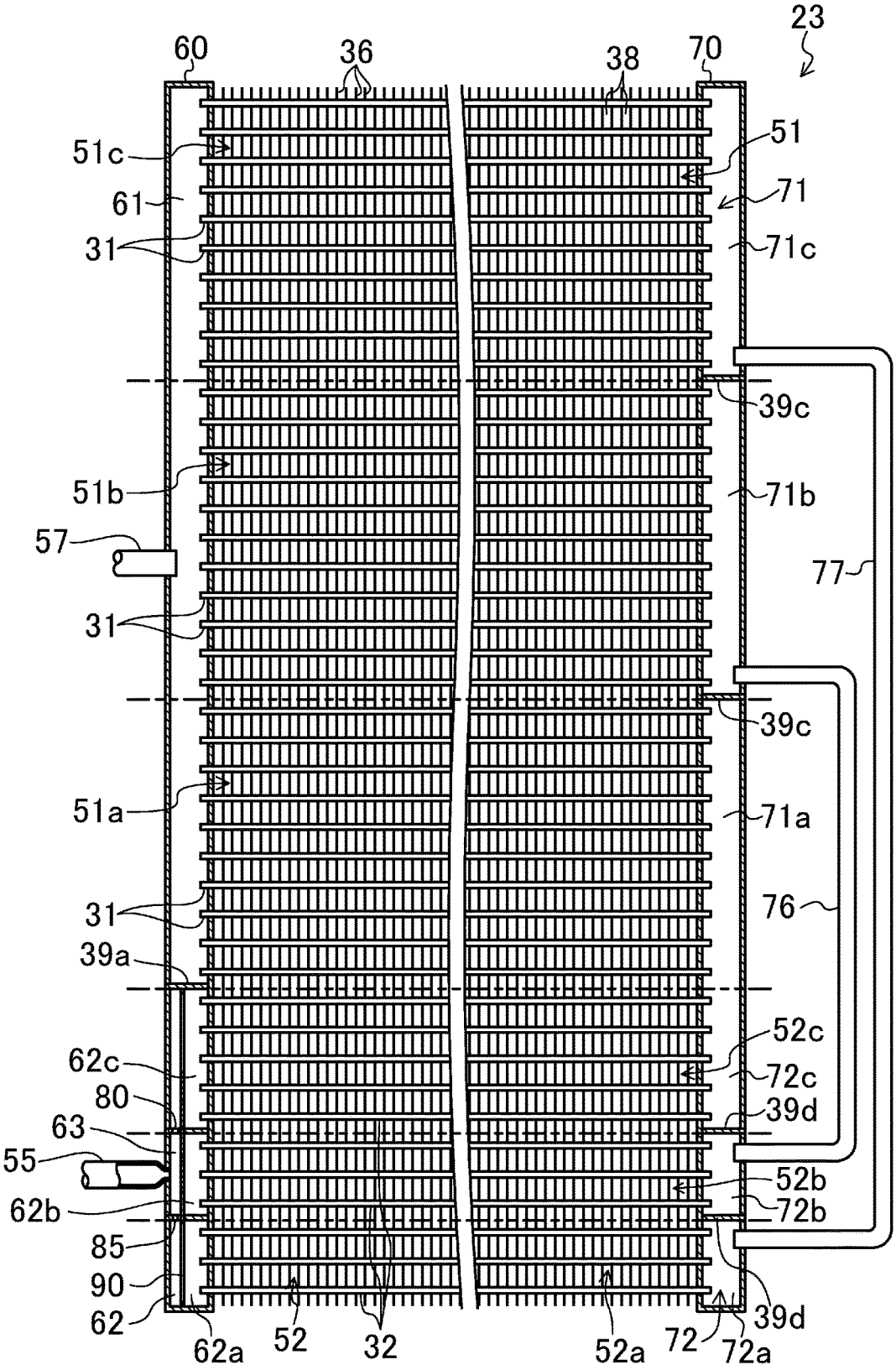
FIG. 21 is a partial cross-sectional view illustrating a front side of an outdoor heat exchanger of a variation of the sixth embodiment.

Referring to FIG. 21, the gas-side connection pipe (57) is connected to the vicinity of the middle, in the vertical direction, of part of the first header collecting pipe (60) of the present variation forming an upper space (61) (i.e., part of the first header collecting pipe (60) above the partition (39*a*)). On the other hand, in the second header collecting pipe (70) of the present variation, the first connection pipe (76) is connected to a fifth sub-space (72*b*) corresponding to the second auxiliary heat exchange part (52*b*), and the second connection pipe (77) is connected to a fourth sub-space (72*a*) corresponding to the first auxiliary heat exchange part (52*a*). The outdoor heat exchanger (23) illustrated in FIG. 21 is similar to that illustrated in FIG. 17 in that a first sub-space (71*a*) and the sixth sub-space (72*c*) form a connected series of spaces.

As described above, in the outdoor heat exchanger (23) of the present variation, a first main heat exchange part (51*a*) and the third auxiliary heat exchange part (52*c*) are connected together in series, a second main heat exchange part (51*b*) and the second auxiliary heat exchange part (52*b*) are connected together in series, and a third main heat exchange part (51*c*) and the first auxiliary heat exchange part (52*a*) are connected together in series.

Seventh Embodiment of the Invention

A seventh embodiment of the present disclosure will be described. An outdoor heat exchanger (23) of the present embodiment is formed in such a manner that the outdoor heat exchanger (23) of the sixth embodiment is modified to reduce the rate of occurrence of defective products in a manufacturing process.

Figure 18:
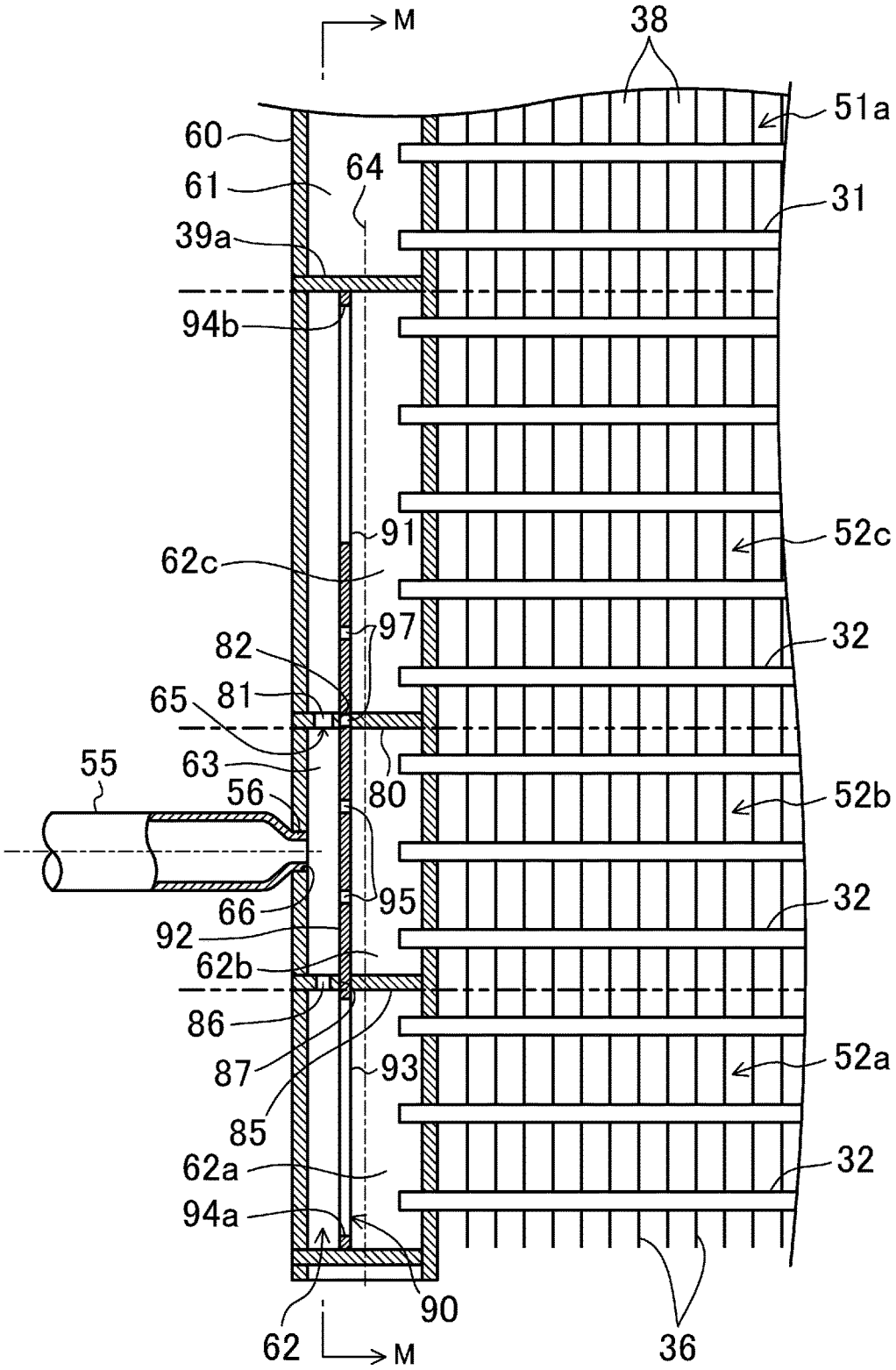
FIG. 18 is an enlarged cross-sectional view illustrating a main part of the front part of the outdoor heat exchanger of the sixth embodiment.

Three types of partitions (39*a*, 80, 85) are provided in the first header collecting pipe (60) of the outdoor heat exchanger (23) of the sixth embodiment illustrated in FIG. 18. That is, the following partitions are provided in the first header collecting pipe (60): the partitions (39*a*) formed without a through-hole; the upper horizontal partition (80) formed with a slightly-larger through-hole (81) for communication and a slit hole (82); and the lower horizontal partition (85) formed with a slightly-smaller through-hole (86) for communication and a slit hole (87).

In order that the outdoor heat exchanger (23) normally functions, it is necessary that the partitions (39*a*, 80, 85) are attached to the proper positions of the first header collecting pipe (60). That is, if the partitions (39*a*, 80, 85) are attached to improper positions of the first header collecting pipe (60) in the process of manufacturing of the outdoor heat exchanger (23), defective products which do not normally function are manufactured.

For the outdoor heat exchanger (23) of the present embodiment, measures are taken to certainly attach the partitions (39*a*, 80, 85) to the proper positions of the first header collecting pipe (60) in the process of manufacturing of the outdoor heat exchanger (23). Differences between the outdoor heat exchanger (23) of the present embodiment and the outdoor heat exchanger (23) of the sixth embodiment will be described.

Figure 22:
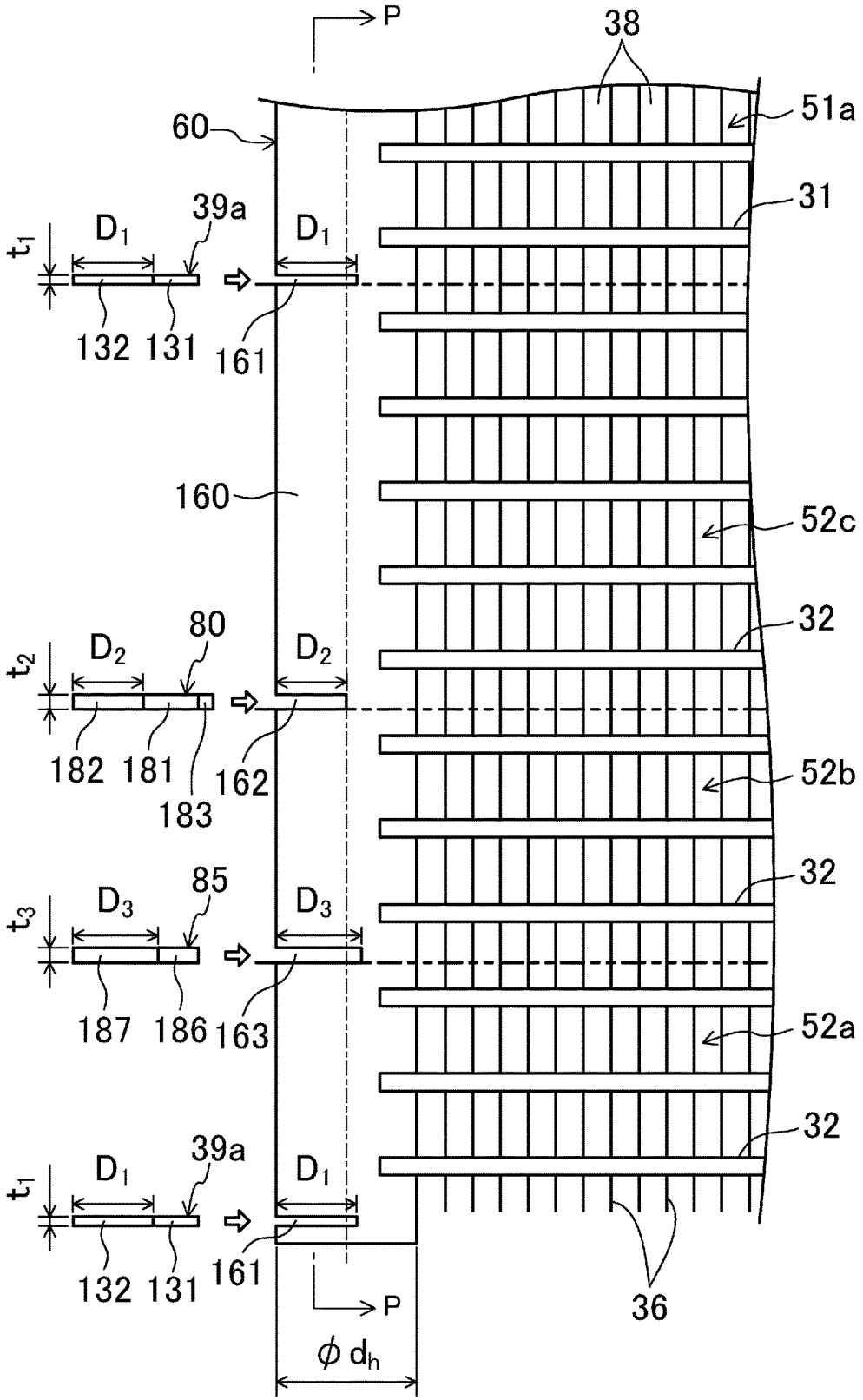
FIG. 22 is an enlarged front view illustrating a main part of an outdoor heat exchanger of a seventh embodiment in the middle of assembly of the outdoor heat exchanger.

Referring to FIG. 22, insertion holes (161-163) into each of which a corresponding one of the partitions (39*a*, 80, 85) is inserted are formed in a body member (160) of the first header collecting pipe (60) of the present embodiment. Note that the body member (160) is a cylindrical member forming the mostly of the first header collecting pipe (60) and made of an aluminum alloy. All of flat tubes (31, 32) are inserted into the body member (160) of the first header collecting pipe (60).

The following holes are formed in the body member (160): the insertion holes (161) for attachment of the partitions (39*a*); the upper insertion hole (162) for attachment of the upper horizontal partition (80); and the lower insertion hole (163) for attachment of the lower horizontal partition (85). The insertion holes (161-163) are slit-shaped through-holes formed on a rear surface side of the body member (160) (i.e., on a side of the body member (160) opposite to a side on which the flat tubes (31, 32) are inserted).

The insertion holes (161) are formed respectively in a boundary part of the body member (160) between a first main heat exchange part (51*a*) and a third auxiliary heat exchange part (52*c*), a lower end part of the body member (160), and an upper end part of the body member (160). The cutting depth $D_1$ (i.e., the length from a rear-surface-side end of the body member (160) to the front-surface-side end of the insertion hole (161)) of the insertion hole (161) is longer than the half of the outer diameter $d_h$ of the body member (160) ($d_h/2<D_1$). Moreover, the width of the insertion hole (161) is slightly larger than the thickness $t_1$ of the partition (39*a*).

The upper insertion hole (162) is formed in a boundary part of the body member (160) between a second auxiliary heat exchange part (52*b*) and the third auxiliary heat exchange part (52*c*). The cutting depth $D_2$ (i.e., the length from the rear-surface-side end of the body member (160) to the front-surface-side end of the upper insertion hole (162)) of the upper insertion hole (162) is equal to the half of the outer diameter $d_h$ of the body member (160) ($D_2=d_h/2$). That is, the cutting depth $D_2$ of the upper insertion hole (162) is shorter than the cutting depth $D_1$ of the insertion hole (161) ($D_2<D_1$). Moreover, the width of the upper insertion hole (162) is slightly larger than the thickness $t_2$ of the upper horizontal partition (80).

The lower insertion hole (163) is formed in a boundary part of the body member (160) between a first auxiliary heat exchange part (52*a*) and the second auxiliary heat exchange part (52*b*). The cutting depth $D_3$ (i.e., the length from the rear-surface-side end of the body member (160) to the front-surface-side end of the lower insertion hole (163)) of the lower insertion hole (163) is longer than the cutting depth $D_1$ of the insertion hole (161) ($D_1<D_3$). Moreover, the width of the lower insertion hole (163) is slightly larger than the thickness $t_3$ of the lower horizontal partition (85).

As just described, the cutting depth $D_1$ of the insertion hole (161), the cutting depth $D_2$ of the upper insertion hole (162), and the cutting depth $D_3$ of the lower insertion hole (163) are different from each other. As will be described later, the thickness $t_1$ of the partition (39*a*) is about the half of each of the thickness $t_2$ of the upper horizontal partition (80) and the thickness $t_3$ of the lower horizontal partition (85). Thus, the width of the insertion hole (161) is also about the half of each of the width of the upper insertion hole (162) and the width of the lower insertion hole (163). The insertion hole (161), the upper insertion hole (162), and the lower insertion hole (163) are different from each other in shapes.

A fitting hole (164) into which a later-described protrusion (183) of the upper horizontal partition (80) is fitted is formed at the position facing the upper insertion hole (162) in the body member (160).

Figure 23:
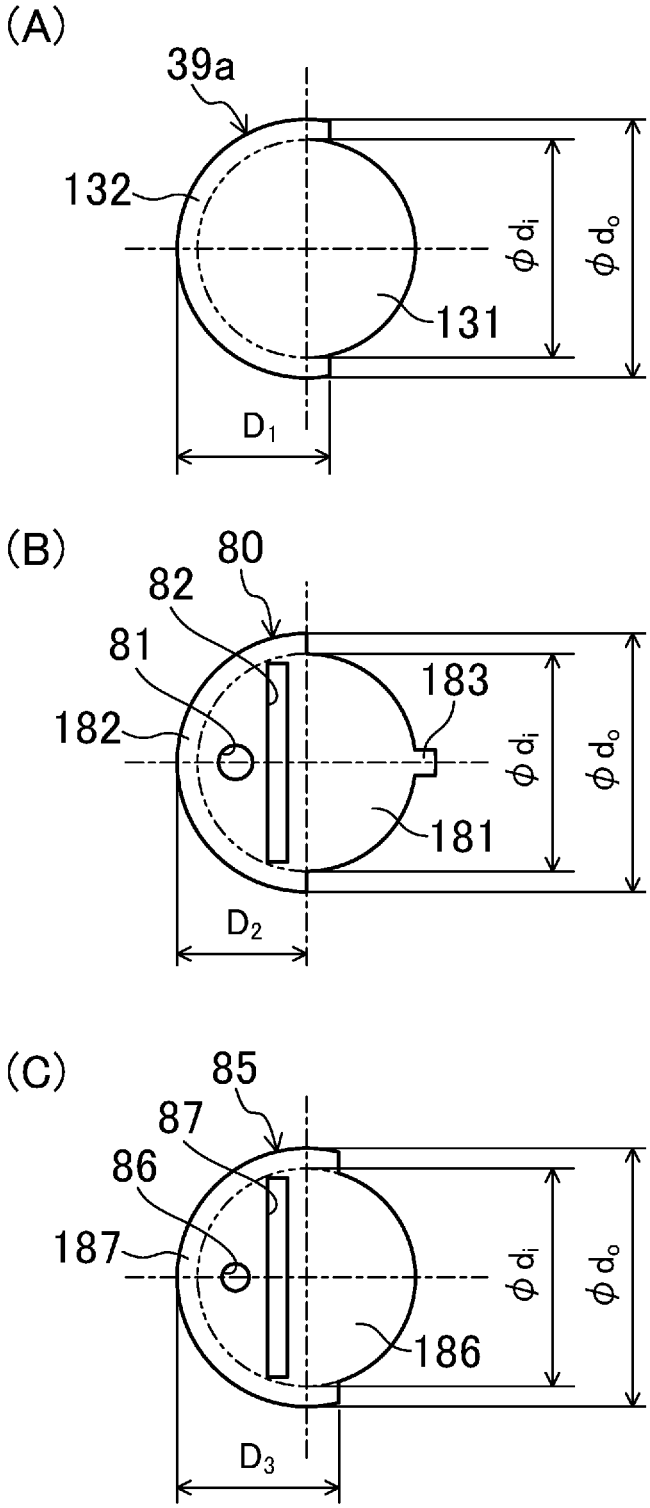
FIGS. 23(A)-23(C) are plan views of partitions provided in the outdoor heat exchanger of the seventh embodiment.

Referring to FIGS. 23(A)-23(C), the partition (39*a*), the upper horizontal partition (80), and the lower horizontal partition (85) are each a flat plate-shaped member having a uniform thickness and including a discoid body (131, 181, 186) and a sealing part (132, 182, 187).

Each discoid body (131, 181, 186) of the partitions (39*a*, 80, 85) is a circular plate having an outer diameter $d_i$ substantially equal to the inner diameter of the body member (160). In each discoid body (131, 181, 186), the sealing part (132, 182, 187) is formed along part of the outer periphery of the discoid body (131, 181, 186). Specifically, the sealing part (132, 182, 187) is a protrusion extending outward from the outer periphery of the discoid body (131, 181, 186) in a radial direction, and the width of the sealing part (132, 182, 187) in the radial direction is uniform. The outer diameter $d_o$ of each sealing part (132, 182, 187) of the partitions (39*a*, 80, 85) is substantially equal to the outer diameter of the body member (160).

The thickness $t_1$ of the partition (39*a*) is, e.g., about 2 mm. The thickness $t_2$ of the upper horizontal partition (80) is, e.g., about 4 mm. The thickness $t_3$ of the lower horizontal partition (85) is, e.g., about 4 mm. That is, the partition (39*a*) is thinner than each of the upper horizontal partition (80) and the lower horizontal partition (85), and the thickness of the upper horizontal partition (80) and the thickness of the lower horizontal partition (85) are equal to each other ($t_1<t_2=t_3$).

Referring to FIG. 23(A), the partition (39*a*) is formed such that the length of the sealing part (132) in a circumferential direction thereof is longer than the half of the outer circumferential length of the discoid body (131). The length between ends of the sealing part (132) in a longitudinal direction thereof is substantially equal to the cutting depth $D_1$ of the insertion hole (161). That is, the sealing part (132) of the partition (39*a*) is in a shape corresponding to the insertion hole (161).

Referring to FIG. 23(B), the upper horizontal partition (80) is formed such that the length of the sealing part (182) in a circumferential direction thereof is substantially equal to the half of the outer circumferential length of the discoid body (181). The length between ends of the sealing part (182) in a longitudinal direction thereof is substantially equal to the cutting depth $D_2$ of the upper insertion hole (162). That is, the sealing part (182) of the upper horizontal partition (80) is in a shape corresponding to the upper insertion hole (162). The protrusion (183) is formed in the upper horizontal partition (80). The protrusion (183) is part protruding from the outer periphery of the discoid body (181), and is positioned opposite to the sealing part (182). Moreover, the through-hole (81) and the slit hole (82) of the upper horizontal partition (80) are formed in a semicircular part of the discoid body (181) close to the sealing part (182).

Referring to FIG. 23(C), the lower horizontal partition (85) is formed such that the length of the sealing part (187) in a circumferential direction thereof is longer than the half of the outer circumferential length of the discoid body (186). The length between ends of the sealing part (187) in a longitudinal direction thereof is substantially equal to the cutting depth $D_3$ of the lower insertion hole (163). That is, the sealing part (187) of the lower horizontal partition (85) is in a shape corresponding to the lower insertion hole (163). Moreover, the through-hole (86) and the slit hole (87) of the lower horizontal partition (85) are formed in a semicircular part of the discoid body (186) close to the sealing part (187).

Referring to FIG. 22, in the process of manufacturing of the outdoor heat exchanger (23), each partition (39*a*) is inserted into a corresponding one of the insertion holes (161) of the body member (160) from the outside of the body member (160), the upper horizontal partition (80) is inserted into the upper insertion hole (162) of the body member (160) from the outside of the body member (160), and the lower horizontal partition (85) is inserted into the lower insertion hole (163) of the body member (160) from the outside of the body member (160).

Figure 24:
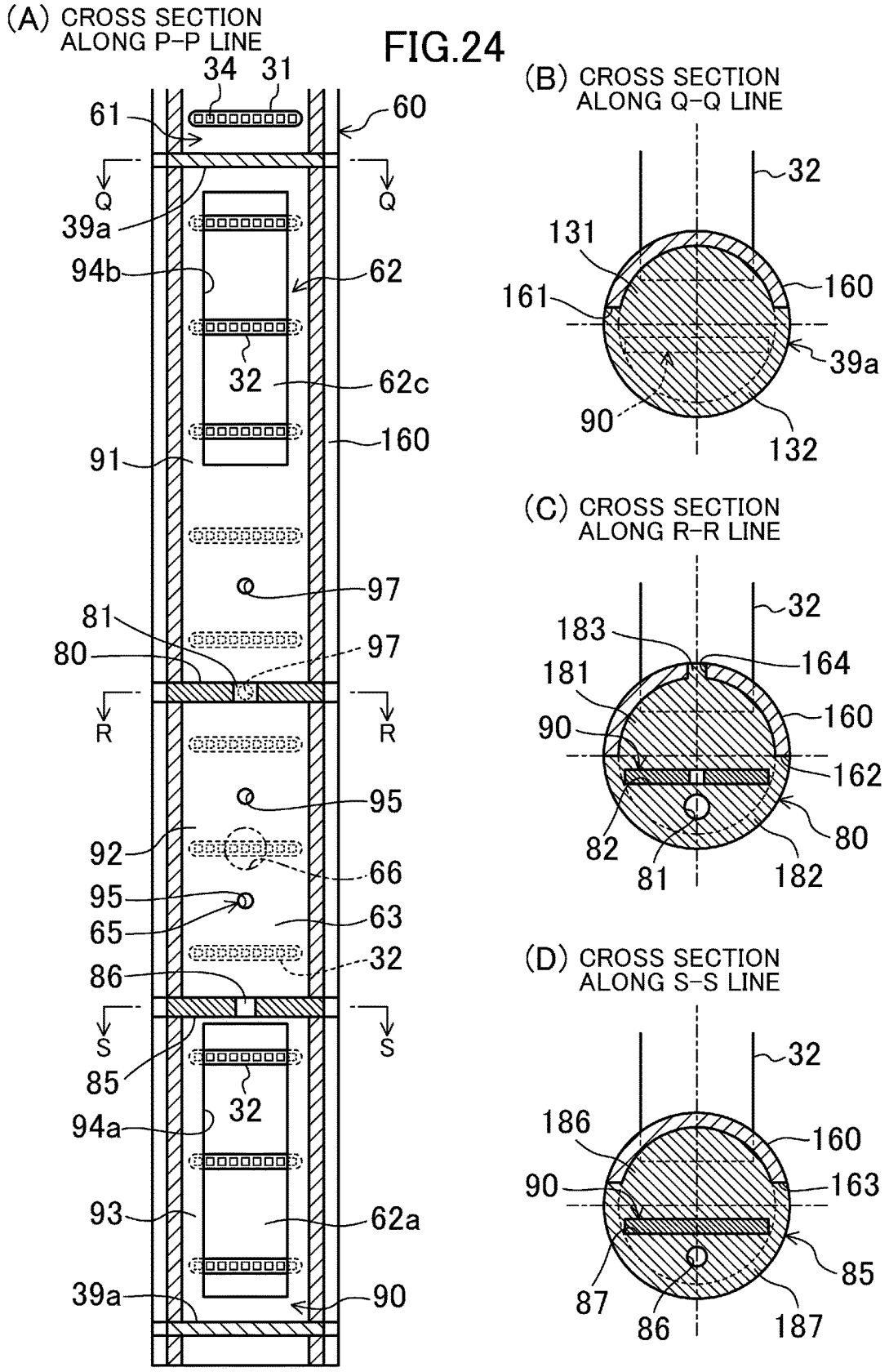
FIGS. 24(A)-24(D) are enlarged cross-sectional views illustrating the main part of the outdoor heat exchanger of the seventh embodiment.

Referring to FIGS. 24(A) and 24(B), in the state in which the partition (39*a*) is inserted into the insertion hole (161), an outer circumferential surface of the discoid body (131) contacts an inner circumferential surface of the body member (160), and an end surface, an upper surface, and a lower surface of the sealing part (132) contact the circumferential edge of the insertion hole (161) of the body member (160). The insertion hole (161) of the body member (160) is closed by the sealing part (132) of the partition (39*a*). A clearance between the partition (39*a*) and the body member (160) is filled with brazing filler metal.

The partition (39*a*) inserted into the insertion hole (161) positioned at the boundary part between the first main heat exchange part (51*a*) and the third auxiliary heat exchange part (52*c*) divides an internal space of the first header collecting pipe (60) into an upper space (61) and a lower space (62). The partition (39*a*) inserted into the insertion hole (161) positioned at a lower end of the body member (160) closes the body member (160) at the lower end thereof, and the partition (39*a*) inserted into the insertion hole (161) positioned at an upper end of the body member (160) closes the body member (160) at the upper end thereof.

Referring to FIGS. 24(A) and 24(C), in the state in which the upper horizontal partition (80) is inserted into the upper insertion hole (162), an outer circumferential surface of the discoid body (181) contacts an inner circumferential surface of the body member (160), and an end surface, an upper surface, and a lower surface of the sealing part (182) contact the circumferential edge of the upper insertion hole (162) of the body member (160). The upper insertion hole (162) of the body member (160) is closed by the sealing part (182) of the upper horizontal partition (80). Moreover, the protrusion (183) of the upper horizontal partition (80) is fitted into the fitting hole (164) of the body member (160). A clearance between the upper horizontal partition (80) and the body member (160) is filled with brazing filler metal.

Referring to FIGS. 24(A) and 24(D), in the state in which the lower horizontal partition (85) is inserted into the lower insertion hole (163), an outer circumferential surface of the discoid body (186) contacts an inner circumferential surface of the body member (160), and an end surface, an upper surface, and a lower surface of the sealing part (187) contact the circumferential edge of the lower insertion hole (163) of the body member (160). The lower insertion hole (163) of the body member (160) is closed by the sealing part (187) of the lower horizontal partition (85). A clearance between the lower horizontal partition (85) and the body member (160) is filled with brazing filler metal.

Advantages of Seventh Embodiment

In the present embodiment, the thickness $t_1$ of the partition (39*a*) is about the half of each of the thicknesses $t_2$, $t_3$ of the upper horizontal partition (80) and the lower horizontal partition (85), and, accordingly, the width of the insertion hole (161) is about the half of each of the widths of the upper insertion hole (162) and the lower insertion hole (163). Thus, it is impossible to insert the upper horizontal partition (80) or the lower horizontal partition (85) into the insertion hole (161). On the other hand, if the partition (39*a*) is inserted into the upper insertion hole (162) or the lower insertion hole (163), a noticeable large clearance is formed therebetween. Consequently, upon assembly of the outdoor heat exchanger (23), a process operator can notice that the partition (39*a*) is attached to an improper position.

Figure 25:
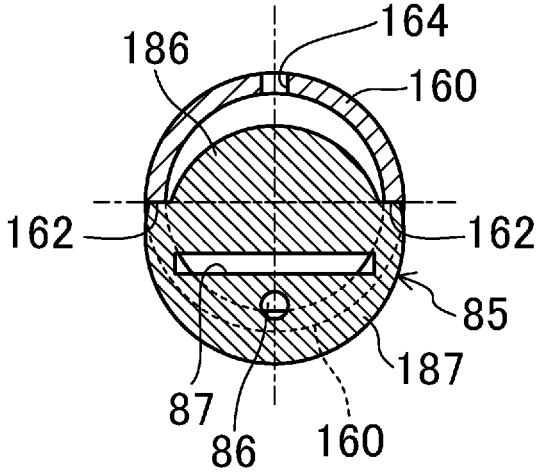
FIGS. 25(A) and 25(B) are cross-sectional views of the first header collecting pipe of the outdoor heat exchanger of the seventh embodiment.
Figure 25:
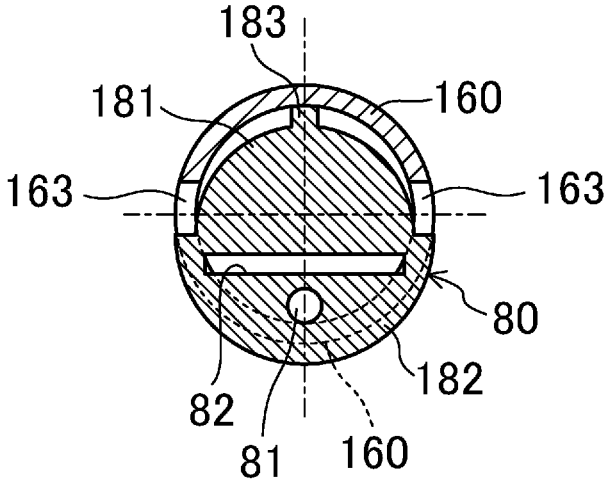

In the present embodiment, the cutting depth $D_2$ of the upper insertion hole (162) is shorter than the longitudinal length $D_3$ of the sealing part (187) of the lower horizontal partition (85). Thus, if the lower horizontal partition (85) is mistakenly inserted into the upper insertion hole (162), an end part of the sealing part (187) comes into contact with the body member (160) before the discoid body (186) contacts the inner circumferential surface of the body member (160) as illustrated in FIG. 25(A), thereby bringing about the state in which the sealing part (187) protrudes out from the body member (160). That is, the upper insertion hole (162) cannot be closed by the sealing part (187) of the lower horizontal partition (85). Consequently, upon assembly of the outdoor heat exchanger (23), a process operator can notice that the lower horizontal partition (85) is attached to an improper position.

In the present embodiment, the protrusion (183) is formed in the upper horizontal partition (80), whereas the fitting hole (164) is not formed in part of the body member (160) facing the lower insertion hole (163). Thus, if the upper horizontal partition (80) is mistakenly inserted into the lower insertion hole (163), the protrusion (183) comes into contact with the inner circumferential surface of the body member (160) before an end part of the sealing part (182) contacts the body member (160), thereby bringing about the state in which the sealing part (182) protrudes out from the body member (160). That is, the lower insertion hole (163) cannot be closed by the sealing part (182) of the upper horizontal partition (80). Consequently, upon assembly of the outdoor heat exchanger (23), a process operator can notice that the upper horizontal partition (80) is attached to an improper position.

As just described, in the process of manufacturing of the outdoor heat exchanger (23) of the present embodiment, a process operator cannot insert the upper horizontal partition (80) or the lower horizontal partition (85) into the insertion hole (161). If a process operator mistakenly attaches the partition (39*a*, 80, 85) to an improper part of the body member (160), the process operator can promptly notice that an abnormality occurs. Thus, according to the present embodiment, the three types of partitions (39*a*, 80, 85) can be prevented from being attached to improper positions of the first header collecting pipe (60), and therefore the rate of occurrence of defective products which do not normally function can be reduced.

Variation of Seventh Embodiment

In the outdoor heat exchanger (23) of the present embodiment, the thickness $t_1$ of the partition (39*a*), the thickness $t_2$ of the upper horizontal partition (80), and the thickness $t_3$ of the lower horizontal partition (85) may be different from each other ($t_1 \neq t_2$, $t_2 \neq t_3$, $t_3 \neq t_1$).

In this case, the cutting depth $D_1$ of the insertion hole (161), the cutting depth $D_2$ of the upper insertion hole (162), and the cutting depth $D_3$ of the lower insertion hole (163) may be equal to each other, or may be different from each other. However, in this case, the cutting depth $D_1$ of the insertion hole (161) and the longitudinal length of the sealing part (132) of the partition (39*a*) should be substantially equal to each other, the cutting depth $D_2$ of the upper insertion hole (162) and the longitudinal length of the sealing part (182) of the upper horizontal partition (80) should be substantially equal to each other, and the cutting depth $D_3$ of the lower insertion hole (163) and the longitudinal length of the sealing part (187) of the lower horizontal partition (85) should be substantially equal to each other.

In addition to the foregoing, the protrusion (183) may be omitted from the upper horizontal partition (80), or the protrusion (183) may be additionally provided in the lower horizontal partition (85).

Other Embodiments

First Variation

In the outdoor heat exchanger (23) of the first to fifth embodiments, the mass flow rate of refrigerant flowing into the communication chamber (62*a*-62*c*) from the mixing chamber (63) is not always equal among the communication chambers (62*a*-62*c*).

For example, in the outdoor heat exchanger (23) provided in the outdoor unit (11) of the air conditioner (10), it is often case that the flow velocity of air passing through the main heat exchange part (51*a*-51*c*) is not equal among the main heat exchange parts (51*a*-51*c*). In this case, the flow rate of refrigerant flowing through the main heat exchange part (51*a*-51*c*) through which air passes at relatively-high flow velocity preferably increases, whereas the flow rate of refrigerant flowing through the main heat exchange part (51*a*-51*c*) through which air passes at relatively-low flow velocity preferably decreases. Thus, in this case, the mass flow rate of refrigerant flowing into the communication chamber (62*a*-62*c*) from the mixing chamber (63) may be sometimes different among the communication chambers (62*a*-62*c*).

Suppose that the flow velocity of air passing through the second main heat exchange part (51*b*) is higher than the flow velocity of air passing through each of the first main heat exchange part (51*a*) and the third main heat exchange part (51*c*). In this case, the mass flow rate of refrigerant flowing through the second main heat exchange part (51*b*) is preferably higher than the mass flow rate of refrigerant flowing through each of the first main heat exchange part (51*a*) and the third main heat exchange part (51*c*). In the state in which the outdoor heat exchanger (23) functions as the evaporator, it is necessary that the mass flow rate of refrigerant flowing through the second auxiliary heat exchange part (52*b*) is higher than the mass flow rate of refrigerant flowing through each of the first auxiliary heat exchange part (52*a*) and the third auxiliary heat exchange part (52*c*).

In this case, e.g., the shapes of the through-holes (81, 86, 95) forming the distribution paths (65) are determined such that the mass flow rate of refrigerant flowing into the second communication chamber (62*b*) from the mixing chamber (63*a*) is higher than the mass flow rate of refrigerant flowing into each of the first communication chamber (62*a*) and the third communication chamber (62*c*) from the mixing chamber (63*a*). For example, in the outdoor heat exchanger (23) of the first embodiment, the total area of the through-holes (95) of the vertical partition (90) is larger than each of the area of the through-hole (81) of the upper horizontal partition (80) and the area of the through-hole (86) of the lower horizontal partition (85).

Second Variation

In each outdoor heat exchanger (23) of the first to seventh embodiments, wave-shaped fins may be provided instead of the plate-shaped fins (36). Such fins are so-called corrugated fins, and are in a wave shape meandering up and down. Each wave-shaped fin is disposed between adjacent ones of the flat tubes (31, 32) adjacent to each other in the vertical direction.

INDUSTRIAL APPLICABILITY

As described above, the present disclosure is useful for the heat exchanger including the flat tubes connected to each header collecting pipe.

DESCRIPTION OF REFERENCE CHARACTERS

23 Outdoor Heat Exchanger (Heat Exchanger)
32 Flat Tube
36 Fin
51 Main Heat Exchange Region
51*a* First Main Heat Exchange Part
51*b* Second Main Heat Exchange Part
51*c* Third Main Heat Exchange Part
52 Auxiliary Heat Exchange Region
52*a* First Auxiliary Heat Exchange Part
52*b* Second Auxiliary Heat Exchange Part
52*c* Third Auxiliary Heat Exchange Part
55 Liquid-Side Connection Pipe (Tubular Member)
56 Connection End Part (End Part)
60 First Header Collecting Pipe
62*a* First Communication Chamber
62*b* Second Communication Chamber
62*c* Third Communication Chamber
63 Mixing Chamber
63*a* Upper Mixing Chamber
63*b* Lower Mixing Chamber
64 Center Axis
65 Distribution Path
66 Connection Port

70 Second Header Collecting Pipe
80 Upper Horizontal Partition
81 Through-Hole for Communication
85 Lower Horizontal Partition
86 Through-Hole for Communication
90 Vertical Partition
95 Through-Hole for Communication
102 Through-Hole for Communication (Connection Path)
103 First Communication Pipe (Connection Path)
104 Second Communication Pipe (Connection Path)
110 Mixing Partition (Partition)
111 Through-Hole for Mixing (Through-Hole)
160 Body Member
162 Upper Insertion Hole
163 Lower Insertion Hole
182 Sealing Part (of Upper Horizontal Partition)
187 Sealing Part (of Lower Horizontal Partition)

The invention claimed is:

1. A heat exchanger, comprising:

a plurality of flat tubes, each flat tube having a first end and a second end;

a first header collecting pipe connected to first ends of the flat tubes;

a second header collecting pipe connected to second ends of the flat tubes; and a plurality of fins joined to the flat tubes, wherein the heat exchanger is configured to exchange heat between fluid flowing through each flat tube and air flowing outside the each flat tube, and is capable of functioning as an evaporator, the first header collecting pipe and the second header collecting pipe are in a vertical orientation, the first header collecting pipe includes a side wall extending parallel to an axial direction of the first header collecting pipe, a connection port connected to a pipe through which refrigerant flows and formed in said side wall, a mixing chamber communicating with the connection port and configured to mix liquid refrigerant and gas refrigerant of gas-liquid refrigerant flowing into the mixing chamber through the connection port to homogenize the gas-liquid refrigerant, a plurality of communication chambers arranged in a vertical direction and each communicating with one or more of the flat tubes, a plurality of distribution paths configured to distribute the homogenized refrigerant of the mixing chamber to the communication chambers, a vertical partition provided along the axial direction of the first header collecting pipe and configured to separate at least one of the communication chambers from the mixing chamber, and a horizontal partition provided so as to intersect the axial direction of the first header collecting pipe and configured to separate the communication chambers adjacent to each other in the vertical direction from each other, the connection port faces the vertical partition, the communication chambers of the first header collecting pipe include three or more communication chambers, the horizontal partition includes an upper horizontal partition configured to separate a first part of an uppermost one of the communication chambers from an adjacent one of the communication chambers and to separate a second part of the uppermost communication chamber from the mixing chamber, and a lower horizontal partition configured to separate a first part of a lowermost one of the communication chambers from an adjacent one of the communication chambers and to separate a second part of the lowermost communication chamber from the mixing chamber, the vertical partition is configured to separate the mixing chamber from one or more of the communication chambers positioned between the upper horizontal partition and the lower horizontal partition, and respective walls of the mixing chamber are formed by portions of the vertical partition, the upper horizontal partition, the lower horizontal partition, and the side wall of the first header collecting pipe.

2. The heat exchanger of claim 1, wherein a through-hole for communication is formed in the vertical partition such that the at least one communication chamber positioned between the upper horizontal partition and the lower horizontal partition communicates with the mixing chamber, a through-hole for communication is formed in the upper horizontal partition such that the uppermost one of the communication chambers communicates with the mixing chamber, a through-hole for communication is formed in the lower horizontal partition such that the lowermost one of the communication chambers communicates with the mixing chamber, and the through-hole of the vertical partition, the through-hole of the upper horizontal partition, and the through-hole of the lower horizontal partition form the distribution paths.

3. The heat exchanger of claim 2, wherein the through-hole of the vertical partition is formed so as not to face the connection port.

4. The heat exchanger of claim 1, wherein a distance from the vertical partition to the connection port is smaller than a distance from the connection port to a center axis of the first header collecting pipe.

5. The heat exchanger of claim 1, wherein the first header collecting pipe further includes a cylindrical body member to which the upper horizontal partition and the lower horizontal partition are attached and in which the communication chambers and the mixing chamber are formed, the body member is formed with an upper insertion hole into which the upper horizontal partition is inserted from outside of the body member, and a lower insertion hole into which the lower horizontal partition is inserted from the outside of the body member, the upper insertion hole and the lower insertion hole are different from each other in shapes, in the upper horizontal partition, a sealing part formed in a shape corresponding to the upper insertion hole and closing the upper insertion hole is formed, and in the lower horizontal partition, a sealing part formed in a shape corresponding to the lower insertion hole and closing the lower insertion hole is formed.

6. The heat exchanger of claim 1, wherein the vertical partition faces end surfaces of the flat tubes connected to the first header collecting pipe.

7. The heat exchanger of claim 1, further comprising:

a tubular member attached to the first header collecting pipe and connected to the connection port, wherein a pipe through which refrigerant flows is connected to the connection port through the tubular member, and the tubular member is in such a shape that an end part of the tubular member connected to the connection port is narrowed.

8. The heat exchanger of claim 1, wherein the heat exchanger is divided into a main heat exchange region including some of the flat tubes and an auxiliary heat exchange region including the remaining flat tubes, the auxiliary heat exchange region is positioned below the main heat exchange region, the auxiliary heat exchange region is divided into a plurality of auxiliary heat exchange parts each auxiliary heat exchange part including multiple ones of the remaining flat tubes and each auxiliary heat exchange part corresponding to one of the communication chambers, the flat tubes in each auxiliary heat exchange part communicate with a corresponding one of the communication chambers, the main heat exchange region is divided into a plurality of main heat exchange parts each main heat exchange part including multiple ones of the some of the flat tubes and each main heat exchange part corresponding to one of the auxiliary heat exchange parts, and the flat tubes in each main heat exchange part communicate, through the second header collecting pipe, with the flat tubes in a corresponding one of the auxiliary heat exchange parts.

9. The heat exchanger of claim 3, wherein a distance from the vertical partition to the connection port is smaller than a distance from the connection port to a center axis of the first header collecting pipe.

10. The heat exchanger of claim 2, wherein the vertical partition faces end surfaces of the flat tubes connected to the first header collecting pipe.

* * * * *